US005126234A

United States Patent [19]

Naruse et al.

[11] Patent Number: 5,126,234

[45] Date of Patent: Jun. 30, 1992

[54] METHOD FOR PROCESSING A SILVER HALIDE COLOR PHOTOGRAPHIC MATERIAL

[75] Inventors: Hideaki Naruse; Hiroshi Fujimoto; Yasuhiro Yoshioka, all of Kanagawa, Japan

[73] Assignee: Fuji Photo Film Co., Ltd., Kanagawa, Japan

[21] Appl. No.: 392,498

[22] Filed: Aug. 11, 1989

[30] Foreign Application Priority Data

Aug. 12, 1988 [JP] Japan ..... 63-202525

[51] Int. Cl.[5] ..... G03C 7/384; G03C 7/392; G03C 7/44

[52] U.S. Cl. ..... 430/372; 430/387; 430/399; 430/434; 430/551; 430/555

[58] Field of Search ..... 430/372, 387, 434, 464, 430/467, 551, 558, 399, 555

[56] References Cited

U.S. PATENT DOCUMENTS

| | | | |
|---|---|---|---|
| 2,735,765 | 2/1956 | Loria et al. | 430/551 |
| 3,227,550 | 1/1966 | Whitmore et al. | 430/557 |
| 3,876,428 | 4/1975 | Murin et al. | 430/565 |
| 4,138,259 | 2/1979 | Adachi et al. | 430/554 |
| 4,198,239 | 4/1980 | Credner et al. | 430/566 |
| 4,543,323 | 9/1985 | Iijima et al. | 430/553 |
| 4,732,845 | 3/1988 | Keiji et al. | 430/551 |
| 4,770,987 | 9/1988 | Takahashi et al. | 430/546 |
| 4,853,319 | 8/1989 | Krishnamurthy et al. | 430/555 |
| 4,939,074 | 7/1990 | Ishikawa | 430/399 |

FOREIGN PATENT DOCUMENTS

| | | |
|---|---|---|
| 255722 | 2/1988 | European Pat. Off. . |
| 56-21145 | 5/1981 | Japan . |
| 88/04795 | 6/1988 | PCT Int'l Appl. . |

OTHER PUBLICATIONS

James, *The Theory of the Photographic Process*, 4th ed., pp. 413–417, and pp. 426–428, 1977.

Research Disclosure 17643, "Photographic silver halide . . . , " pp. 22–31, Dec. 1978.

*Primary Examiner*—Lee C. Wright

*Attorney, Agent, or Firm*—Sughrue, Mion, Zinn, Macpeak & Seas

[57] ABSTRACT

A method for processing a silver halide color photographic material, wherein the silver halide color photographic material having a layer containing at leasst one pyrazolone-based magenta coupler having a coupling releasing group represented by formula (I) and at least one compound represented by formula (II), (III), (IV) or (V) is processed with a color developing solution having a developing solution temperature of 36° to 50° C. and a developing solution pH of 10.3 to 12.0;

(I)

(II)

(III)

$R^{11}—Z_2$ (IV)

(V)

wherein the substituents are as defined in the text of the specification.

7 Claims, No Drawings

METHOD FOR PROCESSING A SILVER HALIDE COLOR PHOTOGRAPHIC MATERIAL

FIELD OF THE INVENTION

The present invention relates to a method for processing a silver halide color photographic material. More specifically, it relates to a method for processing a silver halide color photographic material with which little fog is generated and with which a good color forming property can be obtained even if a development processing is carried out at a high temperature and a high pH.

BACKGROUND OF THE INVENTION

The processing of silver halide color photographic materials basically comprises the two steps of (a) color development (with a preceding initial black-and-white development in the case of color reversal materials) and (b) desilvering, in which the desilvering comprises a bleaching step and a fixing step or a combined bleach-fixing step used in conjunction with these or independently. In addition to the above steps, additional processing steps, which is to say washing, stop processing, stabilization processing and preceding processing for development acceleration, are applied, if desired.

In color development, as the exposed silver halides are reduced to silver, the primary aromatic amine developing agent which is oxidized reacts with couplers to form dyes. In this process, the halogen ions which are produced by the decomposition of the silver halides are eluted and built up in the developing solution. On the other hand, the color developing agent is exhausted by the reaction with the couplers mentioned above. Furthermore, other components are taken out by being held in the photographic material and the concentration of the components in the developing solution is reduced. Therefore, in development processing methods continuously processing large amounts of silver halide photographic materials using an automatic developing machine or the like, a means for maintaining the components of the color developing solution in a fixed concentration range in order to avoid variation in the finished development characteristics caused by changes in the concentration of components is required.

When there is little influence from concentration, the concentration of exhausted components such as developing agents and preservatives is generally raised in the replenisher. Furthermore, with eluents having a development inhibiting effect such as halogens, there will be cases in which their concentration will be lowered or in which they are not included in the replenisher. Again, it is also possible that certain compounds may be included in the replenisher in order to remove the influence of the eluents. Furthermore, there are also cases in which the pH and the concentration of alkalis or chelating agents and the like are adjusted. The method in which replenishers are supplied to replenish insufficient components and to dilute increased components is commonly adopted as such a means. The supply of these replenishers inevitably generates a large amount of overflow which constitutes a major problem of economics and of pollution.

In recent years, a reduction in replenishment amounts for color developing solutions has become highly desirable from the standpoint of rapid development processing as well as saving on raw materials and reducing pollution. However, if the replenishment amounts of the color developing solution are merely reduced, problems of reduction in development activity and loss of rapidity occur due to elution from the photosensitive materials and the accumulation of various organic compounds and bromine ions which are particularly strong developing inhibitors. A developing acceleration technique is necessary as a means for resolving these problems and many accelerating techniques have been investigated to reduce the replenishment amounts of the developing solution.

For example, the accelerating means in which development is accelerated by raising the pH and the processing temperature of the color developing solution is known. With this method, however, there are problems in that it is still insufficient for obtaining a sufficient color density and in that the fog is generated during processing. This phenomenon is particularly pronounced in magenta color image-forming layers with high light absorbency, and is a major problem. On the other hand, methods in which developing acceleration is effected using couplers having high color-forming ability can also be envisaged. Use of highly active magenta couplers as described in JP-A-60-057839 (the term "JP-A" as used herein refers to a "published unexamined Japanese patent application") and U.S. Pat. No. 4,351,897 is known, but while it may be said that the color-forming ability is improved, these are insufficient and satisfactory results cannot be obtained. Also, use of more highly active magenta couplers as described in WO 88/04795 is known.

The magenta couplers as described in WO 88/04795 are highly active and sufficient color densities are obtained, but it is known that a degree of fogging is high and satisfactory photographic properties are not obtained if they are developed in high temperature, high pH color developing solutions. In this respect, a technique with which fogging is inhibited and with which sufficient color densities are obtained is strongly to be desired.

SUMMARY OF THE INVENTION

An object of the present invention is to provide a method for rapidly processing a color photographic material with which fogging is inhibited and with which a sufficient color density is obtained.

The above and other objects are achieved by a method for processing a silver halide color photographic material, wherein the silver halide color photographic material having a layer containing at least one pyrazolone-based magenta coupler having a coupling releasing group represented by formula (I) and at least one compound represented by formula (II), (III), (IV) or (V) is processed with a color developing solution having a developing solution temperature of 36° to 50° C. and a developing solution pH of 10.3 to 12.0;

(I)

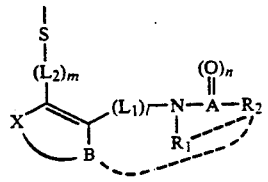

wherein $L_1$ and $L_2$ represent a methylene group or an ethylene group; l and m represent 0 or 1; $R_1$ represents a hydrogen atom, an alkyl group, an aryl group or a heterocyclic group; $R_2$ represents a carbon atom, an oxygen atom, a nitrogen atom or a sulfur atom and represents a group which bonds with A; A represents a carbon atom or a sulfur atom; when A is a carbon atom, n represents 1, and when A is a sulfur atom, n represents 1 or 2; B represents a carbon atom, an oxygen atom, a nitrogen atom or a sulfur atom; X represents an atomic group necessary to form a ring; $R_1$ and $R_2$ may bond together to form a ring; and when B is a carbon atom or a nitrogen atom, B and $R_2$ may bond together to form a ring;

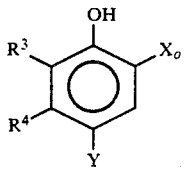

(II)

wherein $X_0$ represents a substituted or unsubstituted alkyl. alkoxy, aryloxy, alkylthio, arylthio, amido or sulfonamide group; $R^3$ and $R^4$ represent the same groups as $X_0$ or a hydrogen atom, a halogen atom, a sulfo group, a carboxyl group, or a substituted or unsubstituted carbamoyl, sulfamoyl, acyl or sulfonyl group; $R^3$ and $R^4$ may form a carbon ring together; and Y represents a hydroxyl group or a sulfonamide group;

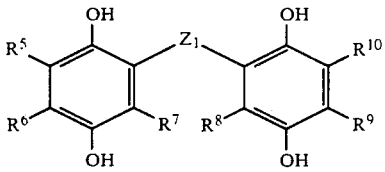

(III)

wherein $R^5$, $R^6$, $R^7$, $R^8$, $R^9$ and $R^{10}$ represent a hydrogen atom, a halogen atom, a sulfo group, a carboxyl group, a cyano group, an alkyl group, an aryl group, an acylamino group, a sulfonamide group, an alkoxy group, an aryloxy group, an alkylthio group, an arylthio group, an acyl group, an acyloxy group, a sulfonyl group, a carbamoyl group, an alkoxycarbonyl group or a sulfamoyl group; or $R^5$ and $R^6$, $R^9$ and $R^{10}$ may form a carbon ring or a heterocyclic ring together; and $Z_1$ represents a single bond or a divalent organic group;

$$R^{11}—Z_2 \quad \text{(IV)}$$

wherein $R^{11}$ represents an aliphatic group, an aromatic group or a heterocyclic group; and $Z_2$ represents a nucleophilic group or a group which decomposes in the photosensitive material to release a nucleophilic group; and

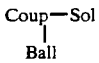

(V)

wherein Coup represents a residual group of compound having an active coupling position; Ball is a group which has the required size and form to impart diffusion resistance properties to the compound represented by formula (V) and represents a group which is capable of releasing from Coup by a coupling reaction; and Sol is a solubilizing group and represents a group which is bonded to a non-coupling position of Coup and which enables a coupling compound produced by a coupling reaction to elute from the photosensitive material outside the system during processing.

DETAILED DESCRIPTION OF THE INVENTION

Formulae (I) to (V) are described in detail below. The pyrazolone-based magenta couplers employed in the present invention have coupling-releasing groups represented by formula (I). Various substituent groups for formula (I) are now explained in detail.

$L_1$ and $L_2$ represent a substituted or unsubstituted methylene or ethylene group having 1 to 30 carbon atoms. Examples of the substituent for $L_1$ and $L_2$ include a halogen atom (for example, fluorine, chlorine, bromine), an alkyl group (for example, straight chain or branched alkyl, aralkyl, alkenyl, alkynyl, cycloalkyl and cycloalkenyl groups having from 1 to 22 carbon atoms), an aryl group (for example, phenyl, naphthyl), a heterocyclic group (for example, 2-furyl, 3-pyridyl), an alkoxy group (for example, methoxy, ethoxy, cyclohexyloxy), an aryloxy group (for example, phenoxy, p-methoxyphenoxy, p-methylphenoxy), an alkylamino group (for example, ethylamino, dimethylamino), an alkoxycarbonyl group (for example, methoxycarbonyl, ethoxycarbonyl), a carbamoyl group (for example, N,N-dimethylcarbamoyl), an anilino group (for example, phenylamino, N-ethylanilino), a sulfamoyl group (for example, N,N-diethylsulfamoyl), an alkylsulfonyl group (for example, methylsulfonyl), an arylsulfonyl group (for example, tolylsulfonyl), an alkylthio group (for example, methylthio, octylthio), an arylthio group (for example, phenylthio, 1-naphthylthio), an acyl group (for example, acetyl, benzoyl), an acylamino group (for example, acetamido, benzamido), an imido group (for example, imidosuccinate, imidophthalate), a ureido group (for example, phenylureido, N,N-dibutylureido), a sulfamoylamino group (for example, N,N-dipropylsulfamoylamino), an alkoxycarbonylamino group (for example, methoxycarbonylamino), a sulfonamide group (for example, methanesulfonamide), a hydroxyl group, a cyano group and the like. The preferred groups represented by $L_1$ and $L_2$ are unsubstituted methylene or ethylene groups. l and m represent 0 or 1 and preferably 0.

$R_1$ represents a hydrogen atom, an alkyl group, an aryl group or a heterocyclic group. Specifically, it represents a hydrogen atom, a straight chain or branched alkyl, alkenyl or cycloalkyl group having from 1 to 22 carbon atoms or other such alkyl group having from 1 to 22 carbon atoms, an aryl group such as phenyl or naphthyl, a heterocyclic group such as 2-furyl, 2-thienyl, 2-pyrimidinyl or 4-pyridyl group. These may further have the substituents defined for $L_1$ and $L_2$. Preferably, $R_1$ is a hydrogen atom or an alkyl group.

$R_2$ is a carbon atom, an oxygen atom, a nitrogen atom and a sulfur atom and represents a group which bonds with A. Specifically, it represents a group bonded with a carbon atom such as alkyl, aryl, heterocyclic (bonded with carbon), acyl, alkoxycarbonyl, carbamoyl; a group bonded with an oxygen atom such as alkoxy, aryloxy; a group bonded with a nitrogen atom such as alkylamino, anilino, acylamino, ureido, sulfamoylamino, alkoxycarbonylamino, sulfonamide; or a group bonded with a sulfur atom such as alkylthio, arylthio. As with $R_1$, these may further have the substituents defined for $L_1$ and $L_2$. Preferably, $R_2$ is an alkyl group having 1 to 30 carbon atoms, an aryl group, an alkylamino group or an anilino group.

A represents a carbon atom or a sulfur atom and preferably represents a carbon atom.

When A is a carbon atom, n represents 1, and when A is a sulfur atom, n represents 1 or 2.

B represents a carbon atom, an oxygen atom, a nitrogen atom or a sulfur atom, preferably represents a carbon atom or a nitrogen atom and more preferably represents a carbon atom.

X represents an atomic group necessary to form a ring. It preferably represents an atomic group constructed of atoms selected from carbon atoms, oxygen atoms, nitrogen atoms or sulfur atoms, necessary to form a saturated or unsaturated 5-, 6- or 7-membered ring. More preferably, it represents an atomic group constructed of atoms selected from oxygen atoms and nitrogen atoms, necessary to form an unsaturated 5- or 6-membered ring. This ring may further have the substituents defined for $L_1$ and $L_2$ as mentioned above, and other rings may be condensed onto a ring containing X.

$R_1$ and $R_2$ may bond together to form a ring, and preferably they bond to form the 5- or 6-membered ring of a saturated or unsaturated ring. Furthermore, this ring may further have the substituents defined for $L_1$ and $L_2$.

When B is a carbon atom or a nitrogen atom, B and $R_2$ may bond together to form a ring, and preferably they form the 5- or 6-membered ring of a saturated or unsaturated ring. More preferably, they form a 5- or 6-membered saturated ring. Moreover, this ring may further have the substituents defined for $L_1$ and $L_2$.

The first preferred pyrazolone couplers can be represented by formula (I-1):

(I-1)

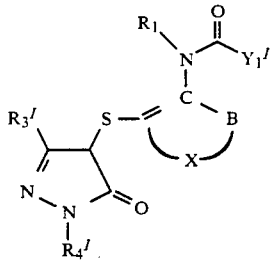

In formula (I-1), $Y_1^I$ represents Ra or $Z_1^I$Rb. Ra represents a substituted or unsubstituted aryl or 5- to 8-membered heterocyclic group, or a substituent having secondary or tertiary groups represented by

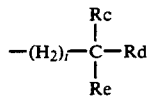

and i represents 0 or 1.

$Z_1^I$ represents an oxygen atom, a sulfur atom or NRf. Rb represents a substituted or unsubstituted alkyl having 1 to 30 carbon atoms, aryl or 5- to 8-membered heterocyclic group. Rc and Rd represent halogen atoms or groups selected from the group consisting of Rb and $Z_2^I$Rg. Re represents a hydrogen atom or a group defined for Rc and Rd. Rf represents a hydrogen atom and a group defined for Rb. $Z_2^I$ represents an oxygen atom, a sulfur atom or NRh. Rg represents a group defined for Rf. Rh represents a group defined for Rf. Rc may bond with at least one of Rd and Re to form 1 or 2 carbon rings or hetero rings and these may further have substituents defined for $L_1$ and $L_2$. $R_1$, X and B in formula (I-1) have the same meaning as the $R_1$, X and B substituents, atomic groups and atoms mentioned above for formula (I).

$R_3^I$ represents an anilino group, an acylamino group, a ureido group, a carbamoyl group, an alkoxy group, an aryloxycarbonyl group, an alkoxycarbonyl group or an N-heterocyclic group, and these groups are preferably groups having oil-solubilizing groups. $R_4^I$ is a substituted or unsubstituted aryl group, preferably a substituted phenyl group and more preferably the 2,4,6-trichlorophenyl group.

Further preferred pyrazolone couplers of this formula (I-1) can be represented by formula (I-1'):

(I-1')

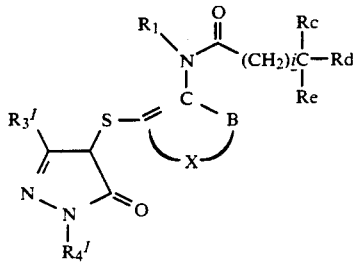

In formula (I-1'), $R_1$, $R_3^I$, $R_4^I$, Rc, Rd, Re, X and B have the same meaning as in formulae (I) and (I-1). i represents 0 or 1.

Second preferred pyrazolone couplers can be represented by formula (I-2):

(I-2)

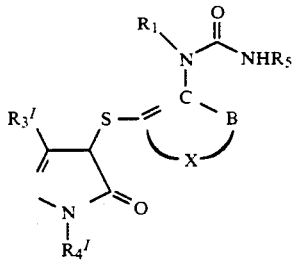

In formula (I-2), $R_5$ represents a substituted or unsubstituted alkyl, aryl or heterocyclic group. $R_1$, $R_3^I$, $R_4^I$, X and B have the same meaning as in formulae (I) and (I-1). Preferably, $R_3^I$ is a group represented by —NH—$Y_2$ and $R_4^I$ is the 2,4,6-trichlorophenyl group. $Y_2$ represents a substituted or unsubstituted aryl, arylcarbonyl or arylaminocarbonyl group.

Third preferred pyrazolone couplers can be represented by formula (I-3):

(I-3)

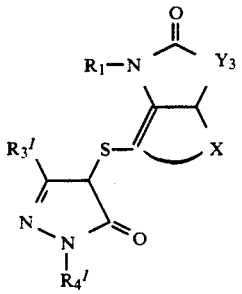

In formula (I-3), $R_1$, $R_3^I$, $R_4^I$ and X have the same meaning as in formulae (I), (I-1) and (I-2). $Y_3$ represents a substituted or unsubstituted methylene or ethylene group. or >NRf. Rf has the same meaning as the above-mentioned substituents. Preferred pyrazolone couplers of this formula (I-3) can be represented by formula (I-3'):

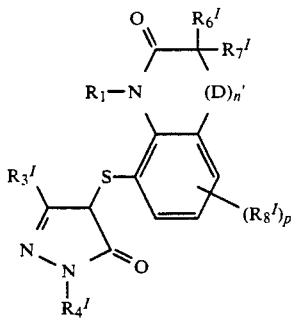

(I-3')

In formula (I-3'), $R_1$, $R_3^I$ and $R_4^I$ have the same meaning as in formulae (I), (I-1) and (I-2). $R_6^I$ and $R_7^I$ represent alkyl groups having 1 to 30 carbon atoms and aryl groups and $R_8^I$ represents the substituent groups defined for the above-mentioned $L_1$ and $L_2$. D represents a methylene group, an oxygen atom, a nitrogen atom or a sulfur atom. When it is a methylene group, n' represents an integer of from 0 to 2, but in other cases n' represents 1. p represents an integer of from 0 to 3.

In the following, "coupler moiety" indicates the moiety other than the coupling-releasing group and "coupler" indicates the whole entity including both the coupler moiety and the coupling-releasing group.

The "coupler moiety" forms a dye, and particularly a magenta dye, by reacting with the oxidized color developing agent and is a pyrazolone coupler which is well known and used in the photographic industry. Examples of preferred pyrazolone coupler moieties include those described in U.S. Pat. Nos. 4,413,054, 4,443,536, 4,522,915, 4,336,325, 4,199,361, 4,351,897, 4,385,111, JP-A-60-170854, JP-A-60-194452, JP-A-60-194451, U.S. Pat. Nos. 4,407,936, 3,419,391, 3,311,476, British Patent 1,357,372, U.S. Pat. Nos. 2,600,788, 2,908,573, 3,062,653. 3,519,429, 3,152,896, 2,311,082, 2,343,703 and 2,369,489. In these patents, when coupling-releasing groups are substituted on the pyrazolone coupler moiety, it is possible to replace these having the coupling-releasing groups represented by formula (I) of the present invention. It is also possible to use the pyrazolone couplers of the present invention in conjunction with other pyrazolone couplers such as those mentioned in the above patents.

Examples of a preferred "coupler" can be represented by formula (I-C):

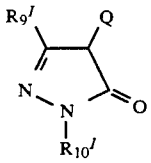

(I-C)

In the above formula (I-C), Q represents the coupling-releasing group of the present invention represented by formula (I). $R_9^I$ represents an anilino, acylamino, ureido, carbamoyl, alkoxy, aryloxycarbonyl, alkoxycarbonyl or N-heterocyclic group. $R_{10}^I$ is a substituted or unsubstituted aryl group and preferably a phenyl group having at least one substituent selected from halogen atoms, alkyl, alkoxy, alkoxycarbonyl, acylamino, sulfamide, sulfonamide and cyano groups. The carbon atoms and nitrogen atoms in these substituent groups may be unsubstituted or may be substituted with groups which do not reduce the effects of the coupler. $R_9^I$ is preferably an anilino group and more preferably an anilino group represented by the following formula:

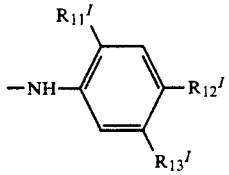

In the above formula, $R_{11}^I$ is an alkoxy group having 1 to 30 carbon atoms, an aryloxy group or a halogen atom (preferably, a chlorine atom).

$R_{12}^I$ and $R_{13}^I$ respectively represent a hydrogen atom, a halogen atom (for example, chlorine, bromine, fluorine), an alkyl group (for example, an alkyl group having 1 to 30 carbon atoms), an alkoxy group (for example, an alkoxy group having 1 to 30 carbon atoms), an acylamino group, a sulfonamide group, a sulfamoyl group, a sulfamide group, a carbamoyl group, a diacylamino group, an aryloxycarbonyl group, an alkoxycarbonyl group, an alkoxysulfonyl group, an aryloxysulfonyl group, an alkanesulfonyl group, an arylenesulfonyl group, an alkylthio group, an arylthio group, an alkoxycarbonylamino group, an alkylureido group, an acyl group, a nitro group and a carboxyl group. For example, $R_{12}^I$ and $R_{13}^I$ may be a hydrogen atom or a ballast group.

$R_{10}^I$ is preferably a substituted phenyl group. Examples of the substituent groups include a halogen atom (for example, chlorine, bromine, fluorine), an alkyl group having 1 to 22 carbon atoms (for example, methyl, ethyl, propyl, t-butyl, tetradecyl), an alkoxy group having 1 to 22 carbon atoms (for example, methoxy, ethoxy, dodecyloxy), an alkoxycarbonyl group having 1 to 23 carbon atoms (for example, methoxycarbonyl, ethoxycarbonyl, tetradecyloxycarbonyl), an acylamino group (for example, α-(3-pentadecylphenoxy)-butyramide) and/or a cyano group. $R_{10}^I$ is more preferably the 2,4,6-trichlorophenyl group.

To describe $R_{12}^I$ and $R_{13}^I$ in further detail, these are a hydrogen atom, a halogen atom (for example, chlorine, bromine, fluorine), a straight chain or branched chain alkyl group having 1 to 30 carbon atoms (for example, methyl, trifluoromethyl, ethyl, t-butyl, tetradecyl), an alkoxy group having 1 to 30 carbon atoms (for example, methoxy, ethoxy, 2-ethylhexyloxy, tetradecyloxy), an acylamino group (for example,, acetamide, benzamide, butyramide, tetradecanamide, α-(2,4-di-t-pentylphenoxy)acetamide, α-(2,4-di-t-pentylphenoxy)-butyramide, α-(4-hydroxy-3-t-butylphenoxy)tetradecanamide, 2-oxypyrrolidin-1-yl, 2-oxy-5-tetradecylpyrrolidin-1-yl, N-methyltetradecanamide, t-butylcarbonamide), a sulfonamide group (for example, methanesulfonamide, benzenesulfonamide, p-toluenesulfonamide, p-dodecylbenzenesulfonamide, N-methyltetradecylsulfonamide,-hexadecanesulfonamide), a sulfamoyl group (for example, N-methylsulfamoyl, N-hexadecylsulfamoyl, N,N-dimethylsulfamoyl, N-[3-(dodecyloxy)propyl]sulfamoyl, N-[4-(2,4-di-t-pentylphenoxy)butyl]sulfamoyl, N-methyl-N-tetradecylsulfamoyl, N-dodecylsulfamoyl), a sulfamide group (for example, N-methylsulfamide, N-octadecylsulfamide), a carbamoyl group (for example, N-methylcarbamoyl, N-octadecylcarbamoyl, N-[4-(2,4-di-t-pentylphenoxy)butyl]carbamoyl, N-methyl-N-tetradecylcarbamoyl, N,N-dioctylcarbamoyl), a diacylamino group (for example, N-succinimido, N-phthalimido, 2,5-dioxo-1-oxazolidinyl, 3-dodecyl-2,3-dioxo-1-imidazolyl, N-acetyl-N-dodecylamino), an aryloxycarbonyl group (for example, phenoxycarbonyl, p-dodecyloxyphenoxycarbonyl), an alkoxycarbonyl group having 2 to 30 carbon atoms (for example, methoxycarbonyl, tetradecyloxycarbonyl, ethoxycarbonyl, benzyloxycarbonyl, dodecyloxycarbonyl), an alkoxysulfonyl group having 1 to 30 carbon atoms (for example, methoxysulfonyl, octyloxysulfonyl, tetradecyloxysulfonyl, 2-ethylhexyloxysulfonyl), an aryloxysulfonyl group (for example, phenoxysulfonyl, 2,4-di-t-pentylphenoxysulfonyl), an alkanesulfonyl group having 1 to 30 carbon atoms (for example, methanesulfonyl, octanesulfonyl, 2-ethylhexanesulfonyl, hexadecanesulfonyl), an arenesulfonyl group (for example, benzenesulfonyl, 4-nonylbenzenesulfonyl, p-toluenesulfonyl), an alkylthio group having 1 to 22 carbon atoms (for example, ethylthio, octylthio, benzylthio, tetradecylthio, 2-(2,4-di-t-pentylphenoxy)ethylthio), an arylthio group (for example, phenylthio, p-tolylthio), an alkoxycarbonylamino group (for example, ethoxycarbonylamino, benzyloxycarbonylamino, hexadecyloxycarbonylamino), an alkylureido group (for example, N-methylureido, N,N-dimethylureido, N-methyl-N-dodecylureido, N-hexadecylureido, N,N-dioctadecylureido, N,N-dioctyl-N'-ethylureido), an acyl group (for example, acetyl, benzoyl, octadecanoyl, p-dodecaneamidobenzoyl, cyclohexanecarbonyl), a nitro group, a cyano group and a carboxyl group.

To describe the alkoxy group and aryloxy group of $R_{11}{}^{I}$ in further detail, examples of the alkoxy group include a methoxy group, an ethoxy group, a propoxy group, a butoxy group, a 2-methoxyethoxy group, a sec-butoxy group, a hexyloxy group, a 2-ethylhexyloxy group, a 2-(2,4-di-t-pentylphenoxy)ethoxy group and a 2-dodecyloxyethoxy group, and examples of the aryloxy group include a phenoxy group, an α- or β-naphthyloxy group and a 4-tolyloxy group.

The monomers containing pyrazolone couplers having a releasing group represented by formula (I) may produce copolymers having non-color-forming ethylenic monomers which do not couple with the oxidation products of primary aromatic amine developing agents.

Examples of non-color-forming ethylenic monomers which do not couple with the oxidation products of primary aromatic amine developing agents include, for example, acrylic acids, α-chloroacrylic acids, α-alkylacrylic acids (for example, methacrylic acid) and the esters or amides derived from these acrylic acids (for example, acrylamide, n-butylacrylamide, t-butylacrylamide, diacetone acrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxy methacrylate), methylenebisacrylamide, vinyl esters (for example, vinyl acetate, vinyl propionate and vinyl laurate), acrylonitrile, methacrylonitrile, aromatic vinyl compounds (for example, styrene and derivatives thereof, vinyltoluene, divinylbenzene, vinylacetophenone and sulfostyrene), itaconic acid, citraconic acid, crotonic acid, vinylidene chloride, vinyl alkyl ethers (for example, vinyl ethyl ether), maleic acid, anhydrous maleic acid, maleic acid esters, N-vinyl-2-pyrrolidone, N-vinylpyridine and 2- and 4-vinylpyridine. The non-color-forming ethylenically unsaturated monomers used here may be two or more types. For example, the combinations of n-butyl acrylate and methyl acrylate, styrene and methacrylic acid, methacrylic acid and acrylamide, methyl acrylate and diacetone acrylamide and the like are used.

The non-color-forming ethylenically unsaturated monomer for copolymerization with the solid water-insoluble monomer coupler can be selected, in a way that is well known in the field of polymer couplers, in such a way as to influence the physical characteristics and/or chemical characteristics of the copolymer formed; for example, the solubility, compatibility with the binder for the photographic colloid composition such as gelatin, the plasticity, the thermostability and the like.

The polymer couplers used in the present invention may be water-soluble or water-insoluble. Among these, polymer coupler latexes are particularly preferred.

Specific examples of the coupling-releasing group represented by formula (I) are shown below, but there is no limitation to these.

Q-1)

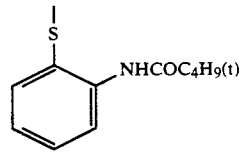

Q-2)

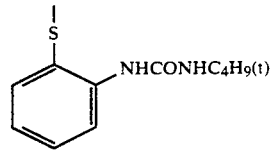

Q-3)

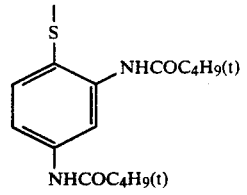

Q-4)

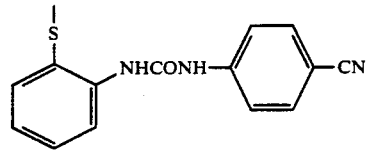

Q-5)

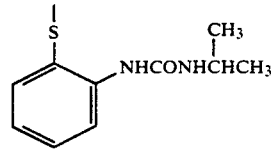

-continued
Q-6)
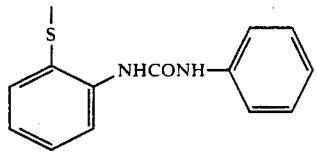
Q-7)
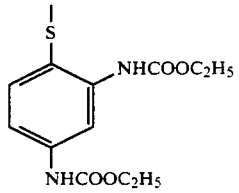
Q-8)
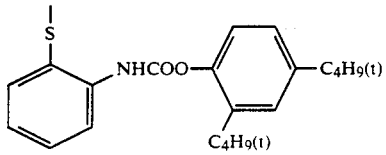
Q-9)
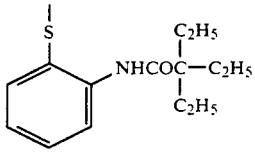
Q-10)
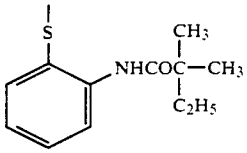
Q-11)
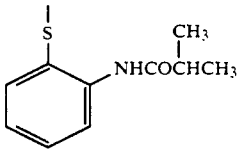
Q-12)
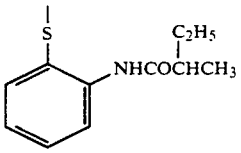
Q-13)
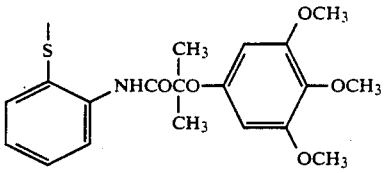
Q-14)
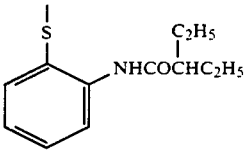
-continued
Q-15)
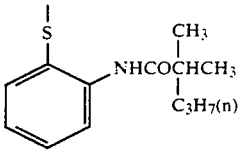
Q-16)
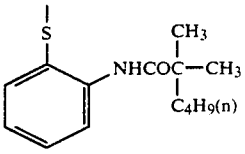
Q-17)
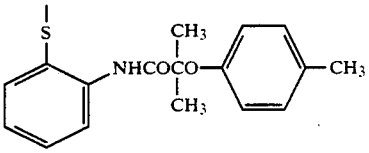
Q-18)
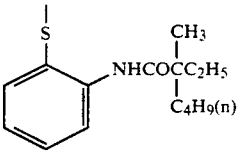
Q-19)
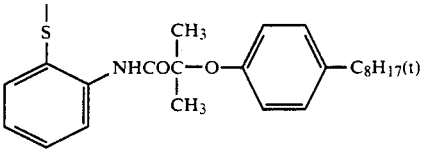
Q-20)
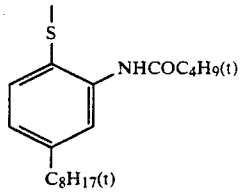
Q-21)
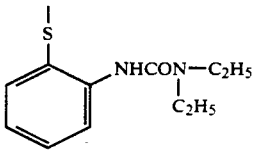
Q-22)
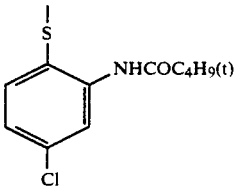

-continued
Q-23)
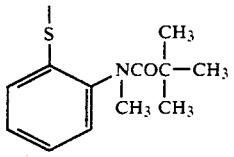
Q-24)
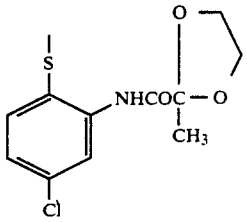
Q-25)
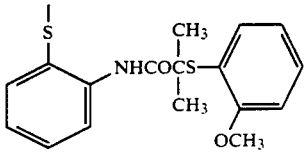
Q-26)
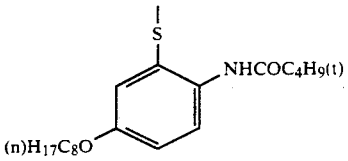
Q-27)
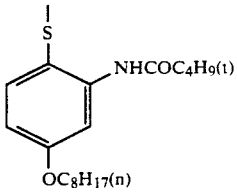
Q-28)
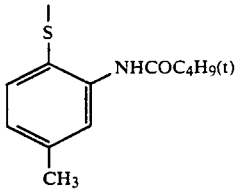
Q-29)
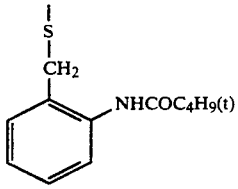
Q-30)
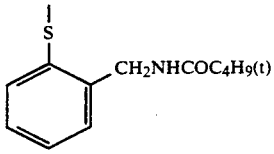
-continued
Q-31)
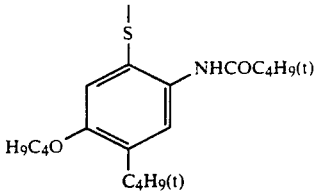
Q-32)
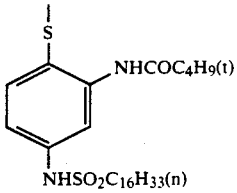
Q-33)
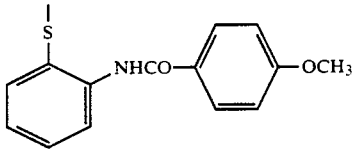
Q-34)
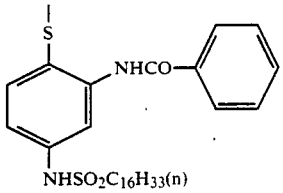
Q-35)
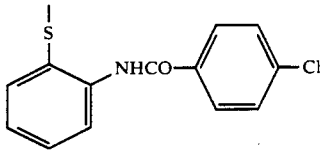
Q-36)
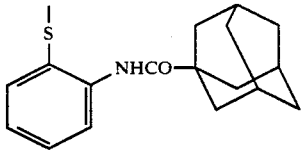
Q-37)
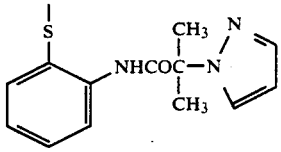
Q-38)
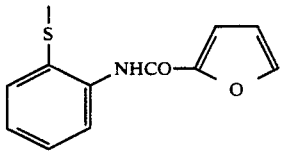

-continued
Q-39)
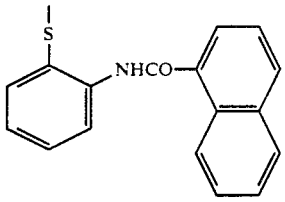
Q-40)
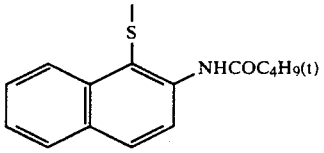
Q-41)
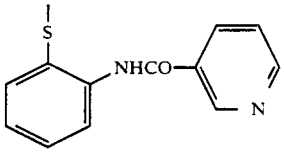
Q-42)
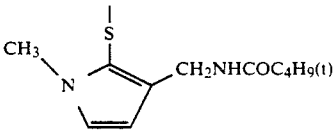
Q-43)
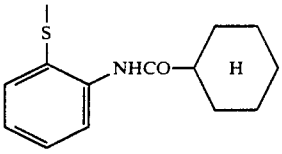
Q-44)
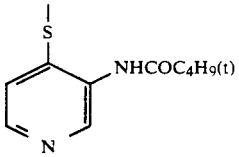
Q-45)
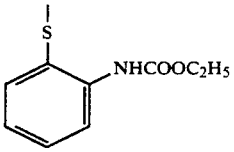
Q-46)
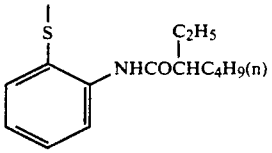
-continued
Q-47)
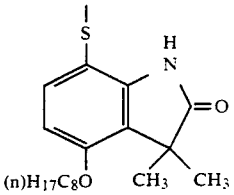
Q-48)
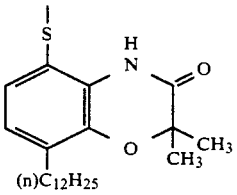
Q-55)
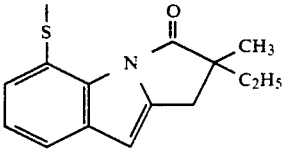
Q-56)
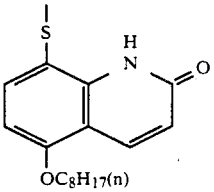
Q-57)
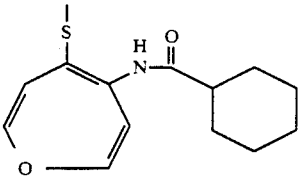
Q-58)
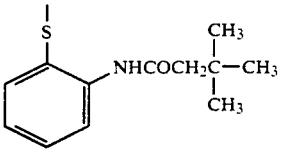
Q-59)
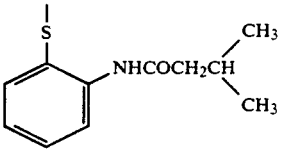
Q-60)
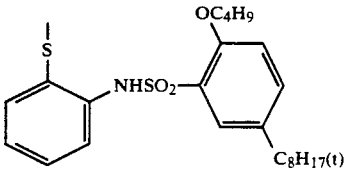
Specific examples of couplers of the present invention are shown below, but there is no limitation to these.

(M-1)
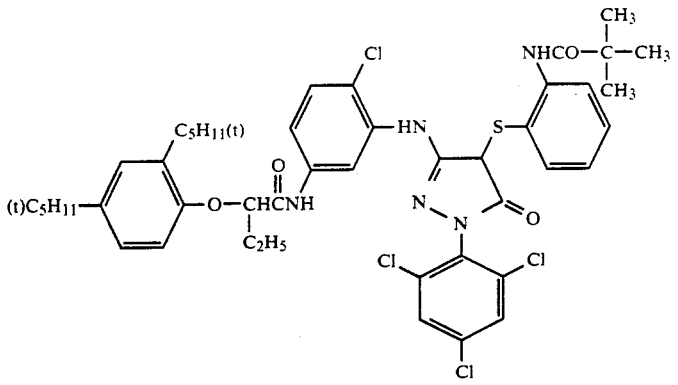
(M-2)
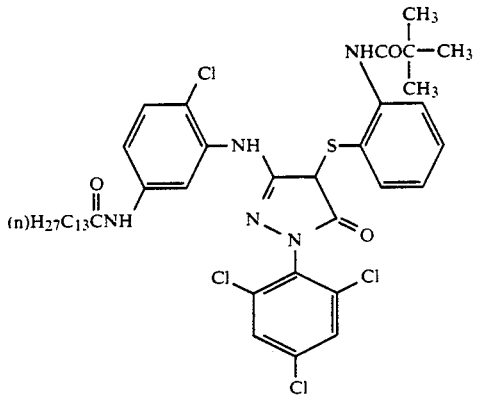
(M-3)
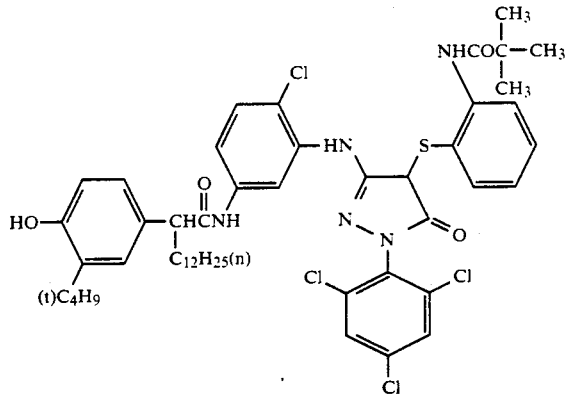
(M-4)
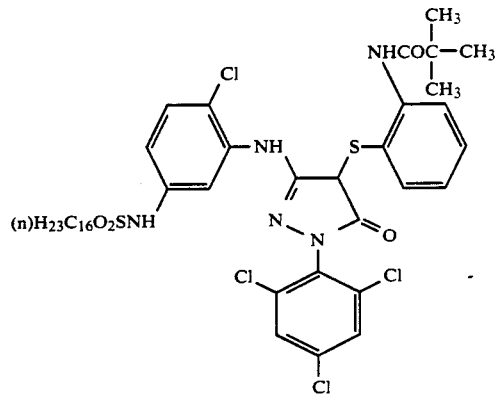

-continued
(M-5)
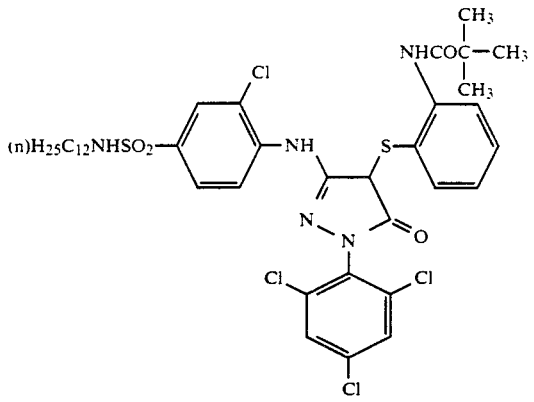
(M-6)
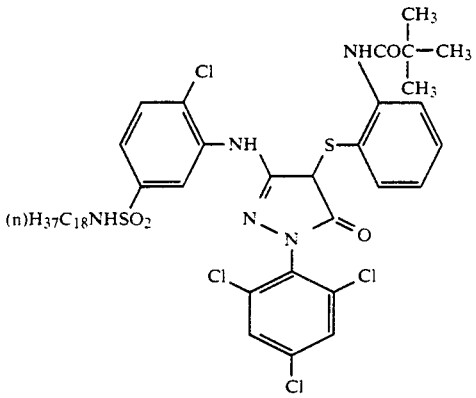
(M-7)
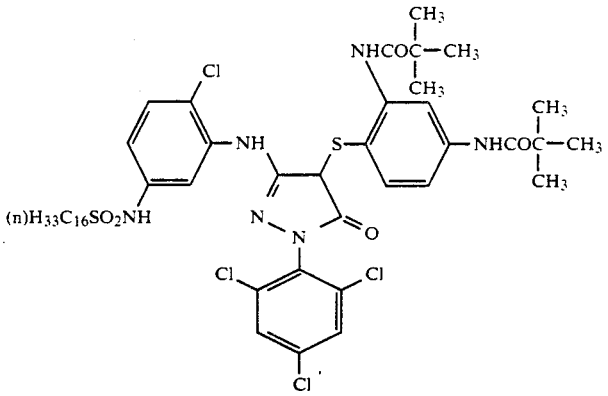
(M-8)
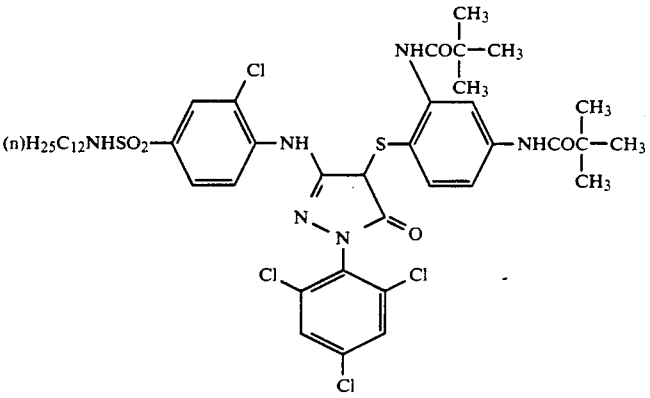

-continued
(M-9)
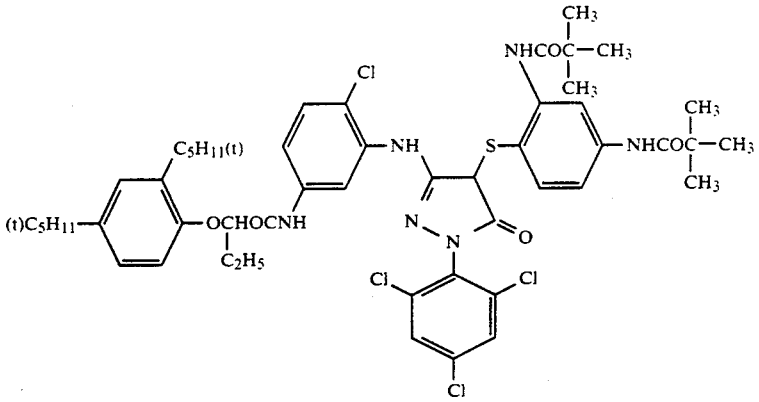
(M-10)
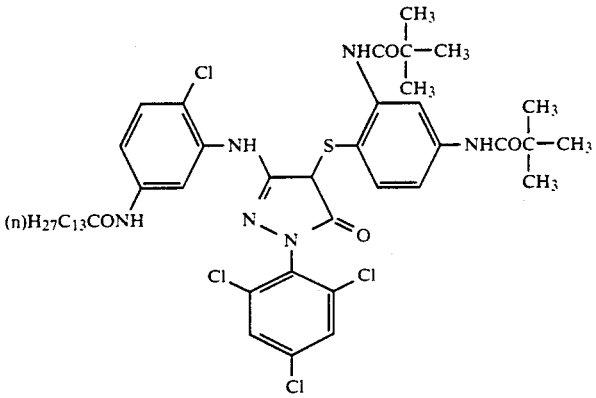
(M-11)
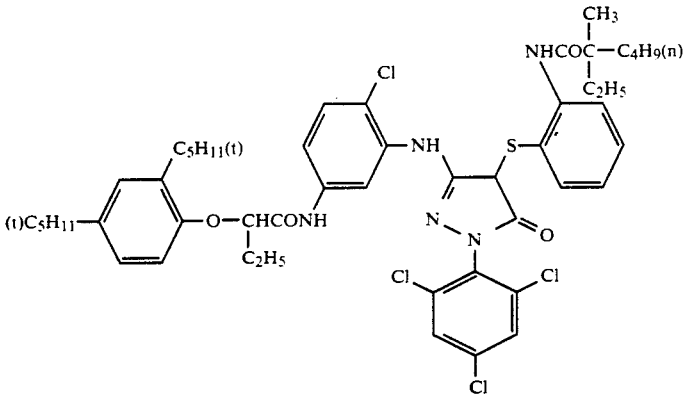
(M-12)
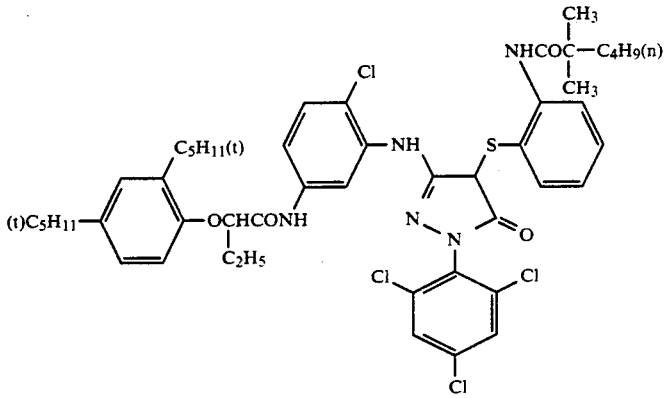

-continued
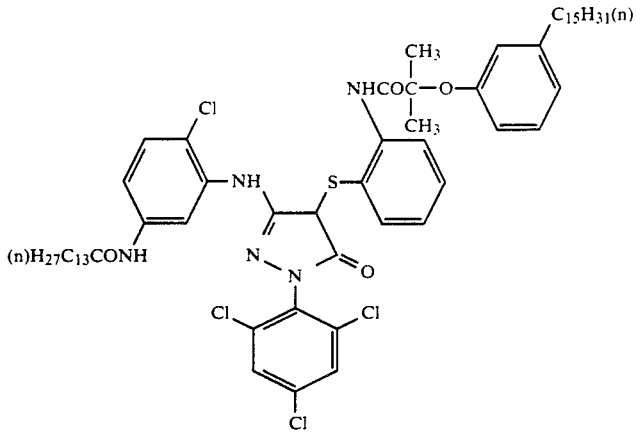
(M-13)
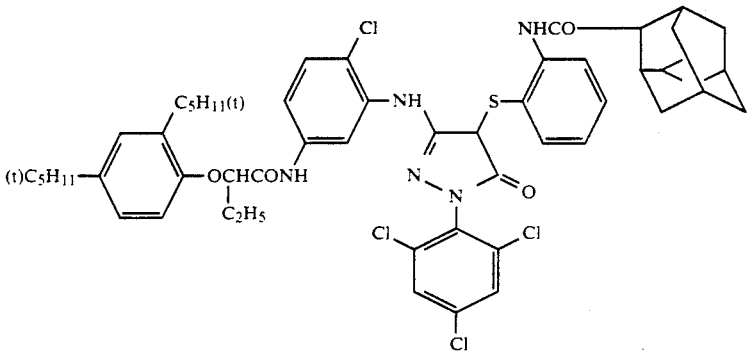
(M-14)
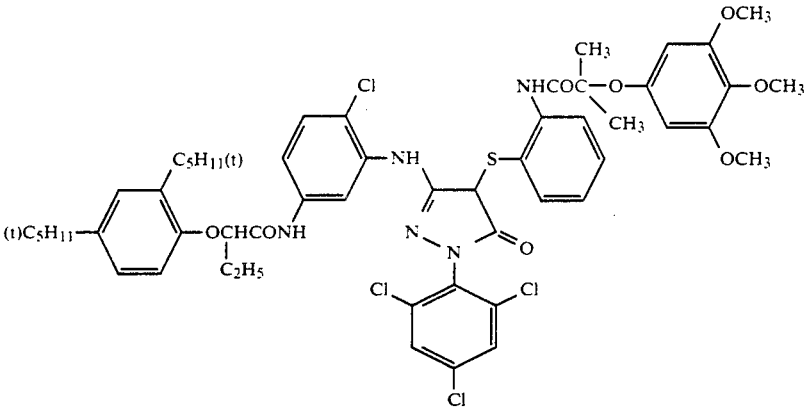
(M-15)
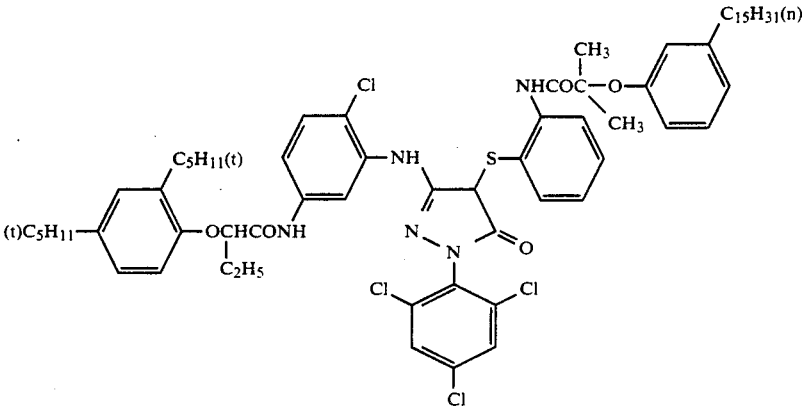
(M-16)

-continued
(M-17)
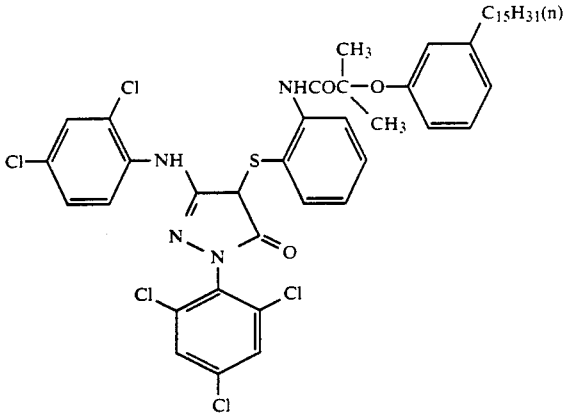
(M-18)
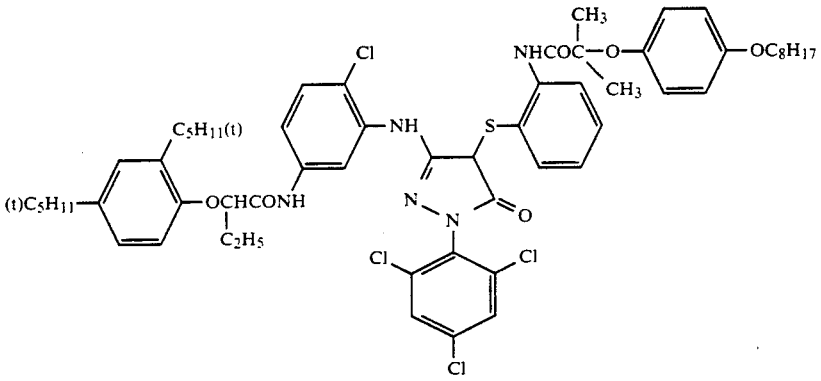
(M-19)
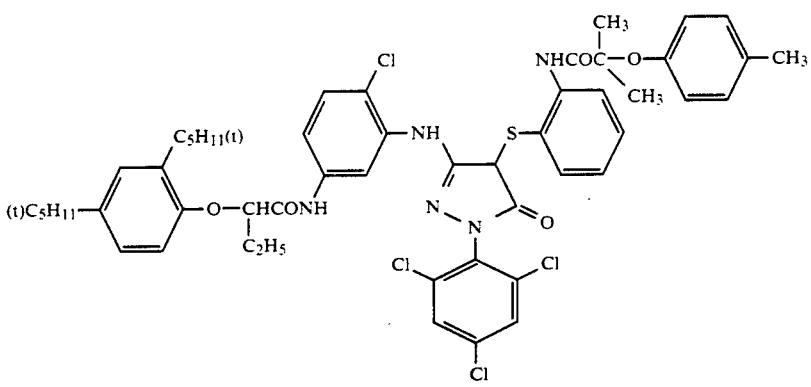
(M-20)
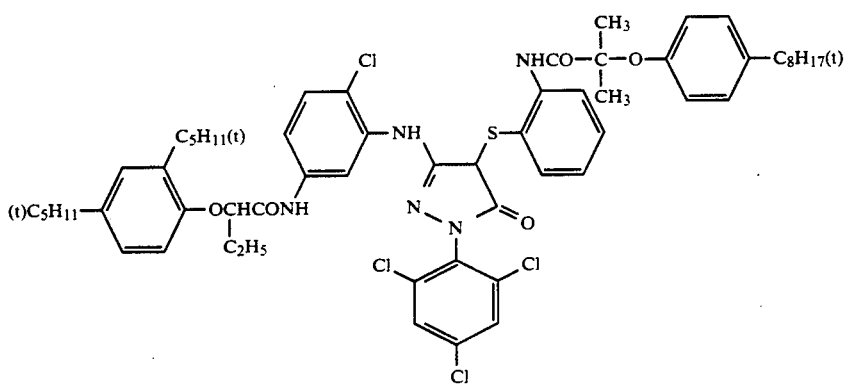

-continued
(M-21)
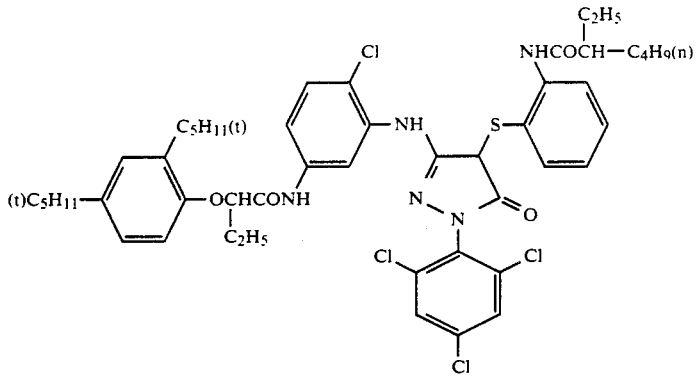
(M-22)
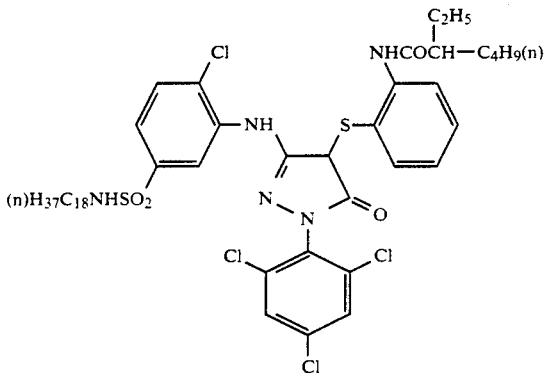
(M-23)
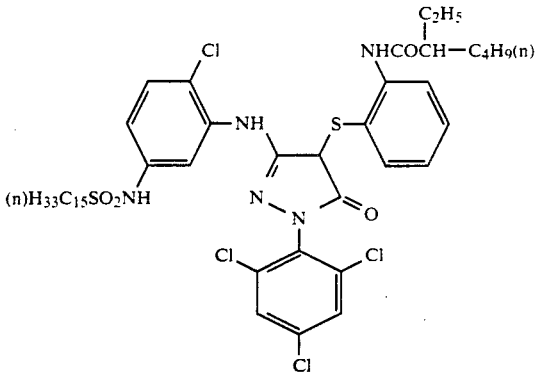
(M-24)
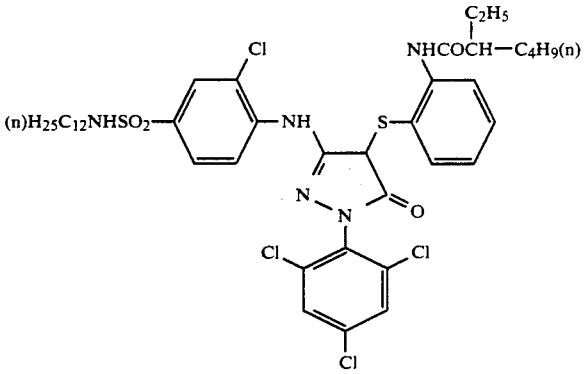

-continued
(M-25)
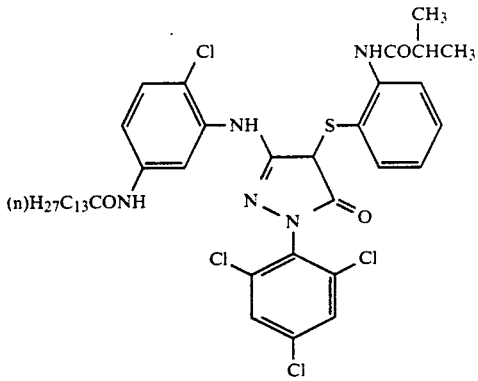
(M-26)
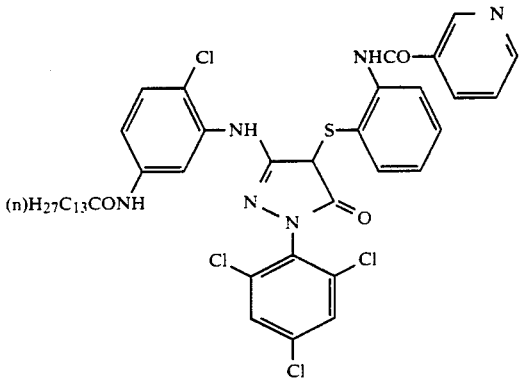
(M-27)
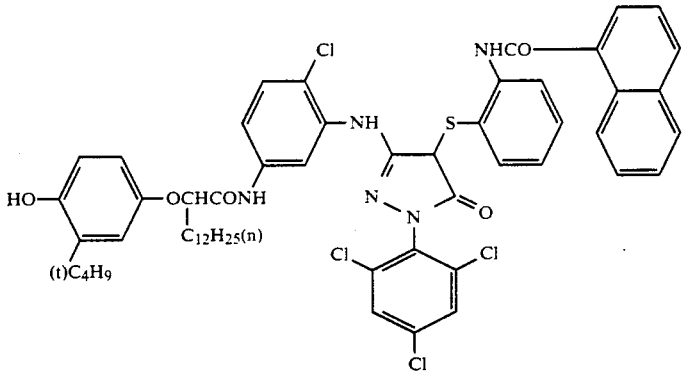
(M-28)
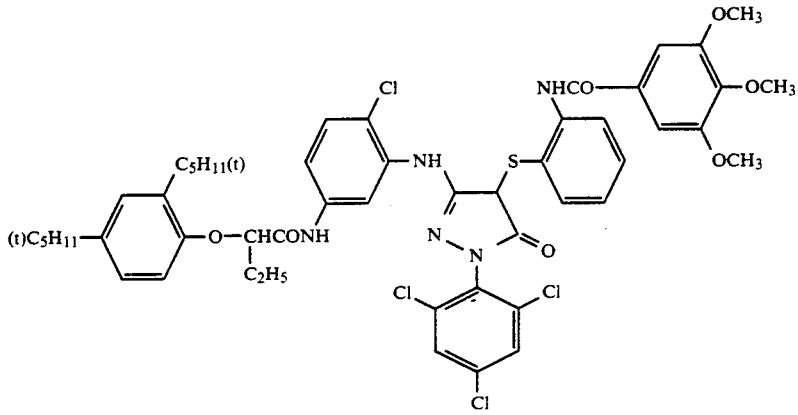

-continued
(M-29)
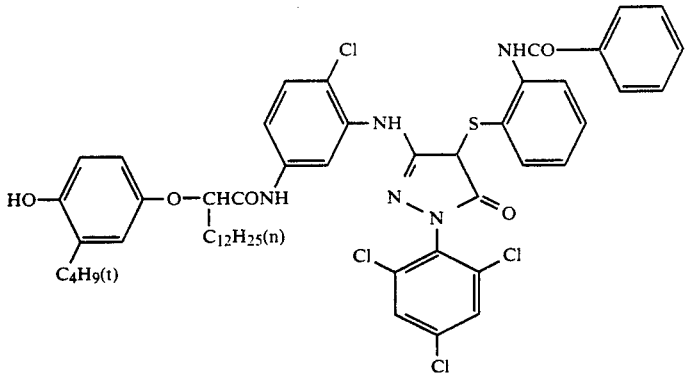
(M-30)
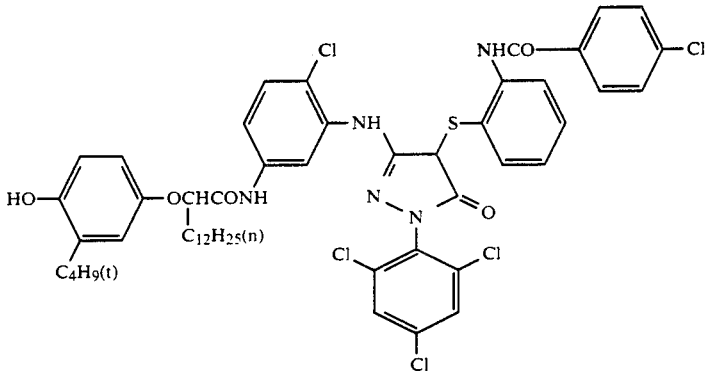
(M-31)
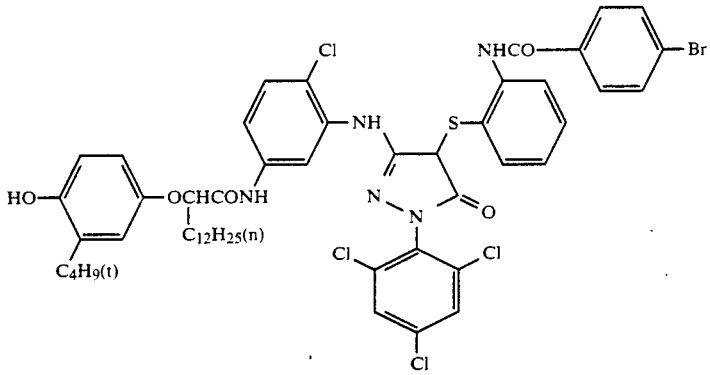
(M-32)
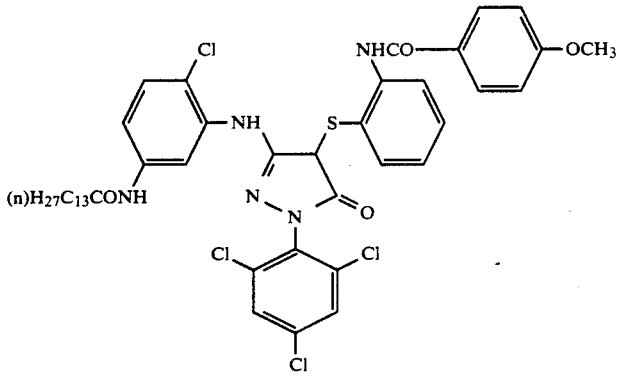

-continued
(M-33)
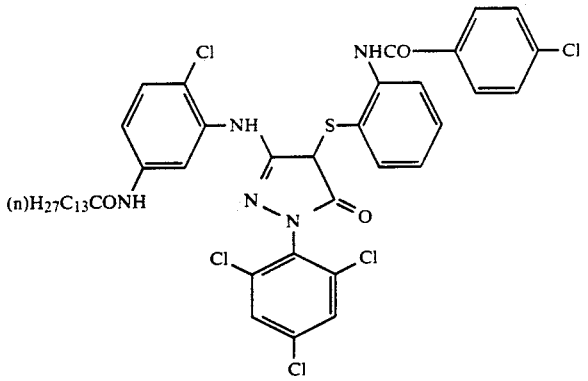
(M-34)
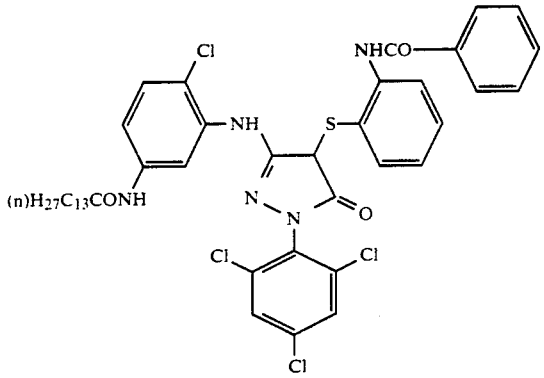
(M-35)
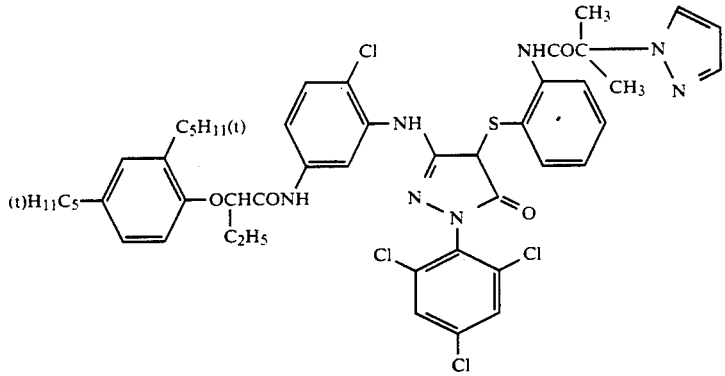
(M-36)
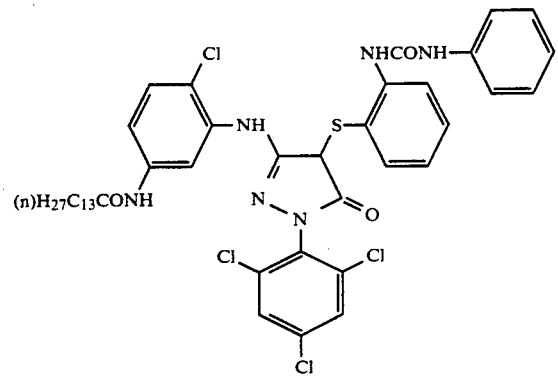

-continued
(M-37)
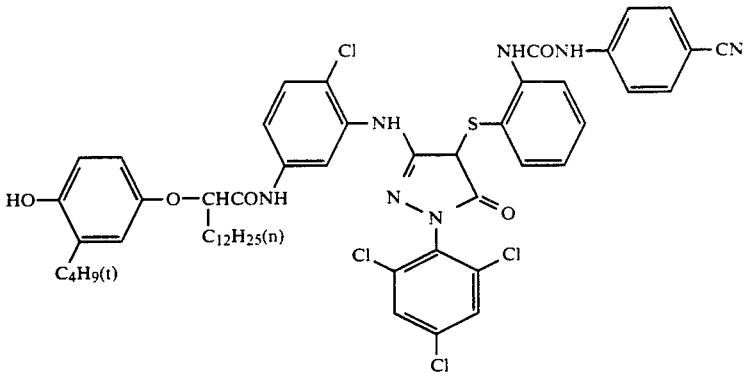
(M-38)
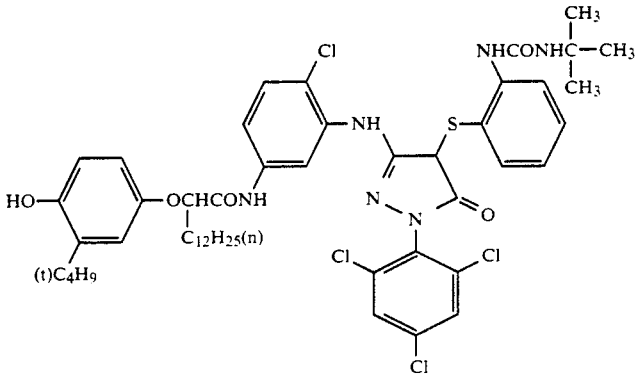
(M-39)
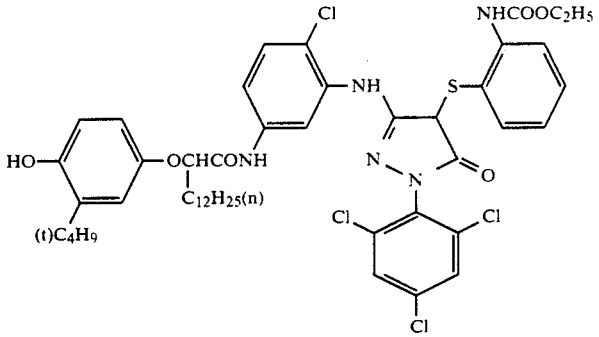
(M-40)
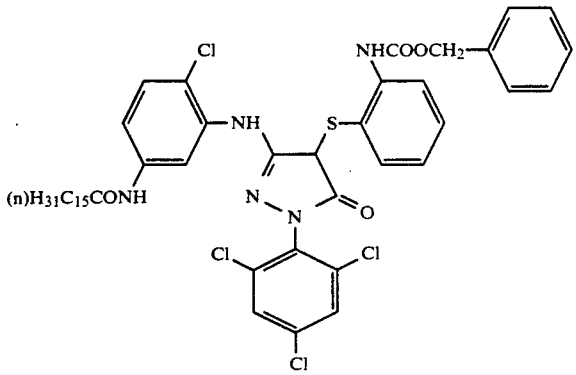

-continued
(M-41)
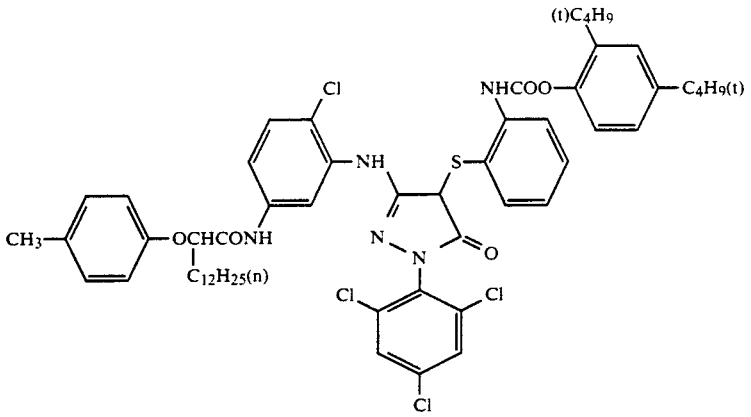
(M-42)
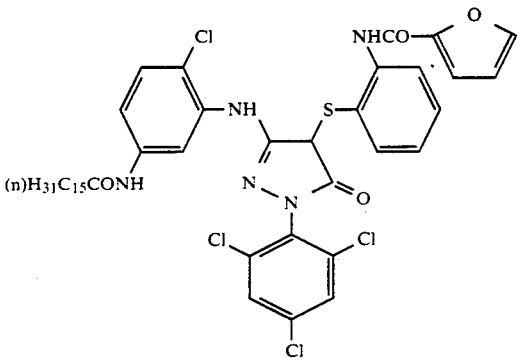
(M-43)
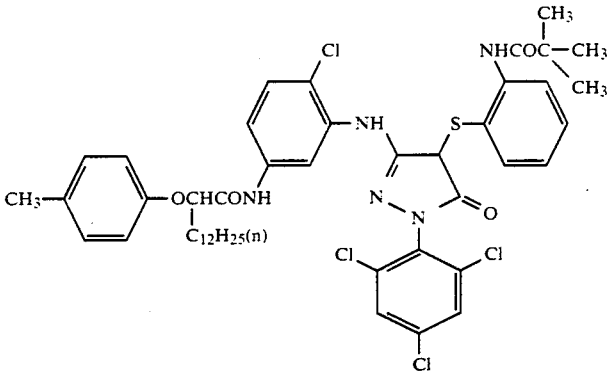
(M-44)
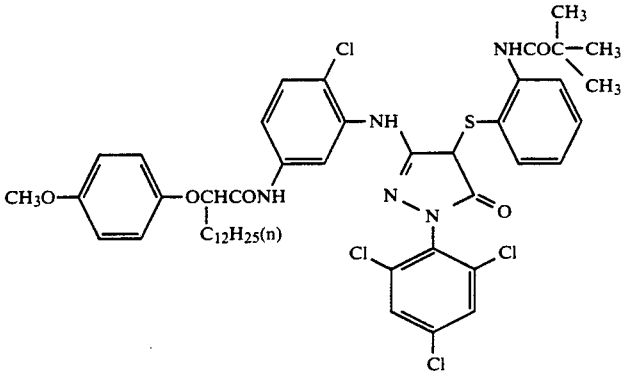

-continued
(M-45)
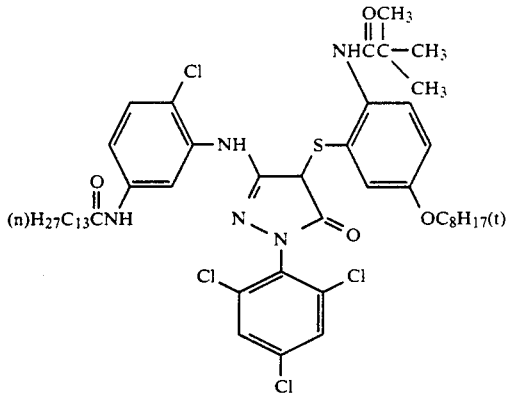
(M-46)
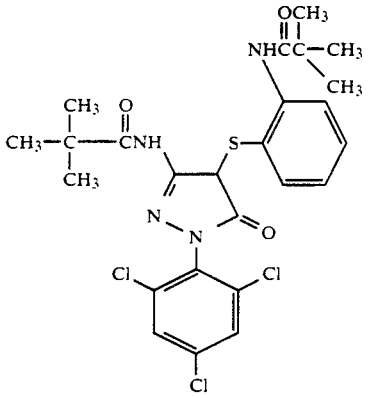
(M-47)
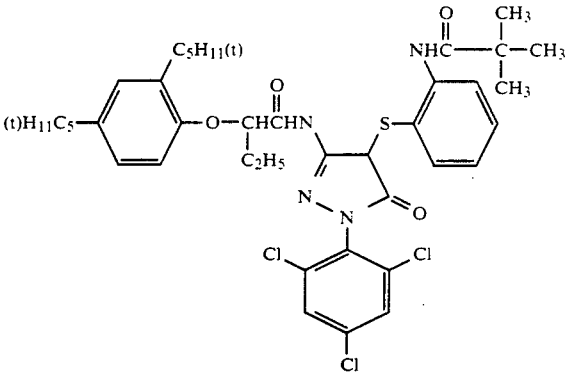
(M-48)
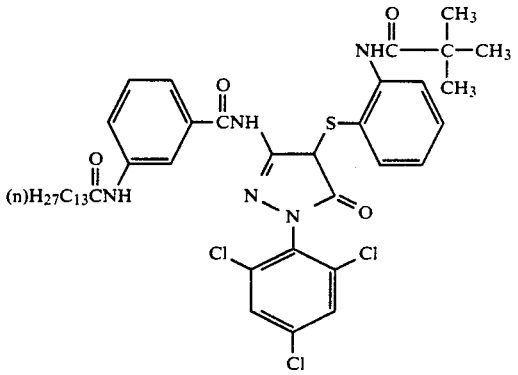

-continued
(M-49)
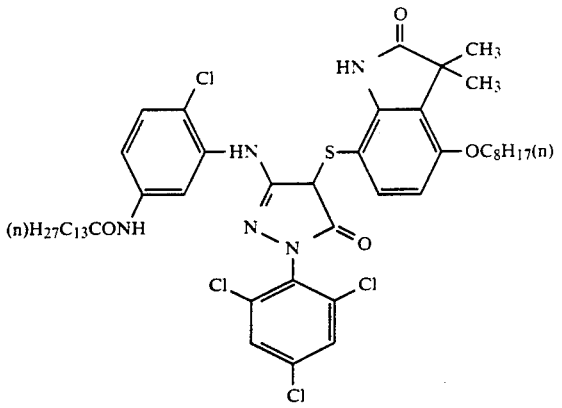
(M-50)
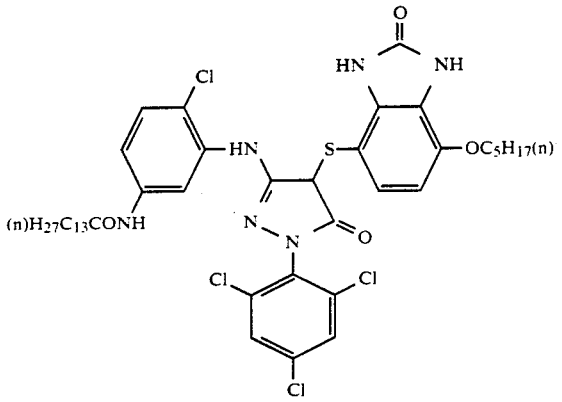
(M-51)
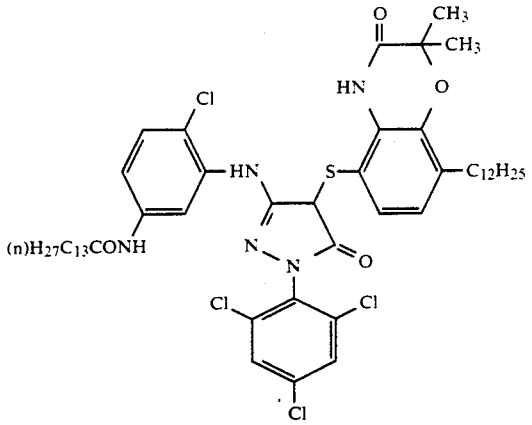
(M-52)
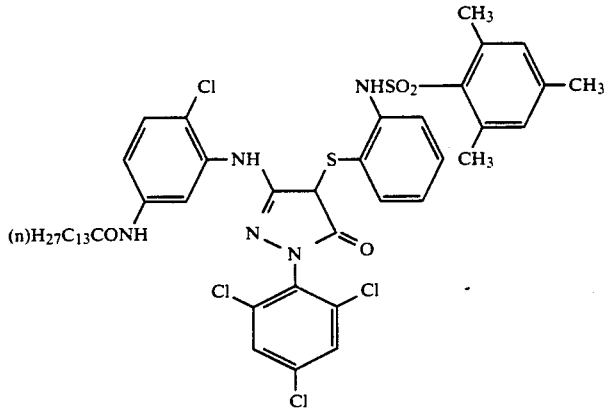

-continued
(M-53)
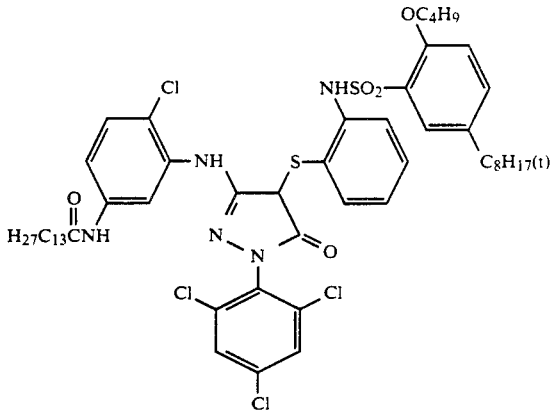
(M-54)
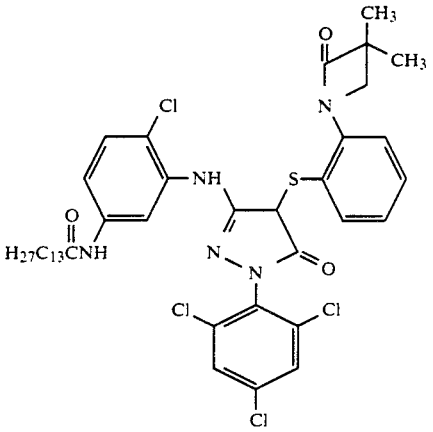
(M-55)
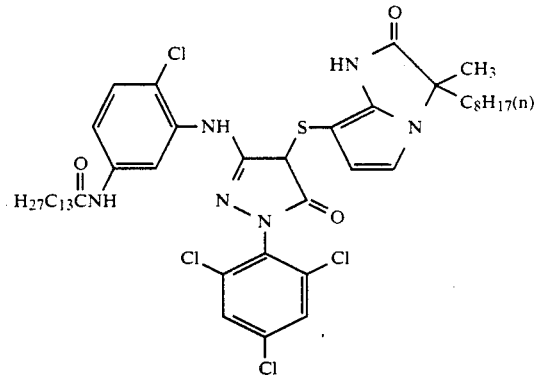
(M-56)
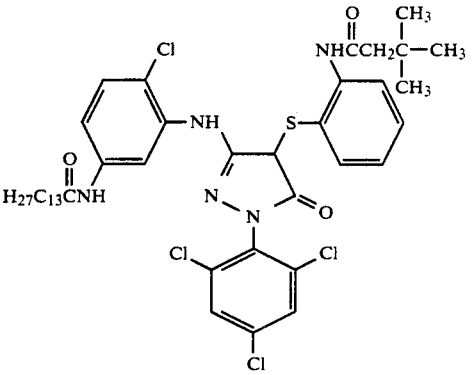

-continued
(M-57)
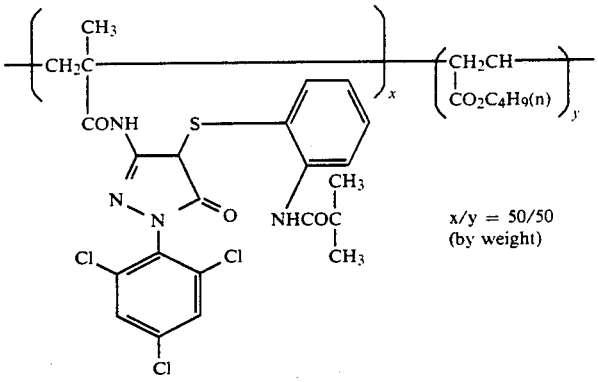
x/y = 50/50
(by weight)
(M-58)
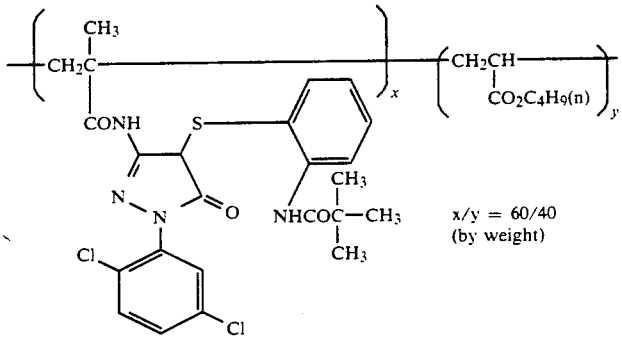
x/y = 60/40
(by weight)
(M-59)
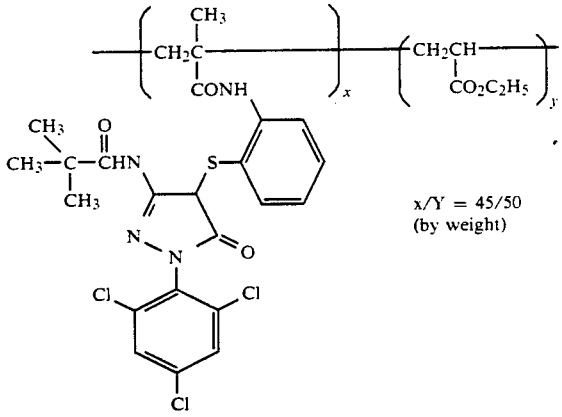
x/Y = 45/50
(by weight)
(M-60)
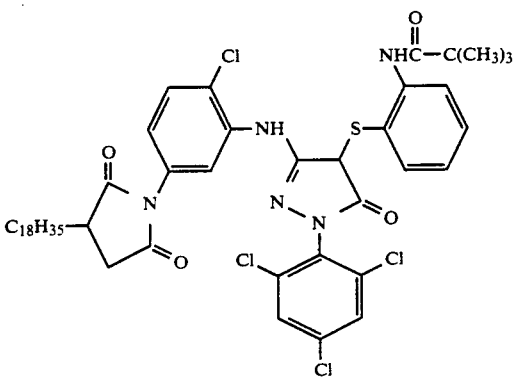

-continued
(M-61)
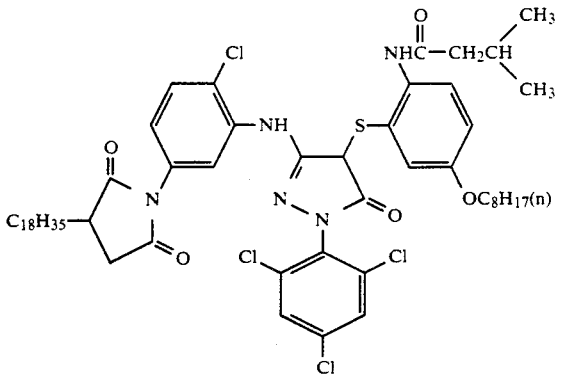
(M-62)
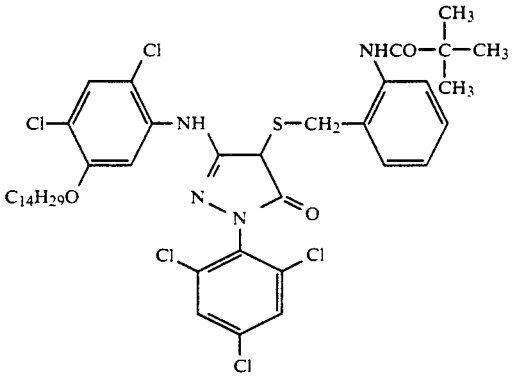
(M-63)
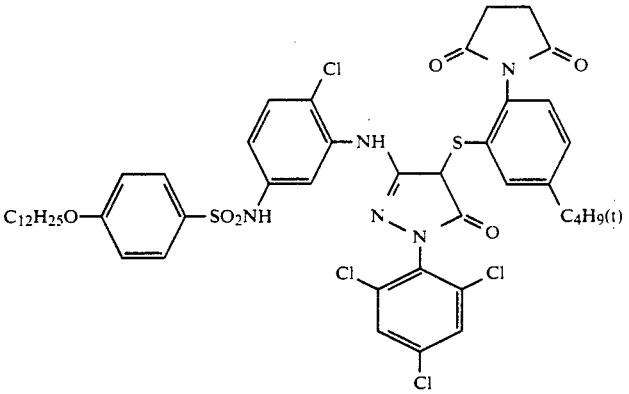
(M-64)
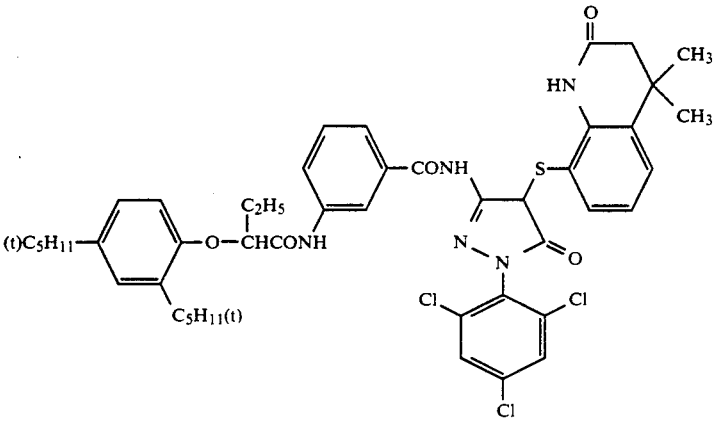

-continued (M-65)

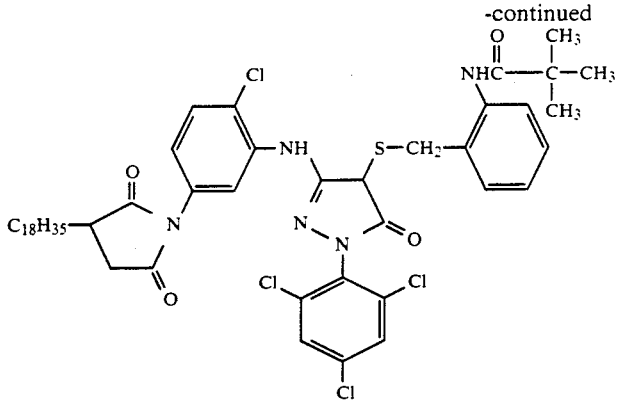

(M-66)

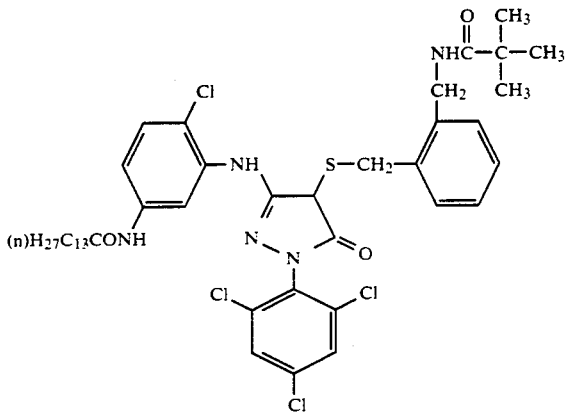

The pyrazolone-based magenta couplers of the present invention can usually be used in an amount of $1\times10^{-3}$ mol to 1 mol, and preferably $1\times10^{-2}$ mol to $8\times10^{-1}$ mol, per mol of silver halide. Furthermore, it is also possible to use the couplers of the present invention in conjunction with other kinds of magenta couplers.

The layer to which the pyrazolone-based magenta couplers of the present invention are added may be any desired silver halide emulsion layer, and it is preferably the green-sensitive silver halide emulsion layer. The amount of silver used in the green-sensitive silver halide emulsion layer is preferably 0.1 to 0.3 g/m$^2$.

The pyrazolone-based magenta couplers of the present invention can be synthesized by the method described in WO 88/04795 or in accordance therewith.

Formula (II) is described in further detail below.

In formula (II), $X_0$ is an alkyl group (preferably having 1 to 60 carbon atoms, for example, methyl, t-butyl, sec-octyl, dodecyl, 4-hexyloxycarbonyl-1,1-dimethylbutyl, sec-octadecyl, t-pentadecyl), a substituted or unsubstituted alkoxy group (preferably having 1 to 60 carbon atoms, for example, methoxy, methoxyethoxy, dodecyloxy), a substituted or unsubstituted aryloxy group (preferably having 6 to 60 carbon atoms, for example, phenoxy, 4-methoxyphenoxy), a substituted or unsubstituted alkylthio group (preferably having 1 to 60 carbon atoms, for example, butylthio, dodecylthio), a substituted or unsubstituted arylthio group (preferably having 6 to 60 carbon atoms, for example, phenylthio, 2-octyloxy-5-t-octylphenylthio), amido group (preferably having 2 to 60 carbon atoms, for example, acetylamino, benzoylamino, 3,5-bis(2-hexyldecanamido)benzoylamino, α-(2,4-di-t-amylphenoxy)butanamide), and a sulfonamide group (preferably having 1 to 60 carbon atoms, for example, benzenesulfonamide, 4-octadecyloxybenzenesulfonamide, hexadecanesulfonamide), $R^3$ and $R^4$ represent the same groups as X or a hydrogen atom, a halogen atom, a sulfo group, a carboxyl group, a substituted or unsubstituted carbamoyl group (preferably having 1 to 60 carbon atoms, for example, carbamoyl, N,N-dipropylcarbamoyl, N-phenylcarbamoyl), a sulfamoyl group (preferably having 0 to 60 carbon atoms, for example, sulfamoyl, N,N-dihexylsulfamoyl, N-phenylsulfamoyl), an acyl group (preferably having 2 to 60 carbon atoms, for example, acetyl, benzoyl, 3-carboxypropanoyl), a sulfonyl group (preferably having 1 to 60 carbon atoms, for example, methanesulfonyl, benzenesulfonyl, dodecyloxybenzenesulfonyl), $R^3$ and $R^4$ may bond together to form a carbon ring, Y represents a hydroxyl group or a sulfonamide group, and the total of the carbon atoms in X, $R^3$, $R^4$ and Y is 10 or more.

The compounds represented by formula (II) may form dimers, trimers, oligomers or polymers and the like.

It is preferable that $X_0$ is an alkyl group, an alkylthio group, an amide group or a sulfonamide group, and it is more preferable that it is an alkyl group or an amide group.

It is preferable that $R^3$ and $R^4$ are a hydrogen atom, a halogen atom, a sulfo group, an alkyl group, an alkylthio group or a sulfonyl group, and more preferable that they are a hydrogen atom, a halogen atom, an alkyl group or a sulfonyl group.

It is preferable that Y is a hydroxyl group.

Specific examples of compounds represented by formula (II) according to the present invention are shown below, but the present invention is not limited to these.

(II-1)
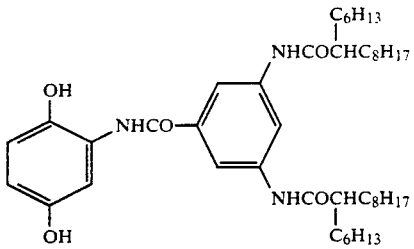
(II-2)
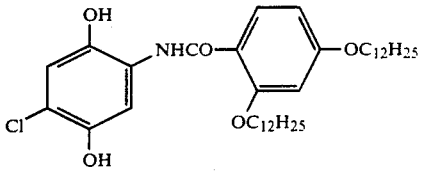
(II-3)
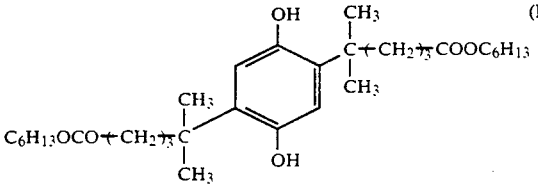
(II-4)
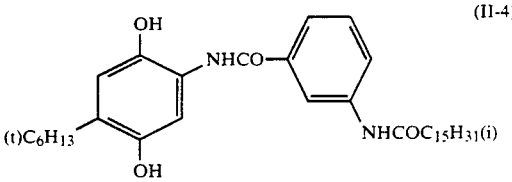
(II-5)
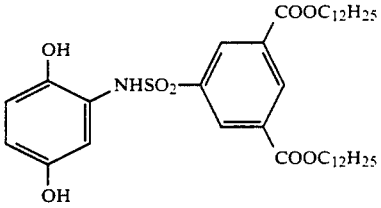
(II-6)
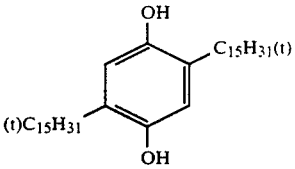
(II-7)
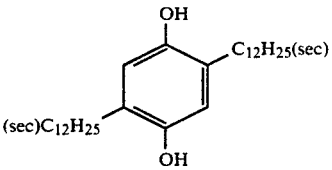
(II-8)
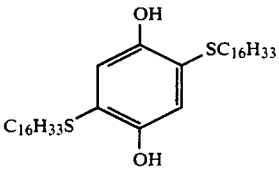
-continued
(II-9)
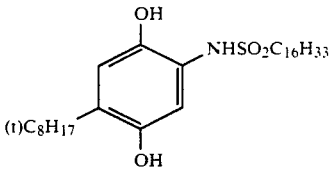
(II-10)
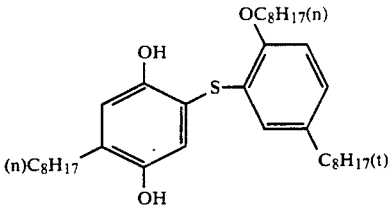
(II-11)
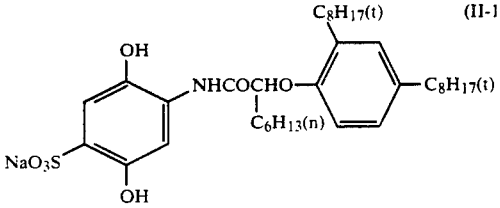
(II-12)
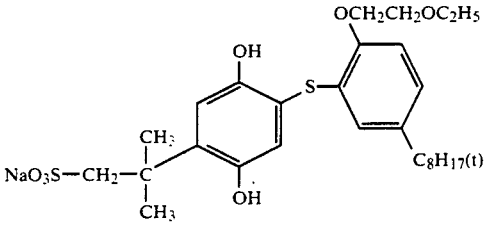
(II-13)
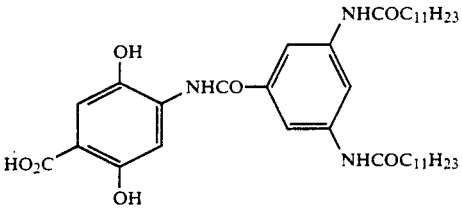
(II-14)
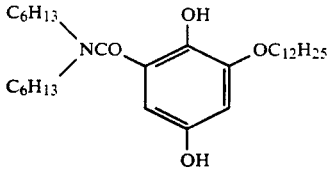
(II-15)
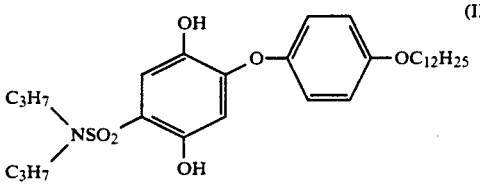
(II-16)
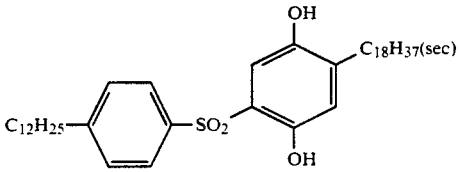

-continued (II-17)

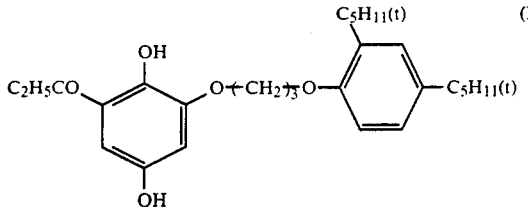

(II-18)

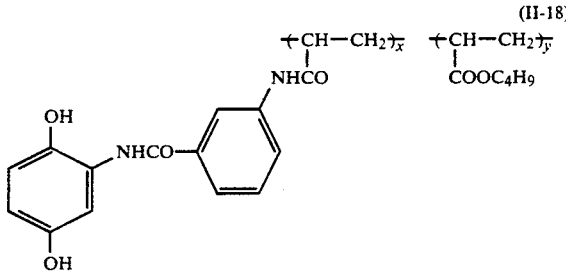

x/y = 1/2
(average molecular weight: 20,000)

(II-19)

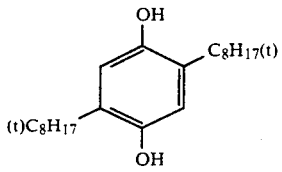

(II-20)

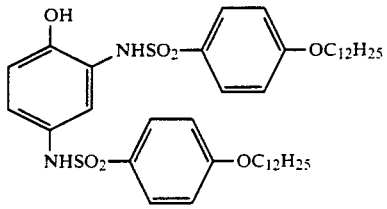

(II-21)

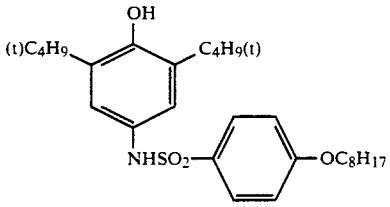

(II-22)

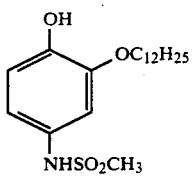

(II-23)

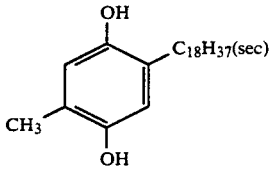

The compounds represented by formula (II) according to the present invention can be synthesized by the methods mentioned in, for example, JP-A-53-32034, JP-A-53-55121, JP-A-59-5247 and JP-A-62-103053 or by methods in accordance therewith.

Formula (III) is now explained in further detail. $R^5$, $R^6$, $R^7$, $R^8$, $R^9$ and $R^{10}$ represent a hydrogen atom, a halogen atom (for example, chlorine, bromine, fluorine), a sulfo group, a carboxyl group, a cyano group, an alkyl group (preferably having 1 to 30 carbon atoms, for example, methyl t-butyl, cyclohexyl, t-octyl, hexadecylbenzyl, allyl), an aryl group (preferably having 6 to 30 carbon atoms, for example, phenyl, p-tolyl), an acylamino group (preferably having 2 to 30 carbon atoms, for example, acetylamino, benzoylamino), a sulfonamide group (preferably having 1 to 30 carbon atoms, for example, methanesulfonamide, benzenesulfonamide), an alkoxy group (preferably having 1 to 30 carbon atoms, for example, methoxy, butoxy, benzyloxy, dodecyloxy), an aryloxy group (preferably having 6 to 30 carbon atoms, for example, phenoxy, p-methoxyphenoxy), an alkylthio group (preferably having 1 to 30 carbon atoms, for example, butylthio, decylthio), an arylthio group (preferably having 6 to 30 carbon atoms, for example, phenylthio, p-hexyloxyphenylthio), an acyl group (preferably having 2 to 30 carbon atoms, for example, acetyl, benzoyl, hexanoyl), an acyloxy group (preferably having 1 to 30 carbon atoms, for example, acetyloxy, benzoyloxy), a sulfonyl group (preferably having 1 to 30 carbon atoms, for example, methanesulfonyl, benzenesulfonyl), a carbamoyl group (preferably having 1 to 30 carbon atoms, for example, N,N-diethylcarbamoyl, N-phenylcarbamoyl), an alkoxycarbonyl group (preferably having 2 to 30 carbon atoms, for example, methoxycarbonyl, butoxycarbonyl), or a sulfamoyl group (preferably having 0 to 30 carbon atoms, for example, N,N-dipropylsulfamoyl, N-phenylsulfamoyl), and $R^5$ and $R^6$, and $R^9$ and $R^{10}$ may bond together to form carbon rings or heterocyclic rings. $Z_1$ represents a single bond or a divalent organic group (preferably having 1 to 60 carbon atoms, for example, methylene, ethylene, p-phenylene,

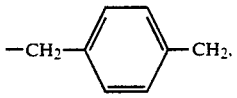

1,4-butylene).

Furthermore, $R^5$ to $R^{10}$ and $Z_1$ in formula (III) may be further substituted by an alkyl group, an aryl group, an alkoxy group, an aryloxy group, a sulfo group, a carboxyl group, an amide group, a carbamoyl group, a halogen atom and other generally known substituents.

The compounds of formula (III) may form dimers (tetramers as hydroquinone moieties).

Of the compounds of formula (III), the compounds which can be represented by formula (IIIa) are particularly preferred compounds in the present invention.

(IIIa)

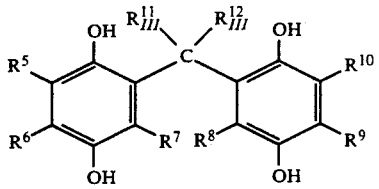

In formula (IIIa), $R^5$ to $R^{10}$ represent the same groups as those in formula (III). $R^{11}_{III}$ and $R^{12}_{III}$ represent a hydrogen atom, and respectively a substituted or unsubstituted alkyl group (preferably having 1 to 30 carbon atoms, for example, methyl, i-propyl, undecyl, benzyl), an aryl group (preferably having 6 to 30 carbon atoms, for example, phenyl, p-tolyl), a heterocyclic group (preferably having 1 to 30 carbon atoms, for example, pyridin-2-yl), and $R^7$ and $R^8$ may bond together to form a carbon ring or a heterocyclic ring.

In formulae (III) and (IIIa), $R^5$ to $R^{10}$ preferably represent a hydrogen atom, a halogen atom, an alkyl group, an aryl group, an acylamino group or an alkylthio group, more preferably a hydrogen atom, an alkyl group, an acylamino group or an alkylthio group, and most preferably a hydrogen atom or an alkyl group.

In formula (IIIa), $R^{11}_{III}$ and $R^{12}_{III}$ preferably represents a hydrogen atom or an alkyl group, preferably $R^{11}_{III}$ and $R^{12}_{III}$ may bond together to form a carbon ring, more preferably $R^{11}_{III}$ is a hydrogen atom and $R^{12}_{III}$ is a hydrogen atom or an alkyl group and most preferably $R^{11}_{III}$ is a hydrogen atom and $R^{12}_{III}$ is an alkyl group.

Specific examples of compounds represented by formula (III) are shown below, but the present invention is not limited to these.

(III-1)

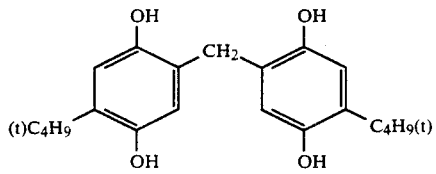

(III-2)

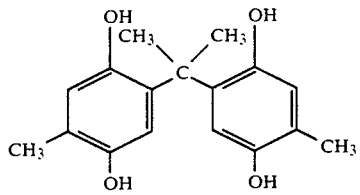

(III-3)

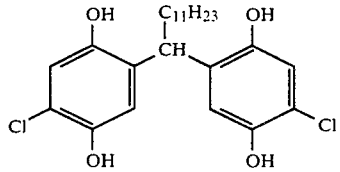

(III-4)

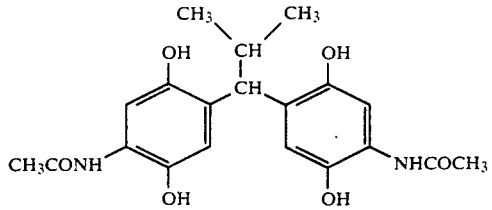

(III-5)

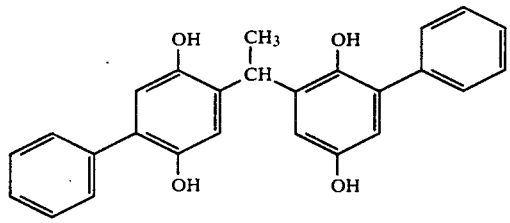

(III-6)

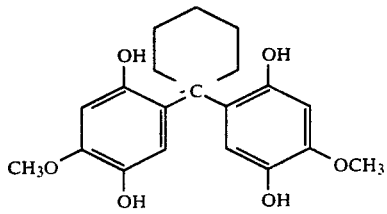

-continued
(III-7)
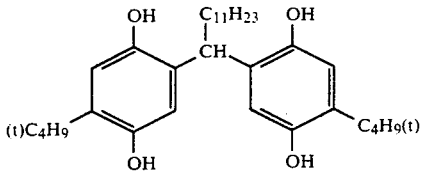
(III-8)
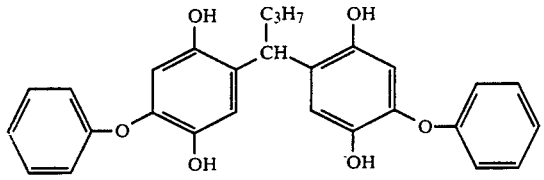
(III-9)
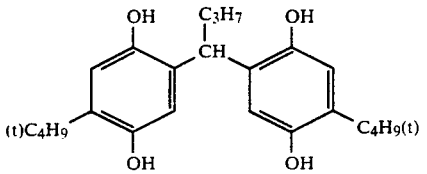
(III-10)
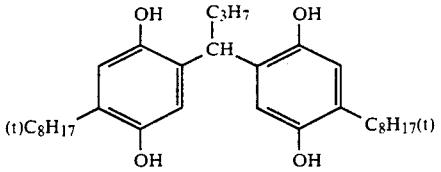
(III-11)
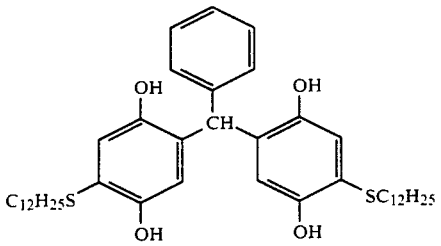
(III-12)
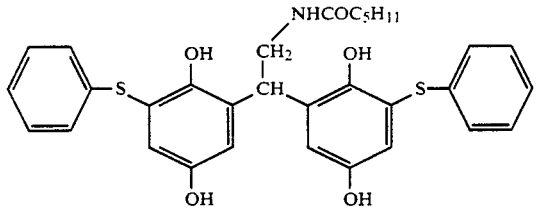
(III-13)
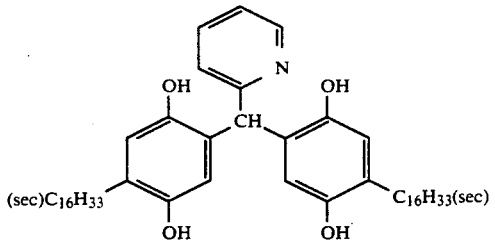
(III-14)
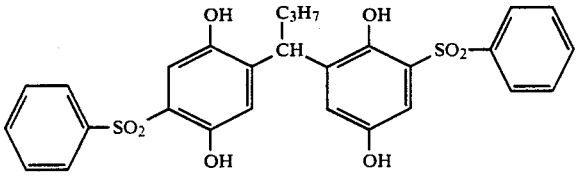

-continued
(III-15)
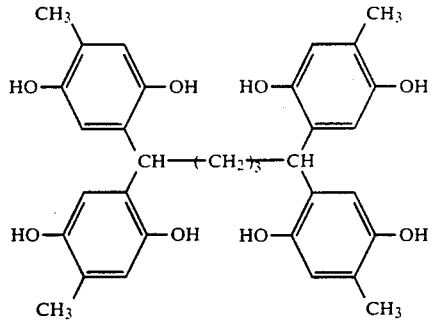
(III-16)
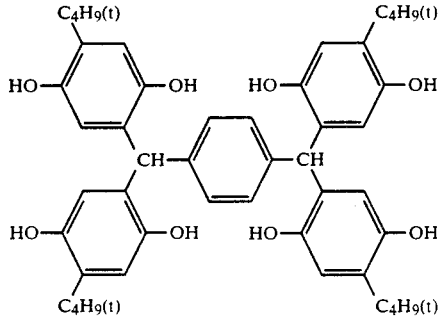
(III-17)
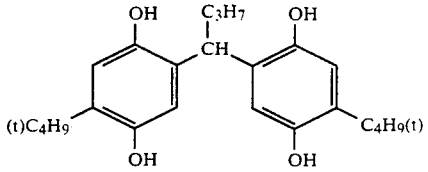
(III-18)
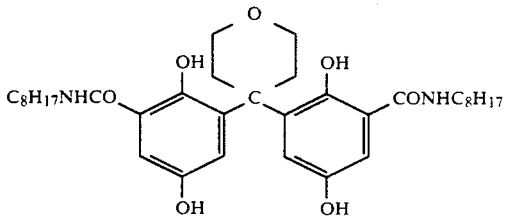
(III-19)
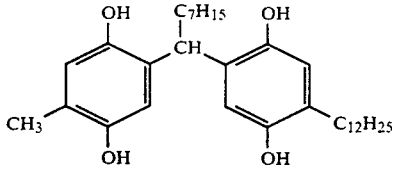
(III-20)
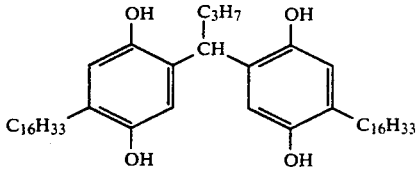
(III-21)
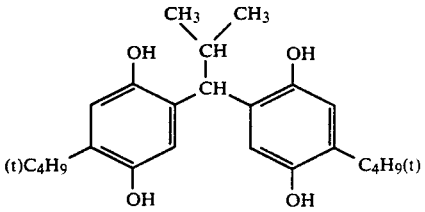

-continued
(III-22)
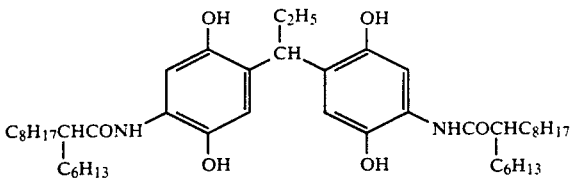
(III-23)
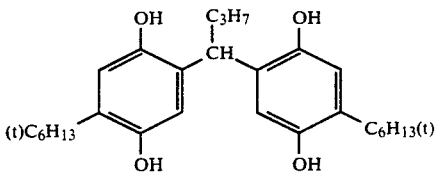
(III-24)
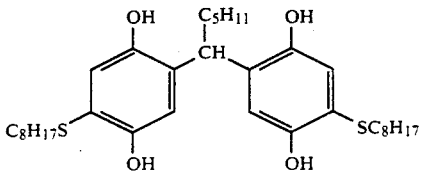
(III-25)
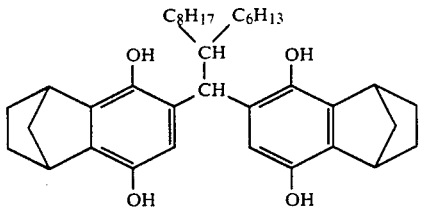
(III-26)
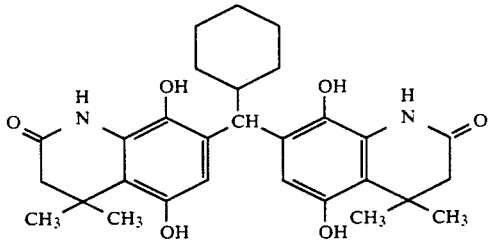
(III-27)
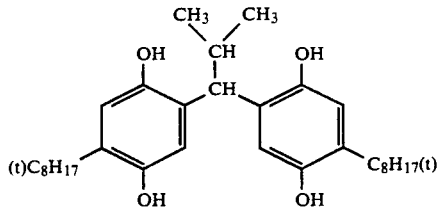
(III-28)
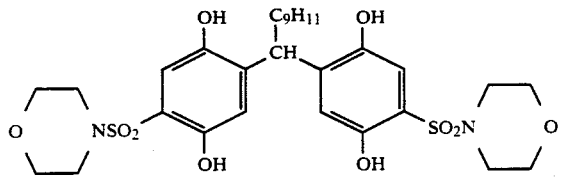

-continued
(III-29)
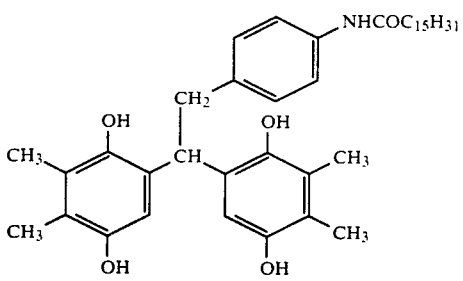
(III-30)
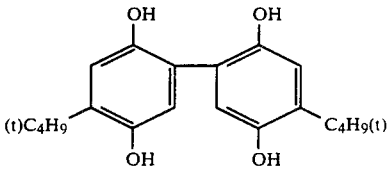
(III-31)
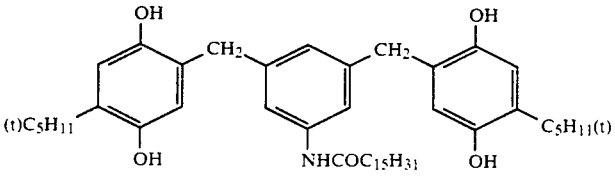
(III-32)
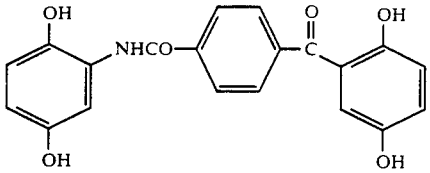
(III-33)
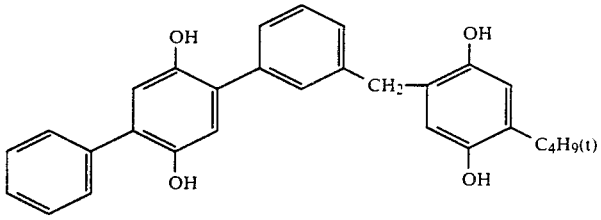
(III-34)
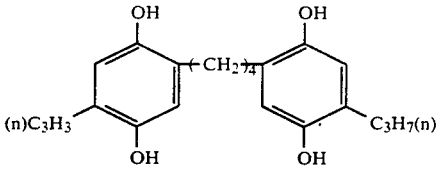
(III-35)
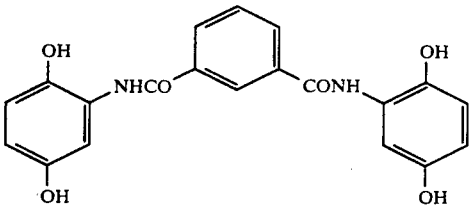
(III-36)
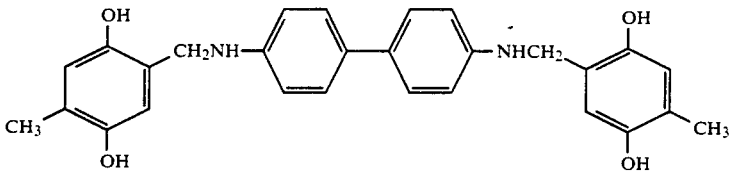

-continued

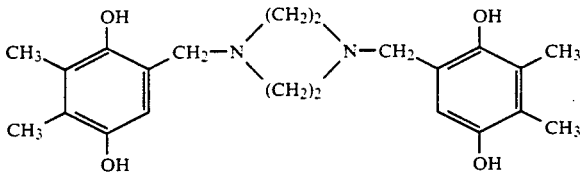

(III-37)

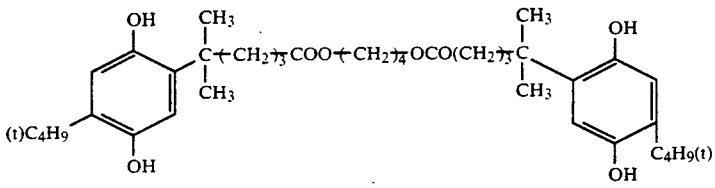

(III-38)

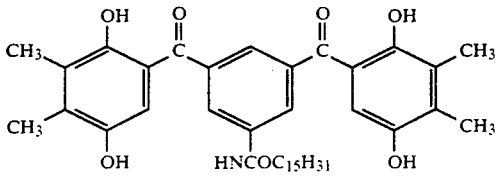

(III-39)

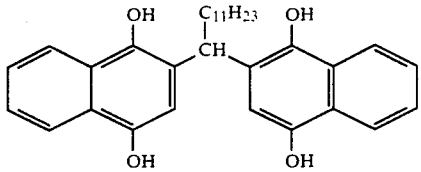

(III-40)

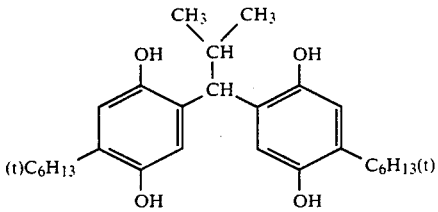

(III-41)

The compounds represented by formula (III) according to the present invention can generally be synthesized in accordance with the methods mentioned in, for example, U.S. Pat. No. 2,735,765 and JP-B-56-21145 (the term "JP-B" as used herein refers to an "examined Japanese patent publication").

Formula (IV) is now explained in detail.

$Z_2$ in formula (IV) represents a nucleophilic group or a group which decomposes in the photosensitive material to release a nucleophilic group. For example, as nucleophilic groups, groups in which the atom which chemically bonds directly with the oxidant of the aromatic amide developing agent is an oxygen atom, a sulfur atom or a nitrogen atom (for example, benzenesulphenyl, primary amine) are preferred. $R^{11}$ in formula (IV) represents an aliphatic group having 1 to 30 carbon atoms, an aryl group or a 5- to 8-membered heterocyclic group containing S, N or O. Preferred compounds are represented by formula (IVa):

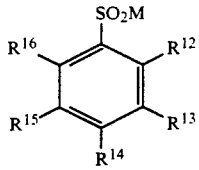

(IVa)

In formula (IVa), M represents an atom or atomic group which forms an inorganic (for example, Li, Na, K, Ca, Mg) salt or an organic (for example, triethylamine, methylamine, ammonia) salt,

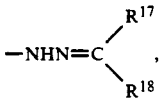

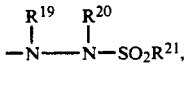

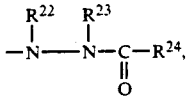

-continued

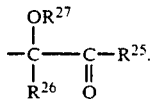

Here, $R^{17}$ and $R^{18}$ may be the same or different and respectively represent a hydrogen atom, an aliphatic group, an aromatic group or a heterocyclic group containing S, N or O. $R^{17}$ and $R^{18}$ may bond together to form a 5- to 7-membered ring. $R^{19}$, $R^{20}$, $R^{22}$ and $R^{23}$ may be the same or different and respectively represent a hydrogen atom, an aliphatic group, an aromatic group, a heterocyclic group containing S, N or O, an acyl group, an alkoxycarbonyl group, a sulfonyl group, a ureido group or a urethane group. With the proviso that at least one of $R^{19}$ and $R^{20}$, and at least one of $R^{22}$ and $R^{23}$ is a hydrogen atom. $R^{21}$ and $R^{24}$ represent a hydrogen atom, an aliphatic group, an aromatic group or a heterocyclic group containing S, N or O. $R^{21}$ further represents an alkylamino group, an arylamino group, an alkoxy group, an aryloxy group, an acyl group, an alkoxycarbonyl group or an aryloxycarbonyl group. Here, at least two groups of $R^{19}$, $R^{20}$ and $R^{21}$ may bond together to form a 5- to 7-membered ring, and at least two groups of $R^{22}$, $R^{23}$ and $R^{24}$ may bond together to form a 5- to 7-membered ring. $R^{25}$ represents a hydrogen atom, an aliphatic group, an aromatic group or a heterocyclic group containing S, N or O, and $R^{26}$ represents a hydrogen atom, an aliphatic group, an aromatic group, a halogen atom, an acyloxy group or a sulfonyl group. $R^{27}$ represents a hydrogen atom or a group which can undergo hydrolysis.

$R^{12}$, $R^{13}$, $R^{14}$, $R^{15}$ and $R^{16}$ in formula (IVa) may be the same or different and respectively represent a hydrogen atom, an aliphatic group (for example, methyl, isopropyl, t-butyl, vinyl, benzyl, octadecyl, cyclohexyl), an aromatic group (for example, phenyl, pyridyl, naphthyl), a heterocyclic group (for example, piperidyl, pyranyl, furanyl, chromanyl), a halogen atom (for example, chlorine, bromine),

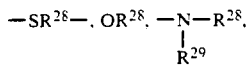

an acyl group (for example, acetyl, benzoyl), an alkoxycarbonyl group (for example, methoxycarbonyl, butoxycarbonyl, cyclohexylcarbonyl, octyloxycarbonyl), an aryloxycarbonyl group (for example, phenyloxycarbonyl, naphthyloxycarbonyl), a sulfonyl group (for example, methanesulfonyl, benzenesulfonyl), a sulfonamide group (for example, methanesulfonamide, benzenesulfonamide), a sulfamoyl group, a ureido group, a urethane group, a carbamoyl group, a sulfo group, a carboxyl group, a nitro group, a cyano group, an alkoxyallyl group (for example, methoxyallyl, isobutoxyallyl, octyloxyallyl, benzoyloxyallyl), an aryloxyallyl group (for example, phenoxyallyl, naphthoxyallyl), a sulfonyloxy group (for example, methanesulfonyloxy, benzenesulfonyloxy),

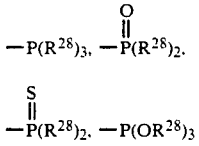

and a formyl group. Here, $R^{28}$ and $R^{29}$ represent a hydrogen atom, an aliphatic group having 1 to 30 carbon atoms, an alkoxy group having 1 to 30 carbon atoms or an aromatic group. Of these, those with a total Hammet $\sigma$ value of no less than 0.5 with respect to $-SO_2M$ are preferred from the point of view of the effects of the present invention.

Specific examples of compounds represented by formula (IV) are shown below, but the present invention is not limited to these.

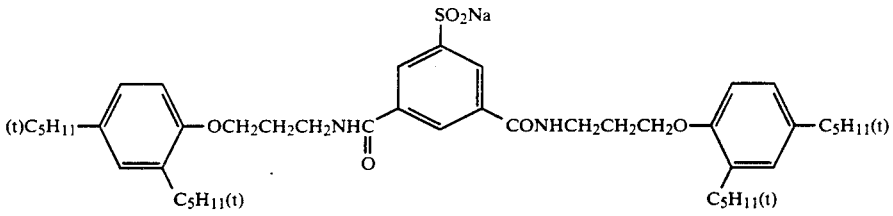

(IV-1)

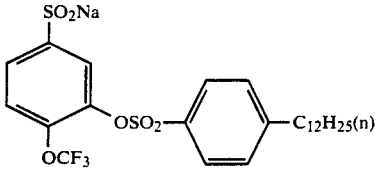

(IV-2)

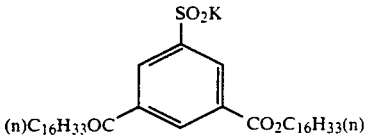

(IV-3)

-continued
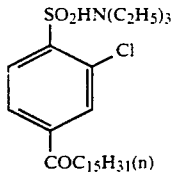
(IV-4)
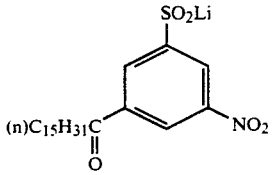
(IV-5)
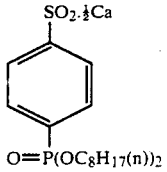
(IV-6)
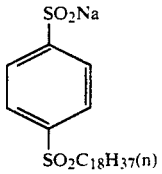
(IV-7)
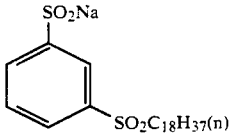
(IV-8)
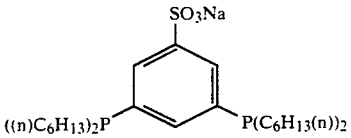
(IV-9)
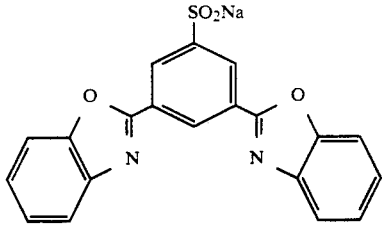
(IV-10)
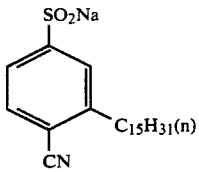
(IV-11)
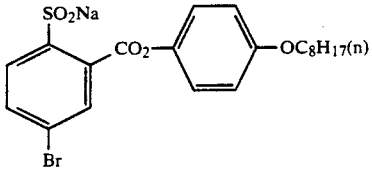
(IV-12)

-continued
(IV-13)
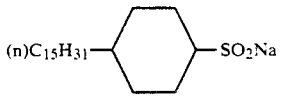
(IV-14)
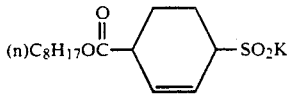
(IV-15)
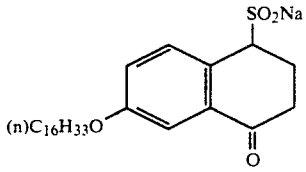
(IV-16)
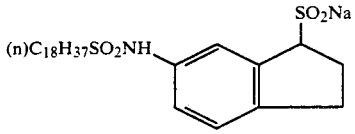
(IV-17)
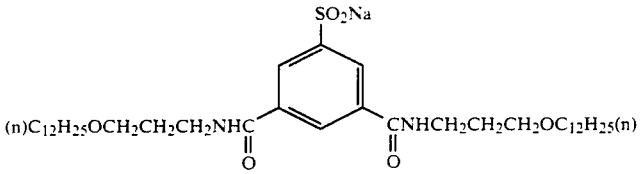
(IV-18)
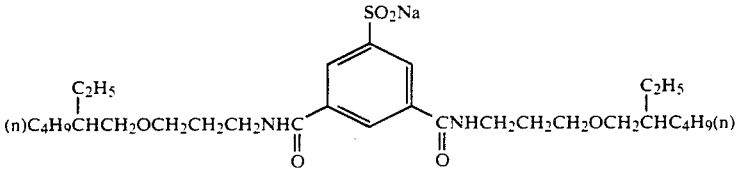
(IV-19)
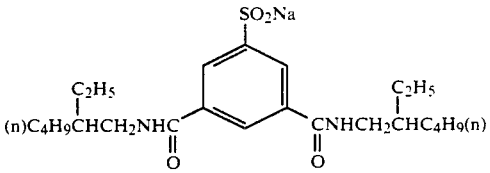
(IV-20)
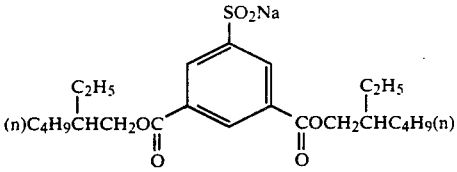
(IV-21)
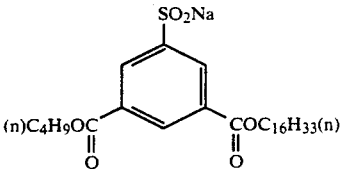
(IV-22)
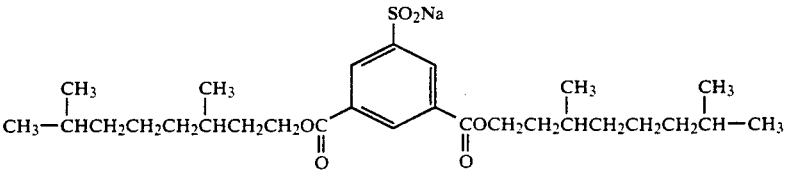

Formula (V) is explained in detail below.

The compound residual groups represented by Coup include acylacetoanilides, pyrazolones, pyrazolotriazoles, pyrazolobenzimidazoles, indazolones, naphthols and phenols.

As groups imparting diffusion resistance represented by Ball, there are a heterocyclic group, an aryl group or an alkyl group, having a total of 8 to 40 carbon atoms which may be substituted and which bond to the active coupling position in Coup with $$-O-,\ -S-,\ -\overset{O}{\overset{\|}{C}}O-,\ -OSO_2-\ \text{or}\ -\overset{O}{\overset{\|}{C}}NH-$$

and a heterocyclic group having a total of 10 to 40 carbon atoms which may be substituted and which bond to the active coupling position with nitrogen atoms. As preferred examples of Ball, there are, having a total of 8 to 40 carbon atoms, an alkoxy group, an aryloxy group, an alkylthio group, an arylthio group, an acyloxy group, an alkylsulfonyloxy group, an arylsulfonyloxy group, a heterocyclic oxy group, a heterocyclic thio group and a heterocyclic group bonded via a nitrogen atom (for example, groups derived from pyrrole, pyrazole, imidazole, triazole, tetrazole, indole, indazole, benzimidazole, benzotriazole, succinimide, maleinimide, phthalimide, 2-pyridone, 4-pyridone, imidazolidine-2,4-dione, oxazolidine-2,4-dione, thiazolidine-2,4-dione, triazolidine-3,5-dione, imidazolidine-2,4,5-trione and the like). These groups which are represented by Ball may be mutually bonded to a divalent or polyvalent group or they may be in pendant form on the main ethylenic polymer chain. In this case, they may be outside the above-mentioned range for the number of carbon atoms.

The solubilizing groups represented by Sol are groups which contain a dissociable hydroxyl, carboxyl, sulfo or aminosulfonyl group, and these dissociable hydroxyl, carboxyl, sulfo and aminosulfonyl groups may bond directly with the above-mentioned coupler residual group, may bond with the coupler residual group via an alkylene or an arylene or other such divalent group, or they may bond with the coupler group via a divalent group in which an alkylene group, an arylene group, $$-O-,\ -S-,\ -SO-,\ -SO_2-,\ -CONH-,$$

$$-SO_2NH-,\ -COO-,\ -SO_2O-,\ -\overset{O}{\overset{\|}{C}}-,\ -NH-$$

or the like have been complexed. A plurality of Sol units may be bonded to non-coupling groups of the coupler-residual group. Groups containing a carboxyl group or a sulfo group are preferred as Sol. Preferred examples of Sol are shown below. Here, the carboxyl group may be a carboxylate group (for example, —COONa— or —COOK) and the sulfo group may also be a sulfonato group (for example, —$SO_3Na$—, —COOK).

$$-COOH,\ -SO_3H,\ -SO_2NH_2,$$

-continued

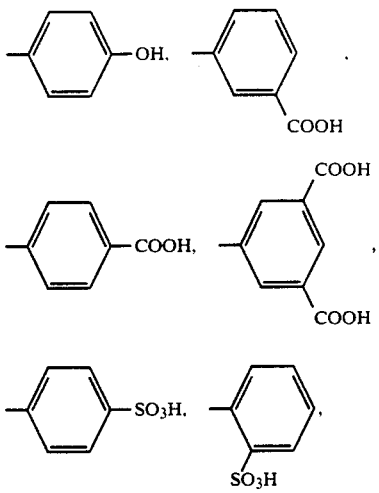

$$-CH_2COOH,\ -CH_2CH_2COOH,\ -CH_2CH_2SO_3H,$$

$$-OCH_2COOH,\ -OCH_2CH_2COOH,\ -SCH_2COOH,$$

$$-SCH_2CH_2COOH,\ -SO_2CH_2CH_2COOH,$$

$$-CONHCH_2CH_2COOH,\ \text{and}\ -CONHCH_2COOH.$$

The compounds represented by formula (V) are preferably compounds represented by the following formulae (QS-II), (QS-III), (QS-IV), (QS-V), (QS-VI) or (QS-VII).

Formula (QS-II)

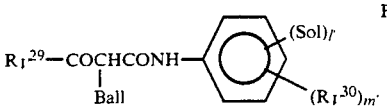

Formula (QS-III)

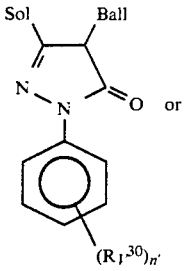

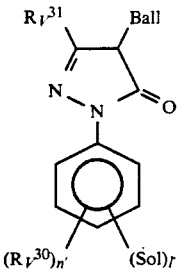

Formula (QS-IV)

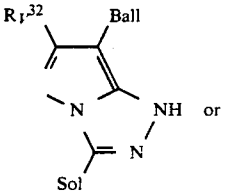

-continued

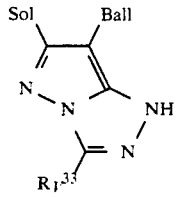

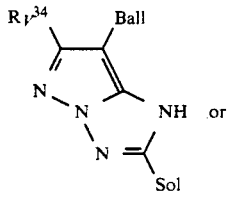

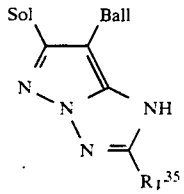

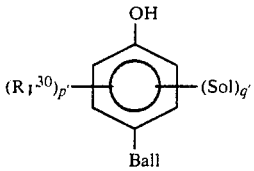

Formula (QS-VI)

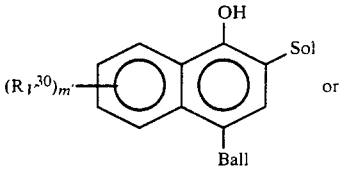

Formula (QS-VII)

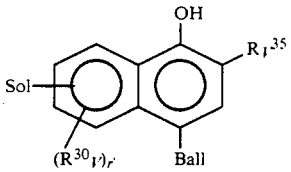

In formulae (QS-II), (QS-III), (QS-IV), (QS-V), (QS-VI) and (QS-VII), $R^{29}{}_V$ represents an alkyl group having 1 to 8 carbon atoms (for example, methyl, t-butyl), an alkoxy group having 1 to 8 carbon atoms (for example, methoxy, ethoxy), a group represented by

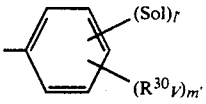

or an aryl group having 6 to 10 carbon atoms (for example, phenyl, 4-methoxyphenyl).

$R^{30}{}_V$ represents a halogen atom (for example, fluorine, chlorine, bromine or iodine), an alkyl group having 1 to 8 carbon atoms (for example, methyl, ethyl, hydroxymethyl), an alkoxy group having 1 to 8 carbon atoms (for example, methoxy, ethoxy, methoxyethoxy, hydroxyethoxy), a carbonamide group having 1 to 10 carbon atoms (for example, formamide, acetamide, benzamide), a sulfonamide group having 1 to 10 carbon atoms (for example, methanesulfonamide, ethanesulfonamide, p-toluenesulfonamide) or an aryloxy group having 6 to 10 carbon atoms (for example, phenoxy, p-methoxyphenoxy).

$R^{31}{}_V$ represents the same groups as $R^{30}{}_V$, an amino group having 1 to 10 carbon atoms (for example, diethylamino, pyrrolidine, anilino, 2-chloroanilino) or an aryl group having 6 to 10 carbon atoms (for example, phenyl, 4-chlorophenyl, 3-acetamidophenyl, 2-methoxyphenyl).

$R^{32}{}_V$, $R^{33}{}_V$, $R^{34}{}_V$ and $R^{35}{}_V$ respectively represent a group with the same meaning as $R^{31}{}_V$, a hydrogen atom, an alkylthio group having 1 to 8 carbon atoms (for example, methylthio, benzylthio), an arylthio group having 6 to 10 carbon atoms (for example, phenylthio, p-tolylthio) or an alkoxycarbonylamino group having 2 to 10 carbon atoms (for example, methoxycarbonylamino, ethoxycarbonylamino).

$R^{36}{}_V$ represents a group with the same meaning as $R^{30}{}_V$, a sulfamoyl group having 0 to 10 carbon atoms (for example, sulfamoyl, methylsulfamoyl, butylsulfamoyl, phenylsulfamoyl), an alkoxycarbonyl group having 2 to 10 carbon atoms (for example, methoxycarbonyl, ethoxycarbonyl, butoxycarbonyl) or a carbamoyl group having 1 to 10 carbon atoms (for example, carbamoyl, methylcarbamoyl, butylcarbamoyl, phenylcarbamoyl).

l′ represents an integer of 1 or 2, m′ and n′ represent integers of 0 to 4, p′ represents an integer of 0 to 2, q′ represents an integer of 1 or 2 and r′ represents an integer of 0 to 3. With the proviso that when m′, n′, p′ or r′ are greater than 1, the plurality of $R^{30}{}_V$ may be the same or different, and when l′ or q′ are 2, the plurality of Sol's may be the same or different.

Of the QS couplers represented by the above-mentioned formulae (QS-II) to (QS-VII), the QS couplers represented by formula (QS-VI) or (QS-VII) are preferred and the QS coupler represented by formula (QS-VII) is particularly preferred.

Specific examples of QS couplers used in the present invention are given below, but the present invention is not limited to these.

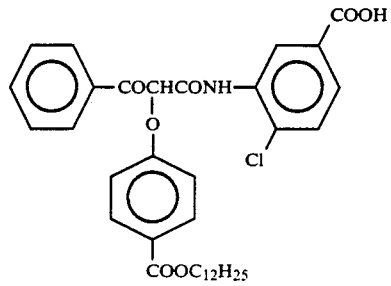

(V-1)

-continued
(V-2)
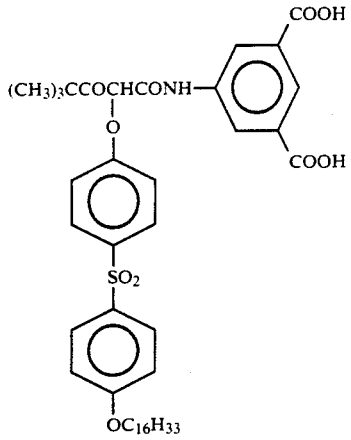
(V-3)
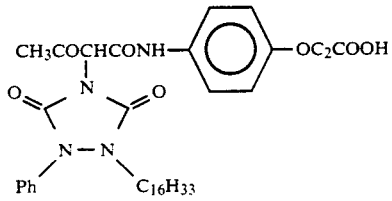
(V-4)
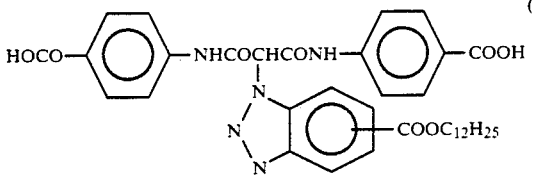
(V-5)
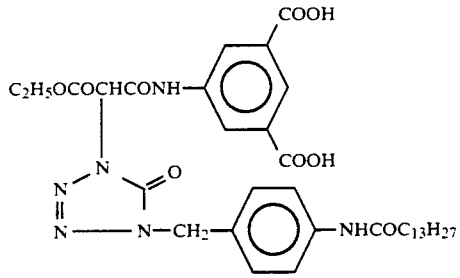
(V-6)
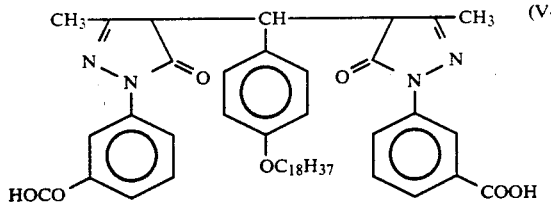
(V-7)
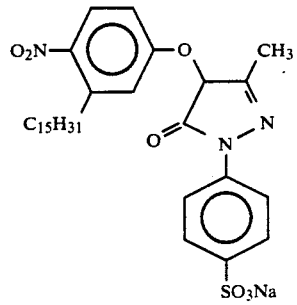
-continued
(V-8)
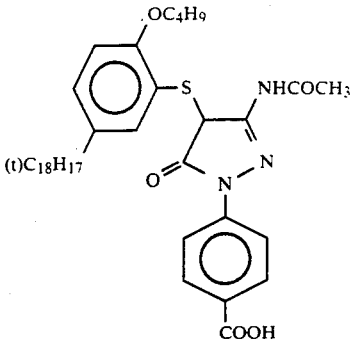
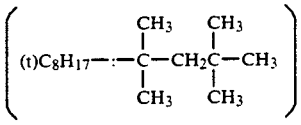
(V-9)
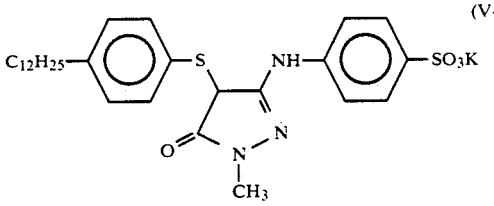
(V-10)
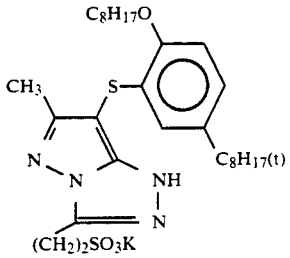
(V-11)
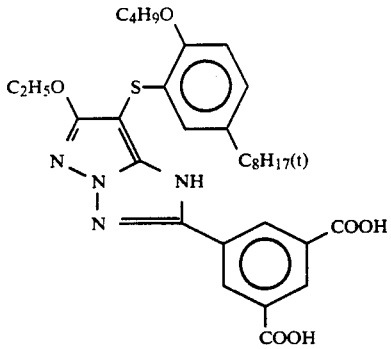
(V-12)
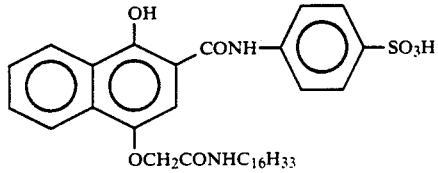

-continued
(V-13)
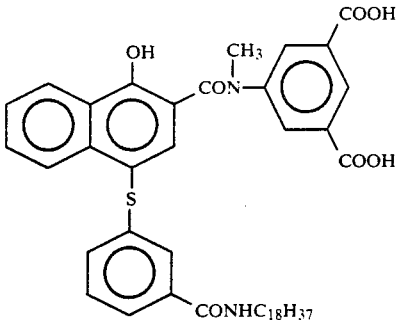
(V-14)
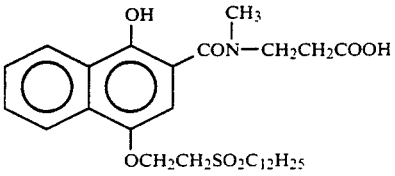
(V-15)
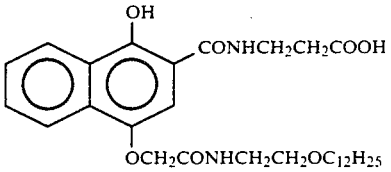
(V-16)
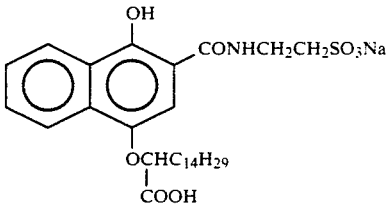
(V-17)
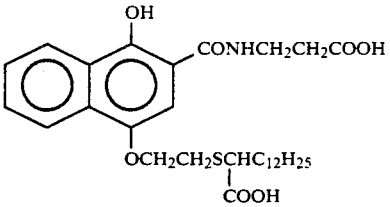
(V-18)
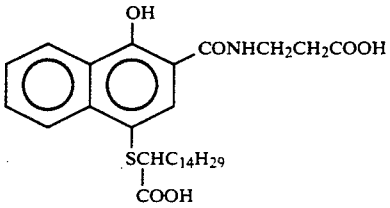
-continued
(V-19)
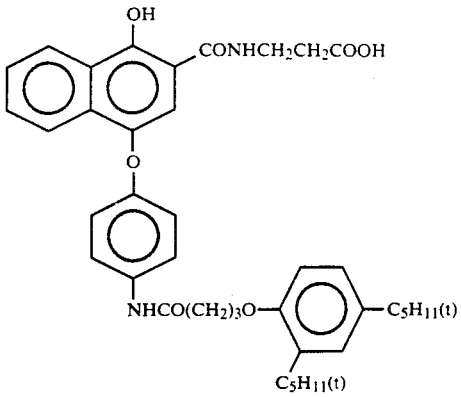
(V-20)
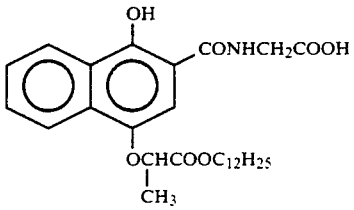
(V-21)
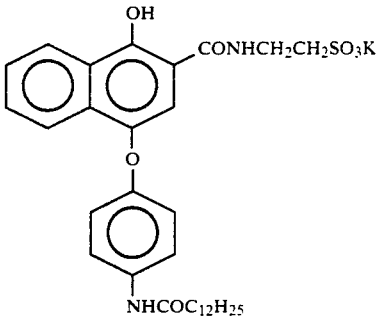
(V-22)
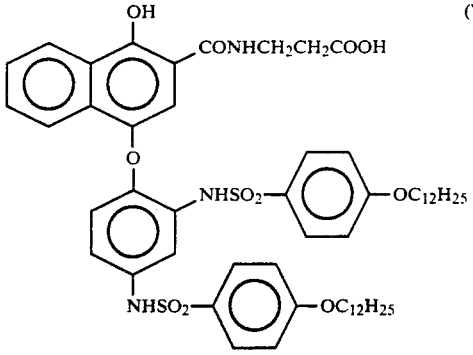
(V-23)
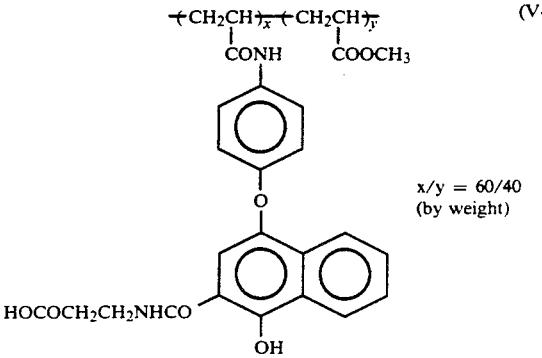
x/y = 60/40
(by weight)

-continued

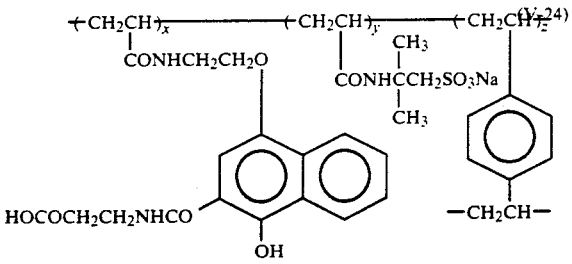

(V-24)

x/y/z = 50/40/10 (by weight)

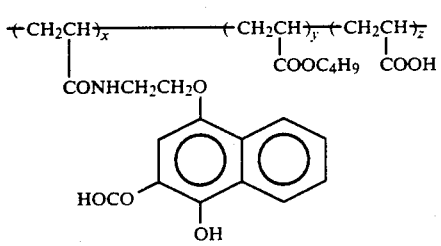

(V-25)

x/y/z = 50/25/25 (by weight)

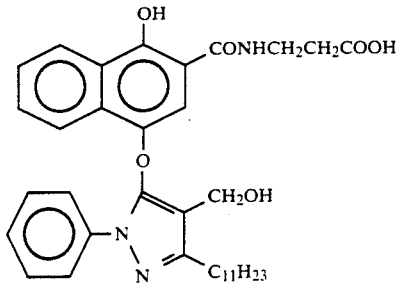

(V-26)

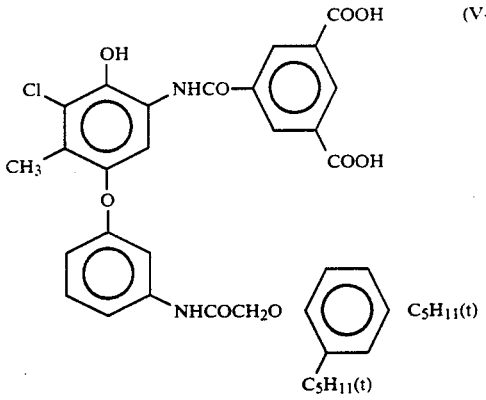

(V-27)

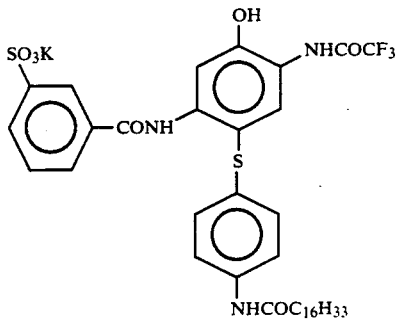

(V-28)

-continued

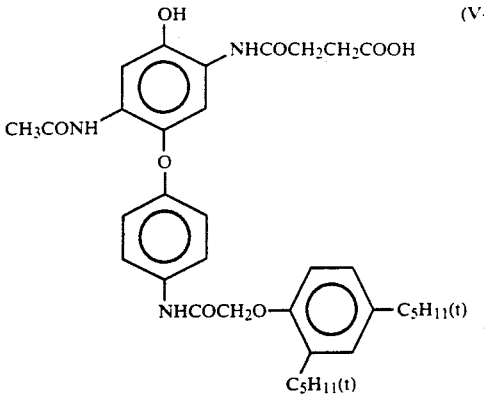

(V-29)

The compounds used in the present invention can, for example, be synthesized by the methods disclosed in JP-A-59-113440, JP-A-59-171955, British Patent 1,284,649 and U.S. Pat. No. 3,227,550.

Furthermore, the amounts of the compounds represented by formulae (II) to (V) which are used in the present invention are generally 0.1 to 200 mol %, preferably 0.5 to 100 mol % and particularly preferably 1 to 50 mol % based on the coupler represented by formula (I).

Among the above compounds represented by formulae (II) to (V), the compounds represented by formulae (III), (IV) and (V) are preferred, and further the compound represented by formula (IV) is particularly preferred.

The color photographic material employed in the practice of the present invention can be prepared by coating, onto a support, at least one blue-sensitive silver halide emulsion layer, green-sensitive silver halide emulsion layer and red-sensitive silver halide emulsion layer. With general color printing papers, it is usual for coating to be carried out in the above order, but orders which differ from this are also acceptable. It is possible to effect color reproduction of the subtractive color method by including, in these photosensitive emulsion layers, silver halide emulsions having sensitivities in the respective wavelength region and dyes having a complementary relationship with the light to which they are sensitive, i.e., so-called color couplers which form yellow in response to blue, magenta in response to green and cyan in response to red. However, the photosensitive layers and the hue which the couplers form may involve a structure which does not have the above correspondences.

Emulsions composed of silver chlorobromide or silver chloride and which substantially do not contain silver iodide preferably are used as the silver halide emulsions used in the present invention. "Substantially do not contain silver iodide" as referred to here means a silver iodide content of 1 mol % or less and preferably 0.2 mol % or less. The halogen composition of the emulsions may differ between grains or be the same, but it is easier to unify the properties of the various grains if an emulsion having similar halide compositions between grains is used.

Furthermore, as regards the silver halide distribution within the silver halide emulsion grains, it is possible to select, as convenient, grains having a so-called uniform structure in which the composition is similar whatever the portion of the silver halide grain, grains having a so-called layered structure in which the halogen composition differs between the core within the silver halide grain and the shell surrounding this (one layer or a plurality of layers), or grains having a structure having a portion in which the halogen composition differs in a non-laminar way within or on the surface of the grain (for example, when on the grain surface, a structure in which a portion having a different composition is joined to an edge, corner or surface of the grain). In order to obtain high photographic speeds, it is more advantageous to use either of the latter two structures than a uniform structure, and these are also preferred from the standpoint of the pressure resistance properties. In cases where the silver halide grains have structures such as those mentioned above, as regards the interface between portions of differing halide compositions, this may be a distinct boundary or it may be an indistinct boundary forming a mixed crystal by compositional changes, or again it may involve grains positively endowed with continuous structural changes.

As regards the halogen composition in these silver chlorobromide emulsions, it is possible to use emulsions having any desired silver bromide/silver chloride ratio. This ratio may be in a wide range in accordance with the intended use, but a silver chloride ratio of 2% or more is preferred.

Furthermore, so-called high silver chloride emulsions which have a high silver chloride content preferably are used in photosensitive materials suited to rapid processing. The silver chloride content of these high silver chloride emulsions is preferably 90 mol % or more and more preferably 95 mol % or more.

With such high silver chloride emulsions, structures having a localized silver bromide layer within the silver halide grain and/or on its surface in a laminar or non-laminar form as mentioned above are preferred. In the above-mentioned halogen compositions with a localized phase, those having a silver bromide content of at least 10 mol % are preferred and those in excess of 20 mol % are more preferred. The localized layers may be within the grain, on the edge or corner of the grain surface or on the surface, but, as one preferred example, it is possible to use grains grown epitaxially on the corners of the grains.

On the other hand, in high silver chloride emulsions having silver chloride contents of 90 mol % or more, grains with uniform structures having small halogen composition distributions within the grain are preferably used in order to suppress photographic speed reduction when the photosensitive materials experience pressure as much as possible.

Furthermore, it is also effective to further increase the silver chloride content of the silver halide emulsions in order to reduce an amount of replenisher of the development processing solution. In such cases, almost pure silver chloride emulsions having silver chloride contents of 98 mol % to 100 mol % are preferably used.

The average grain size of the silver halide grains contained in the silver halide emulsions used in the present invention (the numerical average taking the diameter of the circle equivalent to the projected surface area of the grain as the grain size) is preferably 0.1 μm to 2 μm.

Furthermore, as regards the grain size distribution, so-called monodispersed emulsions in which the variation coefficient (the standard deviation of the grain size divided by the average grain size) is 20% or less and preferably 15% or less are preferred. In such cases, in order to obtain a wide latitude, the above monodispersed emulsions are preferably blended and used in the same layer and multilayer coating is carried out.

As regards the form of the silver halide grains contained in the photographic emulsion, it is possible to use grains having a regular crystal form such as cubic, tetradecahedral or octahedral, grains having an irregular crystal form such as spherical, tabular, or grains having a complex form of these. Furthermore, emulsions in which grains having various crystal forms have been mixed may be used. Of these, emulsions containing grains having the above-mentioned regular crystal form at 50% or more, preferably 70% or more and more preferably 90% or more may be used in the present invention.

Furthermore, other than these, emulsions in which tabular grains having an average aspect ratio (circle-calculated diameter/thickness) of 5 or more and preferably 8 or more are in excess of 50% of the total grains by projected surface area can be preferably used.

The silver chlorobromide emulsions used in the present invention can be prepared using the methods described in, for example, P. Glafkides, *Chimie et Physique Photographique* (Paul Montel, 1967), G. F. Duffin, *Photographic Emulsion Chemistry* (Focal Press, 1966), and V. L. Zelikman et al., *Making and Coating Photographic Emulsions* (Focal Press, 1964). Thus, the acidic method, neutral method, ammonia method and the like are all acceptable, and it is possible to use any method such as the single jet method, the double jet method, combinations thereof and the like as forms of reacting soluble silver salts and soluble halogen salts. It is also possible to use the method in which the grains are formed in an environment with a silver ion excess (the so-called reverse mixing method). As one form of the double jet method, it is possible to use the method in which the pAg in the liquid phase producing the silver halide is kept stable, in other words, the so-called controlled double jet method. With this method, it is possible to obtain silver halide emulsions with regular crystal forms and almost uniform grain sizes.

It is possible to introduce various polyvalent metal ion impurities into the silver halide emulsions used in the present invention during the steps of emulsion grain formation or physical ripening. Examples of compounds used include salts of cadmium, zinc, lead, copper, thallium and the like or salts or complexes of iron, ruthenium, rhodium, palladium, osmium, iridium, platinum and the like which are Group VIII elements. The above Group VIII elements can be particularly preferably used. The amounts of these compounds which can be added extend over a wide range in accordance with the intended use, but $1\times10^{-9}$ to $1\times10^{-2}$ mol per mol of silver halide is preferred.

The silver halide emulsions used in the present invention are normally chemically sensitized and spectrally sensitized.

As regards the chemical sensitization method, it is possible to use, either singly or in combination, a sulfur sensitization as typified by the addition of unstable sulfur compounds, a noble metal sensitization as typified by gold sensitization, or a reduction sensitization. The substances mentioned from the lower right column of page 18 to the upper right column of page 22 of the specification of the report of JP-A-62-215272 preferably are used as the compounds used in the chemical sensitization.

The spectral sensitization is carried out on the emulsions of the various layers in the photosensitive materials of the present invention in order to give spectral sensitivities in the desired wavelength regions. In this invention, it is preferable that this is carried out by adding spectrally sensitizing dyes, which absorb light in the wavelength regions corresponding to the desired spectral sensitivities. The spectrally sensitizing dyes used here are described in F. M. Hamer, *Heterocyclic Compounds—Cyanine Dyes and Related Compounds* (John Wiley & Sons) (New York, London), 1964. As examples of specific compounds, the substances mentioned from the upper right column of page 22 to page 38 of the specification of the report of the above-mentioned JP-A-62-215272 preferably are used.

Various compounds or precursors thereof can be added to the silver halide emulsions used in the present invention in order to prevent fogging during the manufacture, storage or photographic processing of the photosensitive materials or to stabilize the photographic properties. These are generally called photographic stabilizers. The substances mentioned from page 39 to page 72 of the specification of the report of the above-mentioned JP-A-62-215272 are preferably used as specific examples of these materials.

The emulsions used in the present invention may be of the so-called surface latent image emulsion type in which the latent image forms mainly on the grain surface or of the so-called internal latent image emulsion type in which the latent image forms mainly on the inside of the grain.

Yellow couplers, magenta couplers and cyan couplers which respectively form yellow, magenta and cyan colors by coupling with the oxidants of aromatic amine-based color developing agents are commonly used in color photosensitive materials.

Of the yellow couplers which can be used in the present invention, acylacetanilide compounds such as benzoylacetanilide and pivaloylacetanilide are preferred.

Of these, the compounds represented by formulae (Y-1) and (Y-2) are ideal as yellow couplers.

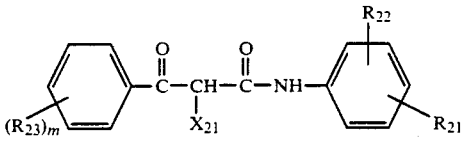

(Y-1)

-continued

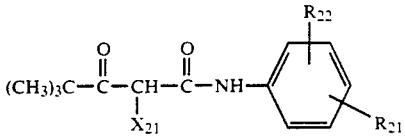

(Y-2)

In the above formulae, $X_{21}$ represents a hydrogen atom or a coupling-releasing group, $R_{21}$ represents a diffusion resistant group having 8 to 32 carbon atoms, $R_{22}$ represents a hydrogen atom, 1 or more halogen atoms (preferably 1 to 4 halogen atoms), a lower alkyl group having 1 to 6 carbon atoms, a lower alkoxy group having 1 to 6 carbon atoms or a diffusion resistant group having 8 to 32 carbon atoms. $R_{23}$ represents a hydrogen atom or a substituent. When m is 2 or more, these $R_{23}$ may be the same or different.

Details of pivaloylacetanilide-based yellow couplers are described from line 15 of column 3 to line 39 of column 8 of the specification of U.S. Pat. No. 4,622,287 and from line 50 of column 14 to line 41 of column 19 of the specification of U.S. Pat. No. 4,623,616.

Details of benzoylacetanilide-based yellow couplers are described, for example, in U.S. Pat. Nos. 3,408,194, 3,933,501, 4,046,575, 4,133,958 and 4,401,752.

Specific examples of pivaloylacetanilide-based yellow couplers include the compound examples (Y-1) to (Y-39) described from column 37 to column 54 of the specification of the above-mentioned U.S. Pat. No. 4,622,287, and of these, (Y-1), (Y-4), (Y-6), (Y-7), (Y-15), (Y-21), (Y-22), (Y-23), (Y-26), (Y-35), (Y-36), (Y-37), (Y-38) and (Y-39) are preferred.

Further, it is possible to mention the compound examples (Y-1) to (Y-33) described at columns 19 to 24 of the specification of the above-mentioned U.S. Pat. No. 4,623,616, and of these, (Y-2), (Y-7), (Y-8), (Y-12), (Y-20), (Y-21), (Y-23) and (Y-29) are preferred.

Furthermore, preferred examples include the typical specific example (34) described at column 6 of the specification of U.S. Pat. No. 3,408,194, compound examples (16) and (19) described at column 8 of the specification of U.S. Pat. No. 3,933,501, compound example (9) described at columns 7 to 8 of the specification of U.S. Pat. No. 4,046,575, compound example (1) described at columns 5 to 6 of the specification of U.S. Pat. No. 4,133,958, compound example 1 described at column 5 of the specification of U.S. Pat. No. 4,401,752 and the following compounds a) to h).

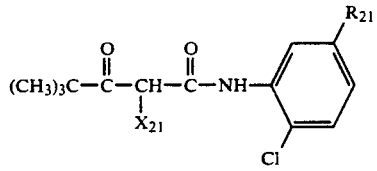

| Compound | $R_{21}$ | $X_{21}$ |
|---|---|---|
| a | $-CO_2CH(CH_3)CO_2C_{12}H_{25}$ | 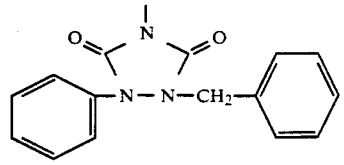 |

-continued

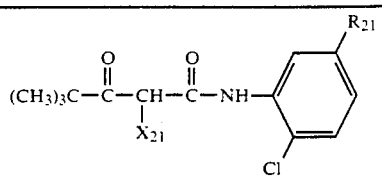

| Compound | $R_{21}$ | $X_{21}$ |
|---|---|---|
| b | $-CO_2CH(C_4H_9)CO_2C_{12}H_{25}$ | Same as in "a" above |
| c | 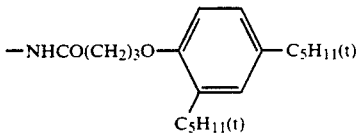 | 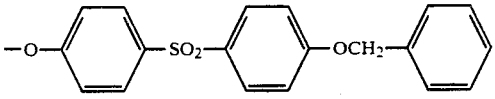 |
| d | Same as in "c" above | 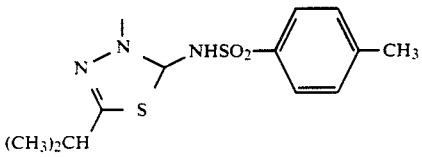 |
| e | Same as in "c" above | 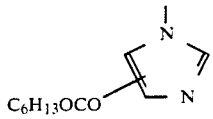 |
| f | $-NHSO_2C_{12}H_{25}$ | 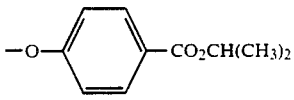 |
| g | $-NHSO_2C_{16}H_{33}$ | 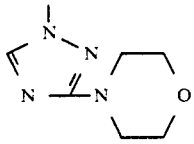 |
| h | $-NHCO(CH_3)CHCH_2SO_2C_{12}H_{25}$ | 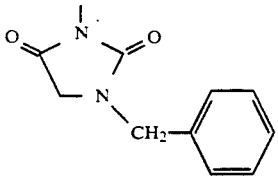 |

Of the above couplers, those which have a nitrogen atom for the releasing atom are particularly preferred.

Other magenta couplers which can be used in combination with the pyrazolone-based magenta couplers used in the present invention include oil protective type pyrazoloazole-based couplers such as indazolone-based or cyanoacetyl-based, preferably 5-pyrazolone-based and pyrazolotriazoles. Of the 5-pyrazolone-based couplers, couplers in which the 3-position has been substituted with an arylamino group or acylamino group are preferred from the point of view of the hue and color density of the color-forming dye, and representative examples of these couplers are mentioned, for example, in U.S. Pat. Nos. 2,311,082, 2,343,703, 2,600,788, 2,908,573, 3,062,653, 3,152,896 and 3,936,015. As 2-equivalent 5-pyrazolone-based coupler releasing groups, the nitrogen atom releasing groups mentioned in U.S. Pat. No. 4,310,619 and the arylthio groups mentioned in U.S. Pat. No. 4,351,897 are preferred. Furthermore, a high color density is obtained with the 5-pyrazolone-based couplers having ballast groups mentioned in European Patent 73,636.

As pyrazoloazole-based couplers, the pyrazolobenzimidazoles mentioned in U.S. Pat. No. 2,369,879, and preferably the pyrazolo[5,1-c][1,2,4]triazoles mentioned in U.S. Pat. No. 3,725,067, the pyrazolotetrazoles mentioned in *Research Disclosure*, 24220 (June, 1984) and the pyrazolopyrazoles mentioned in *Research Disclosure*, 24230 (June, 1984) are preferably used. Any of the couplers mentioned above may be a polymer coupler.

Specifically, these compounds are represented by the following formulae (M-1), (M-2) or (M-3).

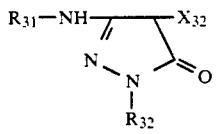
(M-1)

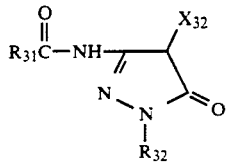
(M-2)

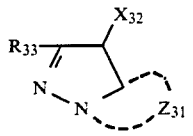
(M-3)

Here, $R_{31}$ represents a diffusion resistant group having 8 to 32 carbon atoms, $R_{32}$ represents a phenyl group or a substituted phenyl group, $R_{33}$ represents a hydrogen atom or a substituent group, $Z_{31}$ represents a non-metal atomic group necessary to form a 5-membered azole ring containing 2 to 4 nitrogen atoms, and the azole ring may contain substituents (and may contain condensed rings).

$X_{32}$ represents a hydrogen atom or a releasing group. Details of the substituents for $R_{33}$ and the substituents for the azole ring are described, for example, at line 41 of column 2 to line 27 of column 8 of the specification of U.S. Pat. No. 4,540,654.

Of the pyrazoloazole-based couplers, the imidazo[1,2-b]pyrazoles described in U.S. Pat. No. 4,500,630 are preferred and the pyrazolo[1,5-b][1,2,4]-triazoles described in U.S. Pat. No. 4,540,650 are particularly preferred from the point of view of reduced yellow side absorption and light fastness of the color-forming dye.

In addition, it is preferred to use pyrazolotriazole couplers in which branched alkyl groups are directly bonded to the 2-, 3- or 6-position of the pyrazolotriazole ring as described in JP-A-61-65245, pyrazoloazole couplers containing sulfonamide groups within the molecule as described in JP-A-61-65246, pyrazoloazole couplers having alkoxyphenylsulfonamide ballast groups as described in JP-A-61-147254 and pyrazolotriazole couplers having alkoxy groups or aryloxy groups in the 6-position as described in European Patent (Laid-Open) No. 226,849.

Specific examples of these couplers are listed below.

| Compound | $R_{33}$ | $R_{34}$ | $X_{32}$ |
|---|---|---|---|
| | | 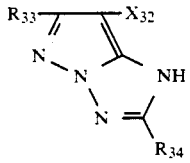 | |
| M'-1 | $CH_3$— | 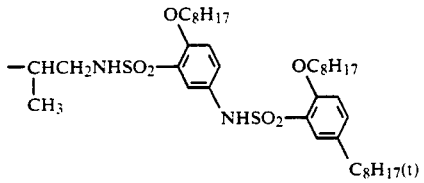 | Cl |
| M'-2 | " | 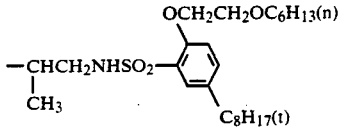 | " |
| M'-3 | " | 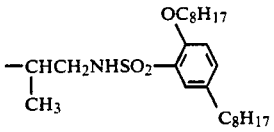 | 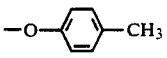 |
| M'-4 | 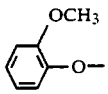 | 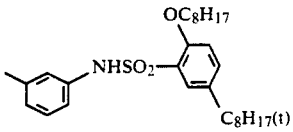 | 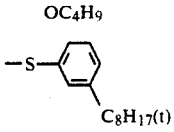 |

-continued
| Compound | $R_{33}$ | $R_{34}$ | $X_{32}$ |
|---|---|---|---|
| M'-5 | $CH_3$— | 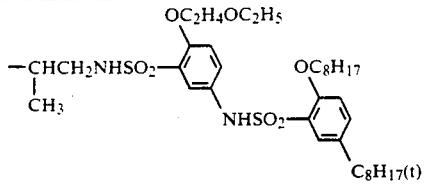 | Cl |
| M'-6 | " | 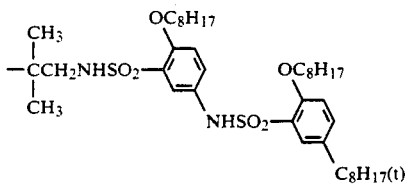 | " |
| M'-7 | 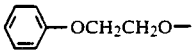 | 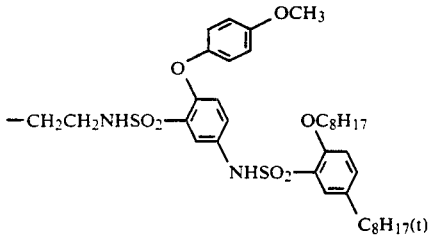 | 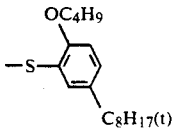 |
| M'-8 | $CH_2CH_2O$— | Same as in "M'-7" | Same as in "M'-7" |
| M'-9 | 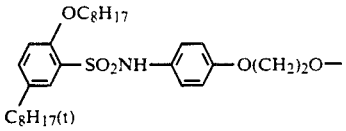 | 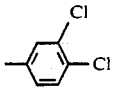 | " |
| M'-10 | 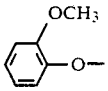 | 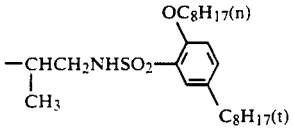 | Cl |
| | | 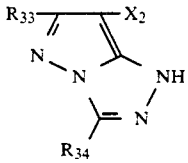 | |
| M'-11 | $CH_3$— | 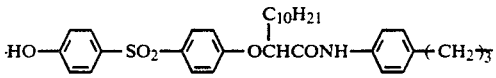 | Cl |
| M'-12 | $CH_3$— | 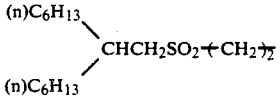 | Cl |
| M'-13 | 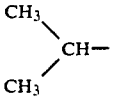 | 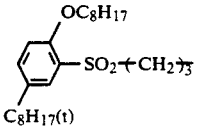 | " |
| M'-14 | 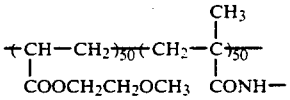 | 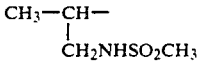 | " |

-continued

| Compound | $R_{33}$ | $R_{34}$ | $X_{32}$ |
|---|---|---|---|
| M'-15 | 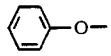 | 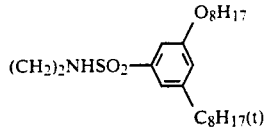 | Cl |
| M'-16 | 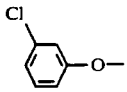 | 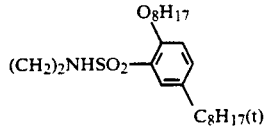 | 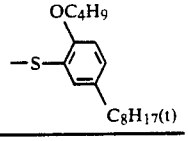 |

Phenol-based cyan couplers and naphthol-based cyan couplers are the most representative in cyan couplers.

Examples of phenol-based cyan couplers include those having acylamino groups in the 2-position and having alkyl groups in the 5-position of the phenol nucleus (including polymer couplers) as described in, for example, U.S. Pat. Nos. 2,369,929, 4,518,687, 4,511,647 and 3,772,002, and as representative specific examples of these, it is possible to mention the coupler of Example 2 of Canadian Patent 625,822, the compound (1) of U.S. Pat. No. 3,772,002, the compounds (I-4) and (I-5) of U.S. Pat. No. 4,564,590, the compounds (1), (2), (3) and (24) of JP-A-61-39045 and the compound (C-2) of JP-A-62-70846.

Examples of phenol-based cyan couplers also include 2,5-diacylaminophenol-based couplers as described in U.S. Pat. Nos. 2,772,162, 2,895,826, 4,334,011, 4,500,653 and JP-A-59-164555, and, as representative examples of these, it is possible to mention, for example, compound (V) described in U.S. Pat. No. 2,895,826, compound (17) described in U.S. Pat. No. 4,557,999, compounds (2) and (12) described in U.S. Pat. No. 4,565,777, compound (4) described in U.S. Pat. No. 4,124,396 and compound (I-19) described in U.S. Pat. No. 4,613,564.

Examples of phenol-based cyan couplers also include those in which nitrogen-containing heterocyclic rings have been condensed onto phenol nuclei as described in U.S. Pat. Nos. 4,372,173, 4,564,586 and 4,430,423, JP-A-61-390441 and JP-A-62-257158, and, as representative examples of these, it is possible to mention couplers (1) and (3) described in U.S. Pat. No. 4,327,173, compounds (3) and (16) described in U.S. Pat. No. 4,564,586, compounds (1) and (3) described in U.S. Pat. No. 4,430,423 and the following compounds.

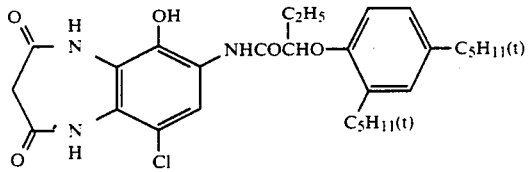

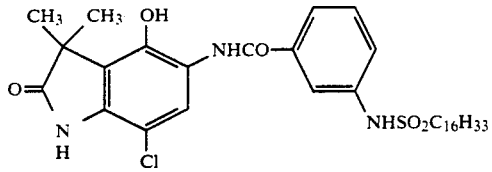

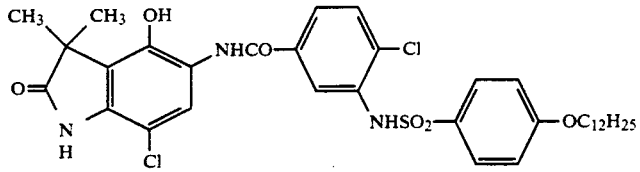

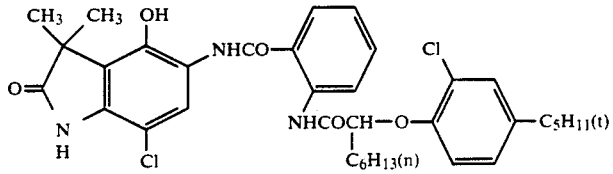

-continued
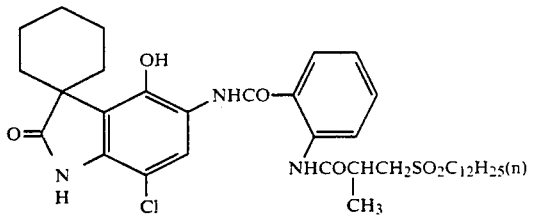
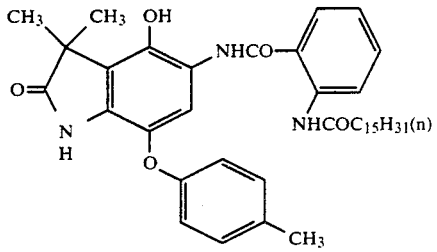
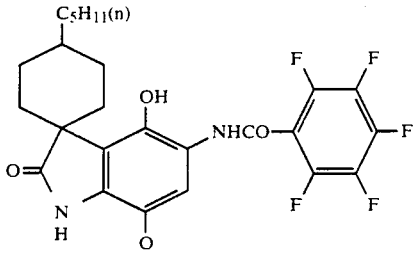
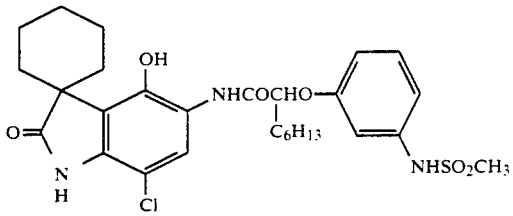
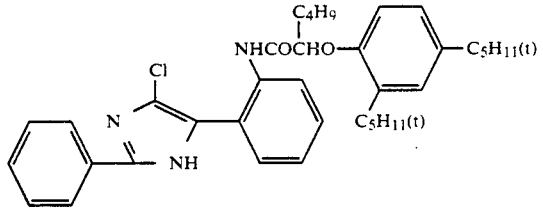
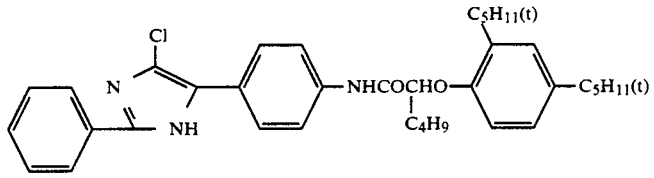
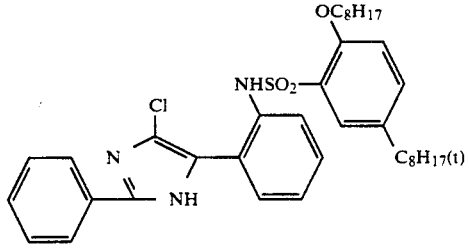

-continued

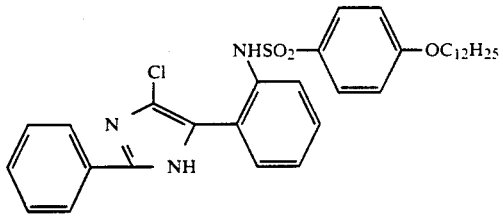

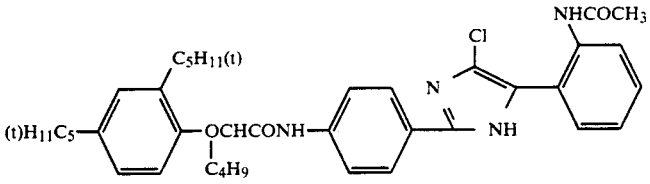

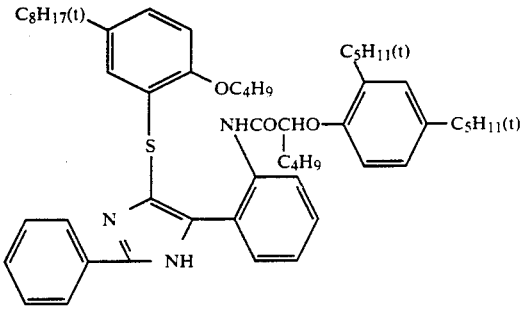

In addition to cyan couplers of the above-mentioned types, it is also possible to use, for example, the diphenylimidazole-based cyan couplers described in European Patent Application (Laid-Open) EP 0,249,453A2.

Examples of phenol-based cyan couplers, in addition to these, include the ureido-based couplers described in, for example, U.S. Pat. Nos. 4,333,999, 4,451,559, 4,444,872, 4,427,767, 4,579,813 and European Patent (EP) 067,689B1, and, as representative examples of these, it is possible to mention, for example, coupler (7) described in U.S. Pat. No. 4,333,999. coupler (1) described in U.S. Pat. No. 4,451,559, coupler (14) described in U.S. Pat. No. 4,444,872, coupler (3) described in U.S. Pat. No. 4,427,767, couplers (6) and (24) described in U.S. Pat. No. 4,609,619, couplers (1) and (11) described in U.S. Pat. No. 4,579,813, couplers (45) and (50) described in European Patent (EP) 067,689B1 and coupler (3) described in JP-A-61-42658.

Examples of naphthol-based cyan couplers include those having an N-alkyl-N-arylcarbamoyl group in the 2-position of the naphthol nucleus (U.S. Pat. No. 2,313,586, for example), those having an alkylcarbamoyl group in the 2-position (U.S. Pat. Nos. 2,474,293 and 4,282,312, for example), those having arylcarbamoyl groups in the 2-position (JP-B-50-14523, for example), those having carbonamide or sulfonamide groups in the 5-position (JP-A-60-237448, JP-A-61-145557 and JP-A-61-153640, for example), those having an aryloxy releasing group (U.S. Pat. No. 3,476,563, for example), those having a substituted alkoxy releasing group (U.S. Pat. No. 4,296,199, for example) and those having glycolate releasing groups (JP-B-60-39217, for example).

These couplers can be contained in a dispersed emulsion layer together with at least one type of high boiling point organic solvent. A high boiling point organic solvent represented by formulae (A) to (D) preferably is used.

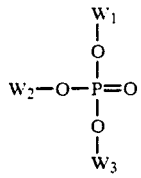

Formula (A)

$W_1-COO-W_2$ Formula (B)

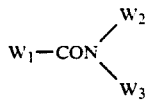

Formula (C)

$W_1-O-W_2$ Formula (D)

In the above formulae, $W_1$, $W_2$ and $W_3$ respectively represent a substituted or unsubstituted alkyl group having 1 to 3 carbon atoms, a substituted or unsubstituted cycloalkyl, alkenyl or aryl group, or 5- to 8-membered heterocyclic group containing S, N or O.

Details of these high boiling point organic solvents are given at the lower right column of page 137 to the upper right column of page 144 of JP-A-62-215272. Other types of high boiling point organic solvents used effectively with the couplers of the present invention include N,N-dialkylaniline compounds. Of these, those which have an alkoxy group bonded to the ortho position of the N,N-dialkylamino group are preferred. Specifically, it is possible to mention, for example, the following compound:

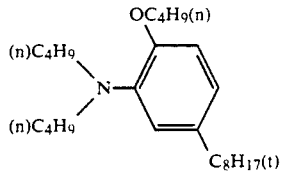

This type of high boiling point organic solvent prevents the occurrence of magenta staining in the white base of color prints for development which is caused by aging, and is useful in preventing fog caused by development. The amount used is generally 10 to 500 mol % and is preferably within the range 20 to 300 mol % with respect to the coupler.

Furthermore, these couplers can be impregnated into loadable latex polymers with or without the presence of the high boiling point organic solvents described above (U.S. Pat. No. 4,203,716, for example), or they can be emulsified and dispersed in hydrophilic colloid solutions by dissolving in water-insoluble but organic solvent-soluble polymers.

Preferably, the monomers or copolymers described on pages 12 to 30 of the specification of the Laid-Open International Patent No. WO 88/00723 are used, and the use of acrylamide-based polymers is particularly preferred for color image stabilization and the like.

The photosensitive materials produced using the present invention may contain hydroquinone derivatives, aminophenol derivatives, gallic acid derivatives, ascorbic acid derivatives as anti-color-fogging agents.

Various anti-color-fading agents can be used in the photosensitive materials of the present invention. Representative examples of organic anti-color-fading agents for cyan, magenta and/or yellow images include hindered phenols such as hydroquinones, 6-hydroxychromans, 5-hydroxycoumarans, spirochromans, p-alkoxyphenols and bisphenols; gallic acid derivatives; methylenedioxybenzenes; aminophenols; hindered amines; and ester or ether derivatives in which phenolic hydroxyl groups of these compounds have been silylated or alkylated. Furthermore, it is also possible to use, for example, metal complexes as typified by (bissalicylaldoximato)nickel complexes and (bis-N,N-dialkyldithiocarbamato)nickel complexes.

Specific examples of organic anti-color-fading agents are described in the specifications of the patents given below.

Hydroquinones are described in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801, 2,816,028, etc.; 6-hydroxychromans, 5-hydroxycoumarans and spirochromans are described in U.S. Pat. Nos. 3,432,300, 3,573,050, 3,574,627, 3,698,909 and 3,764,337, JP-A-52-152225, etc.; spiroindanes are described in U.S. Pat. No. 4,360,589; p-alkoxyphenols are described in U.S. Pat. No. 2,735,765, British Patent 2,066,975, JP-A-59-10539, JP-B-57-19765, etc.; hindered phenols are described in U.S. Pat. No. 3,700,455, JP-A-52-72224, U.S. Pat. No. 4,228,235, JP-B-52-6623, etc.; gallic acid derivatives, methylenedioxybenzenes and aminophenols are respectively described in U.S. Pat. Nos. 3,457,079 and 4,332,886, JP-B-56-21144, etc.; hindered amines are described in U.S. Pat. Nos. 3,336,135 and 4,268,593, British Patents 132,889, 1,354,313 and 1,410,846, JP-B-51-1420, JP-A-58-114036, JP-A-59-53846, JP-A-59-78344, etc.; ether and ester derivatives of phenolic hydroxyl groups are described in U.S. Pat. Nos. 4,155,765, 4,174,220, 4,254,216 and 4,264,720, JP-A-54-145530, JP-A-55-6321, JP-A-58-105147, JP-A-59-10539, JP-B-57-37865, U.S. Pat. No. 4,279,990, JP-B-53-3263, etc.; and metal complexes are described in U.S. Pat. Nos. 4,050,938 and 4,241,155, British Patent 2,027,731(A), respectively. With these compounds, it is normally possible to achieve the objective by emulsifying, together with the coupler, in an amount 5 to 10% by weight based on the respective corresponding color couplers and adding to the photosensitive layer. In order to prevent deterioration in the cyan color image due to heat and, particularly, light, it is more effective to introduce an ultraviolet absorber into the layers on both sides adjacent to the cyan color-forming layer.

Of the above anti-color-fading agents, spiroindanes and hindered amines and the like are particularly preferred.

Together with the above-mentioned couplers, the use of compounds such as those mentioned below is preferred in the present invention.

Thus, for example, because they prevent the occurrence of stain and other such side-effects (i.e., side-reaction) caused by color developing agents remaining in the film during storage after processing, it is preferable to use, either simultaneously or independently, a compound (F) which produces chemically inert and substantially colorless compounds by bonding chemically with aromatic amine-based developing agents remaining after color development processing and/or a compound (G) which forms chemically insert and substantially colorless compounds by bonding chemically with the oxidants of aromatic amine-based color developing agents remaining after color development processing.

Preferred compound (F) are compounds for which the second order reaction rate constant k2 with p-anisidine (in trioctyl phosphate at 80° C.) is within the range 1.0 liter/mol.sec to $1\times10^{-5}$ liter/mol.sec. Furthermore, the second order rate constant can be measured using the method disclosed in JP-A-63-158545.

When k2 is in excess of this range, the compound itself becomes unstable and will react with gelatin and water and decompose. On the other hand, if k2 is lower than this range, the reaction with the residual aromatic amine developing agents is delayed as a result of which it is not possible to prevent the side-effects of the residual aromatic amine-based developing agents which is an object of the present invention.

Particularly preferred compound (F) can be represented by formulae (FI) or (FII).

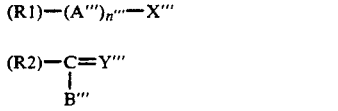

Formula (FI)

Formula (FII)

In the above formulae, (R1) and (R2) respectively represent aliphatic groups, aromatic groups or heterocyclic groups. n''' represents 1 or 0. A''' represents a group which reacts with aromatic amine-based developing agents to form a chemical bond and X''' represents a group which is released upon reacting with aromatic amine-based developing agents. B''' represents a hydrogen atom, an aliphatic group, an aromatic group, a heterocyclic group, an acyl group or a sulfonyl group, and Y''' represents a group which accelerates the addition of aromatic amine-based developing agents to a compound of formula (FII). Here, (R1) and X''', or Y''' and (R2) or B''' may bond together to form a cyclic structure.

Representative examples of methods for chemically bonding with residual aromatic amine-based developing agents are substitution reactions and addition reactions.

Specific examples of compounds represented by formulae (FI) and (FII) are described in the specifications of, for example, JP-A-63-158545, JP-A-62-283338, Japanese Patent Application No. 62-158342 and Japanese Patent Application No. 63-18439.

Water-soluble dyes may be contained in photosensitive materials produced using the present invention for the prevention of irradiation, as filter dyes in hydrophilic colloid layers or for various other purposes. Such dyes include oxonol dyes, hemioxonol dyes, styryl dyes, merocyanine dyes, cyanine dyes and azo dyes. Of these, oxonol dyes, hemioxonol dyes and merocyanine dyes are useful.

It is advantageous to use gelatin as the binder or protective colloid which can be used in the emulsion layers of the photosensitive materials of the present invention, but it is possible to also use other hydrophilic colloids either singly or together with gelatin.

In the present invention, the gelatin may be lime-treated or may be treated using acids. The details of a production method for gelatin are discussed in Arthur Weiss, *The Macromolecular Chemistry of Gelatin,* (Academic Press, published in 1964).

It is possible to use transparent film and reflective supports such as cellulose nitrate film and polyethylene terephthalate which are commonly used in photographic materials as the supports used in the practice of the present invention. The use of reflective supports is particularly preferred.

"Reflective support" as referred to in the present specification means one in which the reflectiveness has been raised and which accentuates the dye image formed in the silver halide emulsion layer, and such reflective supports include those covered with a hydrophobic resin in which a light-reflecting substance such as titanium oxide, zinc oxide, calcium carbonate, or calcium sulfate has been dispersed or those in which a hydrophobic resin in which a light-reflective substance has been dispersed is used as the support. For example, there is a baryta paper, a polyethylene-covered paper, a polypropylene-based synthetic paper, a transparent support jointly provided with a reflective layer or jointly using reflective substances, for example, glass plates, polyethylene terephthalate, polyester films such as cellulose triacetate or cellulose nitrate, polyamide films, polycarbonate films, polystyrene films, vinyl chloride resins and the like and these supports can be appropriately selected in accordance with the intended use.

As the light-reflective substance, a white pigment may be thoroughly mixed in the presence of a surfactant, and it is preferable to use substances in which the surfaces of pigment grains have been treated with dihydric to tetrahydric alcohols.

Most typically, the percentage of the occupied surface are of the white pigment grains for a given unit surface area can be determined by dividing the observed area into adjacent 6 $\mu m \times 6$ $\mu m$ unit areas and then measuring the occupied area percentage (Ri) of the projected grains in this unit area. The variation coefficient in the occupied area percentage can be determined from the ratio of the standard deviation s of Ri to the average value ($\bar{R}$) of Ri:s/$\bar{R}$. It is preferable that the number (n) of unit areas investigated is not less than 6. Thus, the variation coefficient s/$\bar{R}$ can be determined by the following equation:

$$S/R = \sqrt{\frac{\sum_{i=1}^{n} (Ri - R)^2}{n-1}} \Big/ \frac{\sum_{i=1}^{n} Ri}{n}$$

In the present invention, it is preferable that the variation coefficient in the occupied area percentage of pigment grain is 0.15 or less and particularly 0.12 or less. In cases where it is 0.08 or less, it is possible to say that the grain dispersion is essentially "uniform".

The color developing solution used in the present invention contains a known aromatic primary amine color developing agent. Preferred examples thereof are p-phenylenediamine derivatives. Typical examples of the p-phenylenediamine derivative used are set forth below, but the present invention should not be construed as being limited thereto.

D- 1: N,N-Diethyl-p-phenylenediamine
D- 2: 2-Amino-5-diethylaminotoluene
D- 3: 2-Amino-5-(N-ethyl-N-laurylamino)toluene
D- 4: 4-[N-Ethyl-N-(β-hydroxyethyl)amino]aniline
D- 5: 2-Methyl-4-[N-ethyl-N-(β-hydroxyethyl-)amino]aniline
D- 6: 4-Amino-3-methyl-N-ethyl-N-[β-(methanesulfonamino)ethyl]aniline
D- 7: N-(2-Amino-5-diethylaminophenylethyl)methanesulfonamide
D- 8: N,N-Dimethyl-p-phenylenediamine
D- 9: 4-Amino-3-methyl-N-ethyl-N-methoxyethylaniline
D- 10: 4-Amino-3-methyl-N-ethyl-N-β-ethoxyethylaniline
D- 11: 4-Amino-3-methyl-N-ethyl-N-β-butoxyethylaniline Of these p-phenylenediamine derivatives, D-6 is particularly preferred.

These p-phenylenediamine derivatives may be in the form of salts such as sulfates, hydrochlorides, sulfites, or p-toluenesulfonates.

The aromatic primary amine developing agent is preferably used in an amount of generally from about 0.1 g to about 20 g and more preferably from about 0.5 g to about 10 g per liter of the developing solution.

Also, the color developing solution used in the present invention may contain, if desired, sulfites such as sodium sulfite, potassium sulfite, sodium bisulfite, potassium bisulfite, sodium metasulfite, and potassium metasulfite, or carbonyl-sulfite adducts, as preservatives.

However, in order to reduce an environmental pollution, it is preferred that the color developing solution substantially contains no sulfite ion to improve a color forming property when the color developing solution contains no benzyl alcohol. In the above system, the present invention can particularly obtain excellent effects.

The term "substantially contains no sulfite ion" means that the color developing solution contains a sulfite ion in an amount of 0.5 g or less, preferably 0.2 g or less and particularly preferably 0 g calculated as sodium sulfite per liter of the solution.

Further, it is preferred to add, as compounds capable of directly preserving the color developing agent, various hydroxylamines, hydroxamic acids as described in JP-A-63-43138, hydrazines and hydrazides as described in European Patent 254,280A, phenols as described in JP-A-63-44657 and JP-A-63-58443, α-hydroxyketones and α-aminoketones as described in JP-A-63-44656, and/or various saccharides as described in JP-A-63-36244 to the color developing solution. Moreover, together with the above-described compounds, monoamines as described in JP-A-63-4235, JP-A-63-24254, JP-A-21647, JP-A-63-146040, JP-A-63-27841 and JP-A-63-25654; diamine as described in JP-A-63-30845, JP-A-63-146040 and JP-A-63-43139; polyamines as described in JP-A-44655, nitroxy radicals as described in JP-A-63-53551; alcohols as described in JP-A-63-43140 and JP-A-63-53549; oximes as described in JP-A-63-56654; and tertiary amines as described in European Patent 266,797 are preferably employed.

Other preservatives such as various metals as described in JP-A-57-44148 and JP-A-57-53749, silicylic acids as described in JP-A-59-180588, alkanolamines as described in JP-A-54-3532, polyethyleneimines as described in JP-A-56-94349, aromatic polyhydroxyl compounds as described in U.S. Pat. No. 3,746,544, etc., may be incorporated into the color developing solution, if desired. Particularly, the addition of alkanolamines such as triethanolamine, dialkylhydroxylamines such as diethylhydroxylamine, or aromatic polyhydroxy compounds is preferred.

The color developing solution used in the present invention has a pH which ranges preferably from 10.3 to 12.0 and more preferably from 10.5 to 11.5. The color developing solution may also contain any of the compounds that are known to be usable as components of conventional developing solutions.

In order to maintain the pH within the above-described range, various kinds of buffers are preferably employed. That is, carbonate, phosphate, borate, tetraborate, hydroxybenzoate, a salt of N,N-dimethylglycine, a salt of glycine, a salt of leucine, a salt of norleucine, a salt of guanine, a salt of 3,4-dihydroxyphenylalanine, a salt of alanine, aminolactate, a salt of 2-amino-2-methyl-1,3-propanediol, a salt of valine, a salt of proline, a salt of trihydroxyaminomethane or a salt of lysine can be used as buffers. Particularly, carbonate, phosphate, tetraborate, and hydroxybenzoate can be preferably used as buffers since they have an excellent buffering ability in a range of high pH such as a pH of 9.0 or more and an excellent solubility, they do not have a harmful influence (e.g., a fog) in the photographic characteristics even if they are added to the developing solution, and they are inexpensive. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention should not be construed as being limited to these compounds.

The amount of the buffer to be added to the color developing solution is preferably 0.1 mol or more and more preferably from 0.1 mol to 0.4 mol per liter of the developing solution.

In addition, various chelating agents can be used in the color developing solution according to the present invention for the purpose of preventing calcium or magnesium precipitation or increasing the stability of the color developing solution.

As the chelating agents, organic acid compounds are preferred and include aminopolycarboxylic acids, organic phosphoric acids and phosphonocarboxylic acids.

Specific examples of useful chelating agents are set forth below, but the present invention should not be construed as being limited thereto.

Nitrilotriacetic acid
Diethylenetriaminepentaacetic acid
Ethylenediaminetetraacetic acid
N,N,N-Trimethylenephosphonic acid
Ethylenediamine-N,N,N',N'-tetramethylenephosphonic acid
Trans-cyclohexanediaminetetraacetic acid
1,2-Diaminopropanetetraacetic acid
Glycol ether diaminetetraacetic acid
Ethylenediamine-o-hydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid Two or more kinds of such chelating agents may be employed together, if desired.

The chelating agent is added to the color developing solution in an amount sufficient to block metal ions being present therein. For example, a range of from about 0.1 g to about 10 g per liter of the color developing solution may be employed.

The color developing solution may contain appropriate development accelerators, if desired. Benzyl alcohol is used as typical examples of the development accelerators. However, it is preferred that the color developing solution used in the present invention does not substantially contain benzyl alcohol in view of prevention of environmental pollution, the easy preparation of the solution and prevention of color stain. The term "substantially not contain" means that the color developing solution contains benzyl alcohol in an amount of 2 ml or less per liter of the solution, and preferably does not contain benzyl alcohol at all.

Examples of suitable development accelerators include thioether type compounds as described in JP-B-37-16088, JP-B-37-5987, JP-B-38-7826, JP-B-44-12380, JP-B-45-9019 and U.S. Pat. No. 3,813,247; p-phenylenediamine type compounds as described in JP-A-52-49829 and JP-A-50-15554; quaternary ammonium salts as described in JP-A-50-137726, JP-B-44-30074, JP-A-56-156826 and JP-A-52-43429; amine type compounds as described in U.S. Pat. Nos. 2,494,903, 3,128,182, 4,230,796, 3,253,919, 2,482,546, 2,596,926 and 3,582,346 and JP-B-41-11431; polyalkylene oxides as described in JP-B-37-16088, JP-B-42-25201, JP-B-41-11431, JP-B-42-23883 and U.S. Pat. Nos. 3,128,183 and 3,532,501; 1-phenyl-3-pyrazolidones; and imidazoles.

The color developing solution used in the present invention may contain appropriate antifoggants, if desired. Alkali metal halides such as sodium chloride, potassium bromide, and potassium iodide as well as organic antifoggants may be employed as antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine, etc.

It is preferred that the color developing solution used in the present invention contains a fluorescent brightening agent. As fluorescent brightening agents, 4,4'-diamino-2,2'-disulfostilbene type compounds are preferred. The amount of the fluorescent brightening agent added is from 0 to 5 g and preferably from 0.1 g to 4 g, per liter of the color developing solution.

Furthermore, the color developing solution according to the present invention may contain various surface active agents such as alkylsulfonic acids, arylphosphonic acids, aliphatic carboxylic acids, and aromatic carboxylic acids, etc., if desired.

The processing temperature of the color developing solution used in the present invention is usually from 36° C. to 50° C. and preferably from 36° C. to 45° C. The processing time is usually from 20 seconds to 5 minutes and preferably from 30 seconds to 2 minutes. Further, the amount of replenishment for the color developing solution is preferably as small as feasible, and is usually from 200 ml to 600 ml, preferably from 50 ml to 300 ml, and more preferably from 60 ml to 200 ml and most preferably from 60 ml to 150 ml, per square meter of the color light-sensitive material.

The desilvering processes which can be used in the practice of the present invention are now described. In general, it is possible to use various processes such as bleaching - fixing, fixing - bleach-fixing, bleaching - bleach-fixing or bleach-fixing for the desilvering process.

Bleaching solutions, bleach-fixing solutions and fixing solutions which can be used are now described.

It is possible to use various bleaching agents as the bleaching agents used in the bleaching solutions and the bleach-fixing solutions used in the practice of the present invention, in particular, iron (III) organic complex salts (for example, complex with aminopolycarboxylic acids such as ethylenediaminetetraacetic acid and diethylenetriaminepentaacetic acid, aminopolyphosphonic acids, phosphonocarboxylic acids and organic phosphonic acids) or organic acids such as citric acid, tartaric acid and malic acid; persulfates; hydrogen peroxide and the like are preferred.

Of these, iron (III) organic complex salts are particularly preferred from the point of view of rapid processing and the prevention of environmental pollution. Examples of some aminopolycarboxylic acids, aminopolyphosphonic acids or organic phosphonic acids or salts thereof which are useful in forming iron (III) organic complex salts include, for example, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycol ether diaminetetraacetic acid. These compounds may be sodium, potassium, lithium or ammonium salts. Of these compounds, iron (III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred on account of their high bleaching power. These ferric ion complex salts may be used in the form of complex salts or they may be used in the form of ferric ion complex salts in solution using ferric salts such as ferric sulfate, ferric chloride, ferric nitrate, ferric ammonium sulfate, ferric phosphate and the like with chelating agents such as aminopolycarboxylic acids, aminopolyphosphonic acids, phosphonocarboxylic acids and the like. Furthermore, the chelating agents may be used in excess of the amount for forming the ferric ion complex salts. Of the iron complexes, aminopolycarboxylic acid iron complex are preferred, the amount added is generally 0.01 to 1.0 mol/liter, and preferably 0.05 to 0.50 mol/liter.

Various compounds can be used as bleaching accelerators in the bleaching solution, bleach-fixing solution and/or baths prior thereto. For example, the compounds having mercapto groups or disulfide bonds described in U.S. Pat. No. 3,893,858, West German Patent 1,290,812, JP-A-53-95630 and *Research Disclosure*, 17129 (July, 1978), and halides such as iodide or bromide ions or the thiourea-based compounds described in, for example, JP-B-45-8506, JP-A-52-20832, JP-A-53-32735 and U.S. Pat. No. 3,706,561.

The bleaching solutions or bleach-fixing solutions used in the present invention can contain rehalogenating agents such as bromides (for example, potassium bromide, sodium bromide, ammonium bromide), chlorides (for example, potassium chloride, sodium chloride, ammonium chloride) or iodides (for example, ammonium iodide). If desired, it is possible to add, for example, anticorrosion agents such as one or more types of an inorganic acid, an organic acid or alkali metal or ammonium salt thereof which have pH buffering ability such as sodium tetraborate, sodium metaborate, acetic acid, sodium acetate, sodium carbonate, potassium carbonate, phosphorous acid, phosphoric acid, sodium phosphate, citric acid, sodium citrate and tartaric acid; ammonium nitrate or guanidine.

The fixing agents which can be used in the bleach-fixing solutions and fixing solutions are known fixing agents, which is to say, water-soluble silver halide solvents such as thiosulfates such as sodium thiosulfate or ammonium thiosulfate; thiocyanates such as sodium thiocyanate or ammonium thiocyanate; and thioureas and thioether compounds such as 3,6-dithia-1,8-octanediol or ethylenebisthioglycolate, and one or two or more types of these may be used as mixtures. Furthermore, it is also possible to use, for example, special bleach-fixing solutions comprising a combination of a fixing agent and a large amount of halogenides such as potassium iodide or the like as described in JP-A-55-155354. The use of thiosulfates, and of ammonium thiosulfate, in particular, is preferred. The amount of fixing agent which can be used in 1 liter of the bleach-fixing solution or fixing solution is preferably 0.3 to 2 mols and more preferably 0.5 to 1.0 mol. The pH region of the bleach-fixing solution or fixing solution is preferably 3 to 10 and more preferably 5 to 9.

Furthermore, the bleach-fixing solution can contain various organic solvents such as brightening agents, defoaming agents or surfactants (surface active agents), polyvinyl pyrrolidone or methanol.

The bleach-fixing solutions and fixing solutions can contain sulfite ion releasing compounds such as sulfites (for example, sodium sulfite, potassium sulfite and ammonium sulfite), bisulfites (for example, ammonium bisulfite, sodium bisulfite and potassium bisulfite) and metabisulfites (for example, potassium metabisulfite, sodium metabisulfite and ammonium metabisulfite) as preservatives. These compounds are preferably contained at about 0.02 to 0.05 mol/liter calculated as sulfite ions and more preferably 0.04 to 0.40 mol/liter.

In addition to these, sulfites as preservatives, ascorbic acid, carbonyl bisulfite adducts or carbonyl compounds and the like may also be added.

Furthermore, buffers, brightening agents, chelating agents, defoaming agents, antifungal agents and the like may be added, if desired.

The silver halide color photographic materials used in the present invention generally undergo a washing and/or stabilizing treatment after the desilvering treatment such as fixing or bleach-fixing.

The amount of water used in the water washing process can be fixed within a wide range according to the nature of the photosensitive material (for example, the materials, such as couplers, which are being used), and its intended application, the washing water temperature, the number of washing tanks (the number of washing stages), the replenishment system (i.e., whether a countercurrent or a cocurrent system is used), and various other conditions. The relationship between the amount of water used and the number of water washing tanks in a multistage countercurrent system can be obtained using the method outlined on pages 248 to 253 of *Journal of the Society of Motion Picture and Television Engineers,* Vol. 64 (May, 1955). The number of stages in a normal multistage countercurrent system is preferably from 2 to 6 and more preferably from 2 to 4.

The amount of washing water can be greatly reduced by using a multistage countercurrent system and, for example, it is possible to use the amount of from 0.5 to 1 liter per square meter of photosensitive material and the effect of the present invention is pronounced. However, bacteria proliferate due to the increased residence time of the water in the tanks and problems arise as a result of the suspended matter which are formed becoming attached to the photosensitive material. The method in which the calcium and manganese concentrations are reduced as disclosed in JP-A-62-288838 can be used very effectively to overcome problems of this sort in the processing of color photosensitive materials of the present invention. Furthermore, the isothiazolone compounds and thiabendazoles disclosed in JP-A-57-8542, chlorine-based disinfectants such as chlorinated sodium isocyanurate disclosed in JP-A-61-120145, the benzotriazoles disclosed in JP-A-61-267761, copper ions, and the disinfectants disclosed in *Chemistry of Biocides and Fungicides* by Horiguchi, *Killing Microorganisms, Biocidal and Fungicidal Techniques,* published by the Health and Hygiene Technical Society, and in *A Dictionary of Biocides and Fungicides,* published by the Japanese Biocide and Fungicide Society, can be used for this purpose.

Moreover, surfactants as wetting agents, and chelating agents typified by EDTA as water softening agents can be used in the water washing water.

The photosensitive materials can also be treated with a stabilizing solution after the water washing process as described above, or directly without the use of a water washing process. Compounds which have an image stabilizing function can be added to the stabilizing solution, and examples of such compounds include aldehydes typified by formalin, buffers for adjusting to a film pH which is suitable for dye stabilization, and ammonia compounds. Furthermore, the various types of biocides and fungicides aforementioned can be used to prevent the proliferation of bacteria in the bath and to provide the processed photosensitive material with fungicidal properties. Moreover, surfactants, brightening agents and film hardening agents can also be added.

Any of the known methods disclosed, for example, in JP-A-57-8543, JP-A-58-14834 and JP-A-60-220345 can be used in cases where, when processing photosensitive materials of the present invention, the materials are stabilized directly without a water washing process.

The use of chelating agents, such as 1-hydroxyethylidene-1,1-diphosphonic acid and ethylenediaminetetramethylenephosphonic acid, and magnesium or bismuth compounds, is also desirable.

Rinsing solutions can also be used in the same way as the water washing solutions or stabilizing solutions which are used after desilvering in the present invention.

The pH in the water washing or stabilization process in the present invention is generally between 4 and 10 and preferably between 5 and 8. The temperature can be set variously, depending on the application and characteristics of the photosensitive material, but it is generally from 15° C. to 45° C. and preferably from 20° C. to 40° C. The time can be set without particular limitation, and a short time is preferred. Thus, a washing/stabilization time of from 15 seconds to 1 minute and 45 seconds is preferred, and a time of from 30 seconds to 1 minute and 30 seconds is especially desirable. A low amount of the replenisher is preferred from the point of view of running costs, effluent disposal and handling.

Actual preferred amount of replenisher is generally from 0.5 to 50 times and preferably from 3 to 40 times the carry over from the previous bath per unit area of photosensitive material. Alternatively, the amount of replenisher is generally not more than 1 liter and preferably not more than 500 ml per square meter of photosensitive material. Furthermore, replenishment can be carried out continuously or intermittently.

The liquid used in the water washing and/or stabilization processes can also be used in the earlier steps. For example, the overflow of water washing water recovered using a multistage countercurrent system can be introduced into the preceding bleach-fixing bath and a concentrated solution can be used to replenish the bleach-fixing bath with a reduction in the amount of effluent.

The total time taken in the desilvering step, the washing and the stabilizing step generally is 2 minutes or less and preferably 30 seconds to 1 minute 30 seconds. The total time as referred to herein denotes the time taken from when the silver halide color photographic material comes into contact with the first bath of the desilvering step until it leaves the final bath of the washing or stabilizing step and includes time spent in the air owing to transferal in between. Saying that "the sum of the desilvering process, washing process and stabilizing process, processing times is 2 minutes or less" means that the sum of the times of the desilvering process and the process which is carried out until the drying step (more specifically, washing and/or stabilization) is 2 minutes or less, for example, the sum of the processings (1) desilvering→washing
(2) desilvering→stabilization
(3) desilvering→washing→stabilization is 2 minutes or less.

Specific embodiments of this invention are given below, but the present invention is not limited to these.

EXAMPLE 1

Multilayer Color Printing Paper (A) having the layer structure shown below was prepared on a paper support which had been laminated on both sides with polyethylene. The coating solutions were prepared in the following way.

Preparation of the first coating solution for the first layer proceeded as follows. 27.2 ml of ethyl acetate and 4.1 g respectively of the solvents (Solv-3) and (Solv-6) were dissolved by adding to 19.1 g of the yellow coupler (ExY), 4.4 g of the color image stabilizer (Cpd-1) and 1.8 g of (Cpd-7) and the obtained solution was emulsified and dispersed in 185 ml of a 10 wt % aqueous gelatin solution containing 8 ml of 10 wt % sodium dodecylbenzenesulfonate. While, an emulsion in which the blue-sensitizing dye shown below had been added at $5.0\times10^{-4}$ mol per 1 mol of silver to a sulfur sensitized silver chlorobromide emulsion (a mixture in a ratio of $\frac{1}{3}$ (Ag molar ratio) of 80.0 mol % of silver bromide, cubic, average grain size 0.85 μm, variation coefficient 0.08 and 80.0 mol % of silver bromide, cubic, average grain size 0.62 μm, variation coefficient 0.07) was prepared. The above-mentioned emulsified dispersion and this emulsion were mixed and dissolved and the first coating solution for the first layer was prepared with the composition shown below.

The coating solutions for the second layer to the seventh layer were prepared by the same general method as that for the first coating solution, with the appropriate components and amounts for these layers as described below.

1-Oxy-3,5-dichloro-s-triazine, sodium salt was used as a gelatin hardener for each layer.

The following were used as spectral sensitizing dyes in the indicated layers.

Blue-Sensitive Emulsion Layer

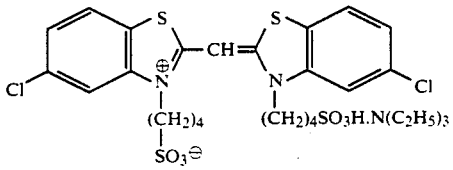

($5.0\times10^{-4}$ mol per mol of silver halide)

Green-Sensitive Emulsion Layer

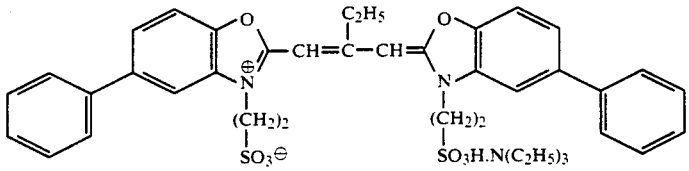

($4.0\times10^{-4}$ mol per mol of silver halide)

and

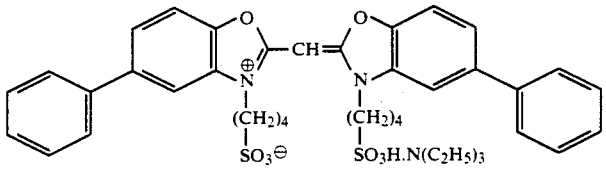

($7.0\times10^{-5}$ mol per mol of silver halide)

Red-Sensitive Emulsion Layer

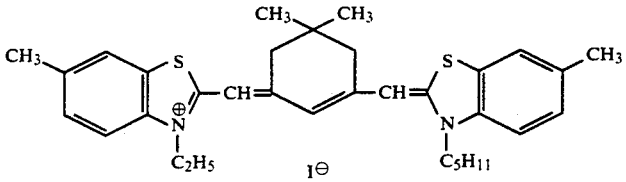

($0.9\times10^{-4}$ mol per mol of silver halide)

The following compound (i.e., a sensitizing dye) was added to the red-sensitive emulsion layer at $2.6\times10^{-3}$ mol per mol of silver halide.

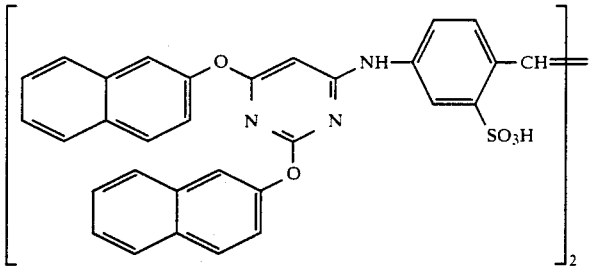

Furthermore, there were added to the blue-sensitive emulsion layer, green-sensitive emulsion layer and red-sensitive emulsion layer, 1-(5-methylureidophenyl)-5-mercaptotetrazole in amounts of $4.0\times10^{-6}$, $3.0\times10^{-5}$ and $1.0\times10^{-5}$ mol per mol of silver halide, respectively, and 2-methyl-5-t-octylhydroquinone in amounts of $8\times10^{-3}$, $2\times10^{-2}$ and $2\times10^{-2}$ mol per mol of silver halide, respectively.

Furthermore, there was added to the blue-sensitive emulsion layer and green-sensitive emulsion layer, 4-hydroxy-6-methyl-1,3,3a,7-tetraazaindene in amounts of $1.2\times10^{-2}$ and $1.1\times10^{-2}$ mol per mol of silver halide, respectively.

The following dyes were added to the emulsion layers to prevent irradiation.

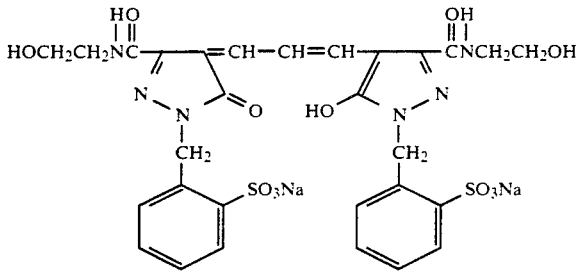

and

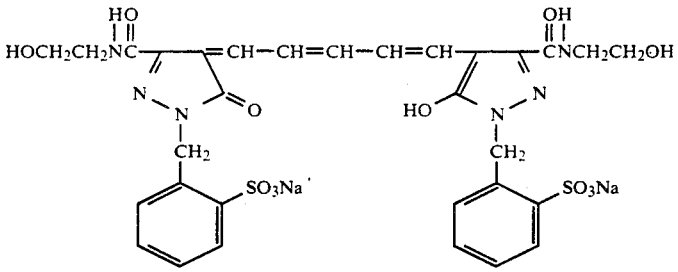

Layer Structure

The compositions of the various layers are shown below. The figures denote the coated amount ($g/c^2$). For the silver halide emulsions, they denote coated amounts calculated as silver.

Support

Polyethylene-laminated paper (containing a white pigment ($TiO_2$) and bluish dye (ultramarine) in the polyethylene on the side of the first layer)

| First Layer: Blue-Sensitizing Layer | |
|---|---|
| Silver chlorobromide emulsion described above (AgBr content: 80 mol %) | 0.26 |
| Gelatin | 1.83 |
| Yellow coupler (ExY) | 0.83 |
| Color image stabilizer (Cpd-1) | 0.19 |
| Color image stabilizer (Cpd-7) | 0.08 |
| Solvent (Solv-3) | 0.18 |
| Solvent (Solv-6) | 0.18 |
| Second Layer: Anti-Color-Mixing Layer | |
| Gelatin | 0.99 |
| Anti-color-mixing agent (Cpd-6) | 0.08 |
| Solvent (Solv-1) | 0.16 |
| Solvent (Solv-4) | 0.08 |
| Third Layer: Green-Sensitive Layer | |
| Silver chlorobromide emulsion (a 1/1 (Ag molar ratio) mixture of 90 mol % AgBr, cubic, average grain size: 0.47 μm, variation coefficient: 0.12 and 90 mol % AgBr, cubic, average grain size: 0.36 μm, variation coefficient: 0.09) | 0.16 |
| Gelatin | 1.79 |
| Magenta coupler (ExM) | 0.32 |
| Color image stabilizer (Cpd-3) | 0.20 |
| Color image stabilizer (Cpd-8) | 0.16 |
| Color image stabilizer (Cpd-4) | 0.01 |
| Solvent (Solv-2) | 0.65 |
| Compound of the present invention | See Table 1 |
| Fourth Layer: Ultraviolet Absorbing Layer | |
| Gelatin | 1.58 |
| Ultraviolet absorber (UV-1) | 0.47 |
| Anti-color-mixing agent (Cpd-5) | 0.05 |
| Solvent (Solv-5) | 0.24 |

-continued

| | |
|---|---|
| Fifth Layer: Red-Sensitive Layer | |
| Silver chlorobromide emulsion (a 1/2 (Ag molar ratio) mixture of 70 mol % AgBr, cubic, average grain size: 0.49 μm, variation coefficient: 0.08 and 70 mol % AgBr, cubic, average grain size: 0.34 μm, variation coefficient: 0.10) | 0.23 |
| Gelatin | 1.34 |
| Cyan coupler (ExC) | 0.30 |
| Color image stabilizer (Cpd-6) | 0.17 |
| Color image stabilizer (Cpd-7) | 0.40 |
| Solvent (Solv-6) | 0.20 |
| Sixth Layer: Ultraviolet Absorbing Layer | |
| Gelatin | 0.53 |
| Ultraviolet absorber (UV-1) | 0.16 |
| Anti-color-mixing agent (Cpd-5) | 0.02 |
| Solvent (Solv-5) | 0.08 |
| Seventh Layer: Protective Layer | |
| Gelatin | 1.33 |
| Acrylic modified copolymer of polyvinyl alcohol (modification: 17%) | 0.17 |
| Liquid paraffin | 0.00 |

(Cpd-1) Color Image Stabilizer

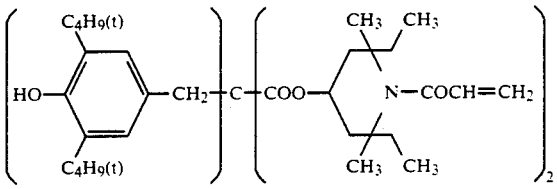

(Cpd-3) Color Image Stabilizer

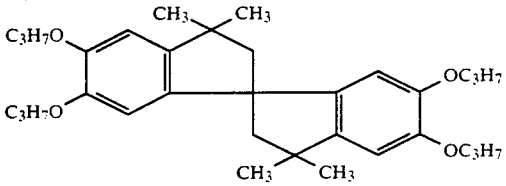

(Cpd-4) Color Image Stabilizer

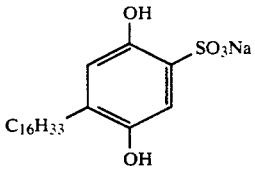

(Cpd-5) Anti-Color-Mixing Agent

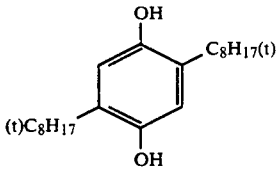

(Cpd-6) Color Image Stabilizer
a 2/4/4 mixture (by weight) of

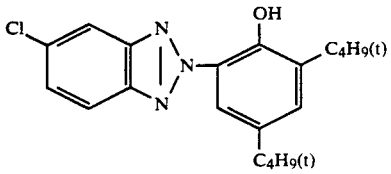

-continued

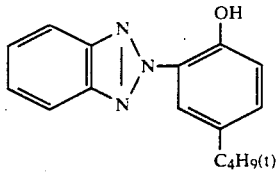

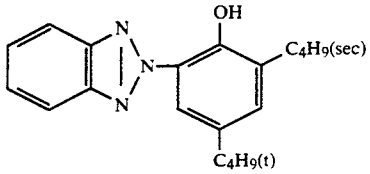

(Cpd-7) Color Image Stabilizer $$\left(CH_2-\underset{\displaystyle CONHC_4H_9(t)}{\underset{|}{CH}}\right)_n$$

average molecular weight: 80,000

(Cpd-8) Color Image Stabilizer

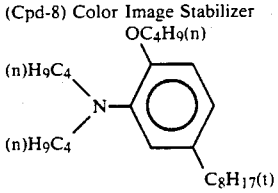

(UV-1) Ultraviolet Absorber
a 4/2/4 mixture (by weight) of

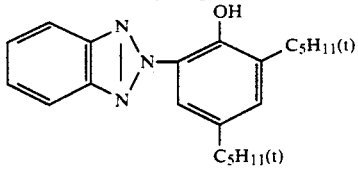

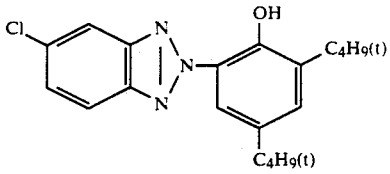

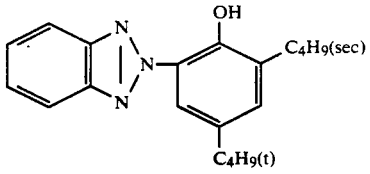

(Solv-1) Solvent

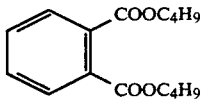

(Solv-2) Solvent
a 2/1 mixture (by volume) of $$O{=}P\left(O\underset{\displaystyle C_4H_9}{\underset{|}{CH}}CH_2C_2H_5\right)_3 \quad \text{and} \quad O{=}P\left(O-C_6H_4-CH_3\right)_3$$

(Solv-3) Solvent $$O{=}P\left(O-C_9H_{19}(iso)\right)_3$$

-continued (Solv-4) Solvent

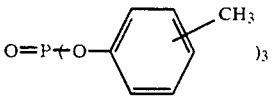

(Solv-5) Solvent

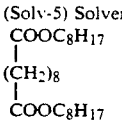

(Solv-6) Solvent

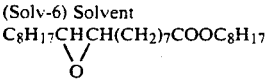

(ExY) Yellow Coupler

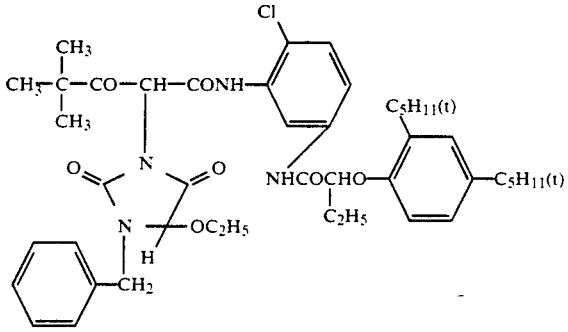

(ExM) Magenta Coupler: Comparative Compound A-1

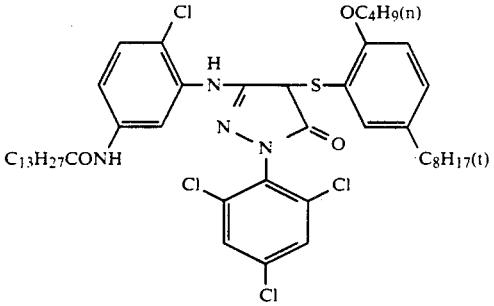

(ExC) Cyan Coupler
a 1/1 mixture (molar ratio) of

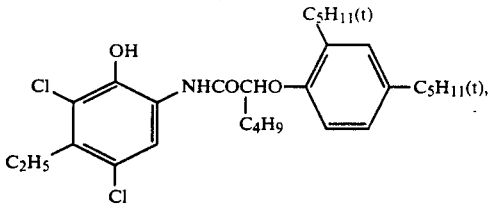

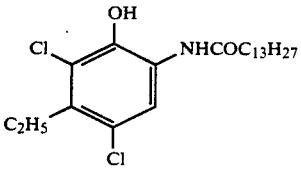

Photosensitive Materials (B) to (Q) were prepared by the same manner as the above Photosensitive Material A except that the magenta coupler and the compound of the present invention of the Photosensitive Material A were changed for the magenta couplers and compounds of the present invention shown in Table 1.

After subjecting the above Photosensitive Material (A) to image exposure, continuous processing (running test) was carried out using the Fuji color paper processing machine "FPRP115" until twice the color development tank capacity had been replenished in the following processing steps.

| Processing Step | Temperature (°C.) | Time | Replenishment Amount* (ml) | Tank Capacity (liter) |
|---|---|---|---|---|
| Color Development | See Table 1 | 3 min 30 sec | 200 | 60 |
| Bleach-Fixing | 33 | 1 min 30 sec | 55 | 10 |
| Washing (1) | 24-34 | 1 min | — | 20 |
| Washing (2) | 24-34 | 1 min | — | 20 |
| Washing (3) | 24-34 | 1 min | 10 | 20 |
| Drying | 70-80 | 1 min | | |

*Per 1 $m^2$ of photosensitive material
(A three tank cascade of washing from (3) to (1) was adopted.)

The compositions of the various processing solutions were as shown below.

| | Tank Solution | Replenisher |
|---|---|---|
| Color Developing Solution: | | |
| Water | 800 ml | 800 ml |
| Diethylenetriaminepentaacetic Acid | 1.0 g | 1.0 g |
| Nitrilotriacetic Acid | 2.0 g | 2.0 g |
| Benzyl Alcohol | 15 ml | 23 ml |
| Diethylene Glycol | 10 ml | 10 ml |
| Sodium Sulfite | 2.0 g | 3.0 g |
| Potassium Bromide | 1.2 g | — |
| Potassium Carbonate | 30 g | 25 g |
| N-Ethyl-N-(β-methanesulfonamidoethyl)-3-methyl-4-aminoaniline Sulfate | 5.0 g | 9.0 g |
| Hydroxylamine Sulfate | 3.0 g | 4.5 g |
| Brightening Agent ("WHITEX 4B", made by Sumitomo Chemicals) | 1.0 g | 2.0 g |
| Water to make | 1,000 ml | 1,000 ml |
| pH (25° C.) | See Table 1 | |
| Bleach-Fixing Solution: | | |
| Water | 400 ml | 400 ml |
| Ammonium Thiosulfate (700 g/liter) | 150 ml | 300 ml |
| Sodium Sulfite | 13 g | 26 g |
| Ethylenediaminetetraacetic Acid Iron (III) Ammonium Salt | 55 g | 110 g |
| Ethylenediaminetetraacetic Acid Disodium Salt | 5 g | 10 g |
| Water to make | 1,000 ml | 1,000 ml |
| pH (25° C.) | 6.70 | 6.30 |

Similar processings were carried out for Photographic Materials (B) to (Q) each in its turn and the photographic properties were evaluated. The photographic properties were evaluated using the two criteria of the minimum density (Dmin) and the maximum density (Dmax).

The results are shown in Table 1.

TABLE 1

| Sample No | Photo-Sensitive Material | Magenta Coupler | Compound* of the Present Invention | Processing Temperature (°C.) | Processing pH | Photographic Properties: Fresh Solution Dmin | Fresh Solution Dmax | Running Solution Dmin | Running Solution Dmax | Comment |
|---|---|---|---|---|---|---|---|---|---|---|
| 1 | (A) | A-1 | — | 38 | 10.30 | 0.11 | 2.41 | 0.21 | 2.01 | Comparison |
| 2 | (B) | A-1 | II-1 | " | " | 0.11 | 2.40 | 0.14 | 1.98 | " |
| 3 | (C) | M-3 | — | " | " | 0.21 | 2.84 | 0.32 | 2.79 | " |
| 4 | (D) | " | II-1 | " | " | 0.11 | 2.83 | 0.12 | 2.82 | Invention |
| 5 | (E) | " | II-9 | " | " | 0.12 | 2.82 | 0.12 | 2.81 | " |
| 6 | (F) | " | II-19 | " | " | 0.11 | 2.84 | 0.12 | 2.83 | " |
| 7 | (G) | " | II-23 | " | " | 0.11 | 2.83 | 0.12 | 2.82 | " |
| 8 | (H) | " | III-1 | " | " | 0.12 | 2.83 | 0.13 | 2.82 | " |
| 9 | (I) | " | III-7 | " | " | 0.12 | 2.83 | 0.12 | 2.81 | " |
| 10 | (J) | " | IV-1 | " | " | 0.11 | 2.83 | 0.12 | 2.83 | " |
| 11 | (K) | " | IV-3 | " | " | 0.11 | 2.82 | 0.12 | 2.82 | " |
| 12 | (L) | " | V-1 | " | " | 0.11 | 2.84 | 0.11 | 2.83 | " |
| 13 | (M) | " | V-7 | " | " | 0.11 | 2.84 | 0.12 | 2.81 | " |
| 14 | (C) | " | — | 36 | 11.0 | 0.24 | 2.82 | 0.31 | 2.81 | Comparison |
| 15 | (C) | " | — | " | 10.5 | 0.16 | 2.79 | 0.29 | 2.80 | " |
| 16 | (C) | M-3 | — | 36 | 11.5 | 0.26 | 2.83 | 0.30 | 2.82 | Comparison |
| 17 | (N) | " | III-30 | " | 11.0 | 0.12 | 2.81 | 0.13 | 2.79 | Invention |
| 18 | (H) | " | III-1 | " | 10.5 | 0.12 | 2.82 | 0.12 | 2.79 | " |
| 19 | (J) | " | IV-1 | " | 11.5 | 0.13 | 2.83 | 0.14 | 2.81 | " |
| 20 | (C) | " | — | 40 | 10.5 | 0.18 | 2.82 | 0.31 | 2.81 | Comparison |
| 21 | (C) | " | — | " | 11.0 | 0.28 | 2.83 | 0.33 | 2.82 | " |
| 22 | (C) | " | — | " | 11.5 | 0.30 | 2.82 | 0.36 | 2.82 | " |
| 23 | (O) | " | II-4 | " | 10.5 | 0.12 | 2.81 | 0.12 | 2.81 | Invention |
| 24 | (P) | " | III-6 | " | 11.0 | 0.12 | 2.81 | 0.14 | 2.82 | " |
| 25 | (Q) | " | V-3 | " | 11.5 | 0.14 | 2.81 | 0.16 | 2.79 | " |

*Compounds (II) to (V) were added at 5 mol % with respect to the coupler.

As is apparent from the results of Table 1, it will be seen that fog is inhibited and sufficient color densities are exhibited even during high temperature, high pH development processing running when the pyrazolone-based magenta couplers of the present invention and Compounds (II) to (V) of the present invention are used.

Furthermore, when (M-1), (M-5), (M-7), (M-10), (M-15), (M-27), (M-30), (M-42) and (M-51) are used in place of (M-3) as the magenta coupler, effects similar to those when (M-3) is used are obtained.

EXAMPLE 2

Multilayer Color Printing Paper (A2) with the layer structure shown below was prepared on a paper support laminated on both sides with polyethylene. Coating solutions were prepared as follows.

Preparation of the first coating solution for the first layer proceeded as follows.

27.2 ml of ethyl acetate and 8.2 g of a solvent (Solv-3) were dissolved by adding to 19.1 g of the yellow coupler (ExY), 4.4 g of the color image stabilizer (Cpd-1) and 0.7 g of the color image stabilizer (Cpd-7), and the obtained solution was emulsified and dispersed in 185 ml of a 10 wt % aqueous gelatin solution containing 8 ml of 10 wt % sodium dodecylbenzenesulfonate. While, an emulsion was prepared in which sulfur sensitization was effected after adding the two blue-sensitizing dyes shown below, each in an amount of $2.0\times10^{-4}$ mol per mol of silver, to a silver chlorobromide emulsion (containing silver bromide at 1 mol % as a proportion of the total grain, localized in 1 part of the grain surface and being cubic with a grain size of 0.85 μm and a variation coefficient of 0.07). The above emulsified dispersion and this emulsion were mixed and dissolved and the first layer coating solution was prepared with the composition shown below.

The coating solutions for the second layer to the seventh layer were prepared by the same manner as that for the first layer coating solution with the appropriate components and amounts for these layers as described below.

1-Oxy-3,5-dichloro-s-triazine sodium salt was used as a gelatin hardener in each layer.

The following were used as spectrally sensitizing dyes in the various layers.

Blue-Sensitive Emulsion Layer

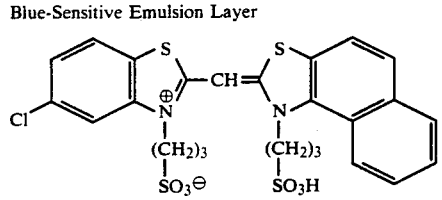

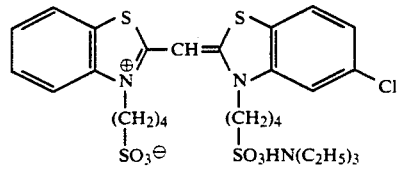

-continued (The above two each at $2.0 \times 10^{-4}$ mol per mol of silver halide)

Green-Sensitive Emulsion Layer

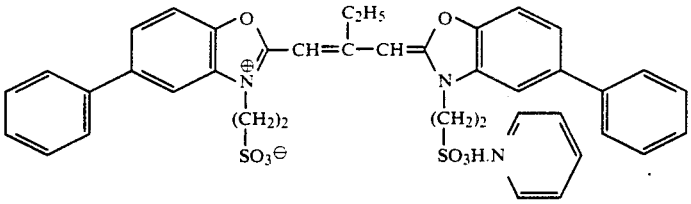

($4.0 \times 10^{-4}$ mol per mol of silver halide)

and

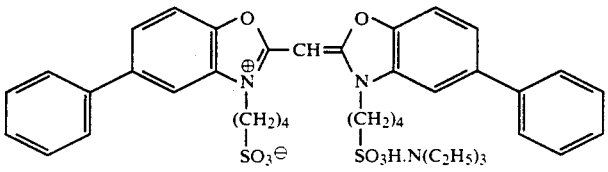

($7.0 \times 10^{-5}$ mol per mol of silver halide)

Red-Sensitive Emulsion Layer

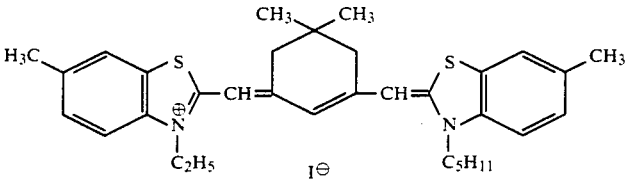

($0.9 \times 10^{-4}$ mol per mol of silver halide)

The following compound (i.e., a sensitizing dye) was added to the red-sensitive emulsion layer in an amount of $2.6 \times 10^{-3}$ mol per mol of silver halide.

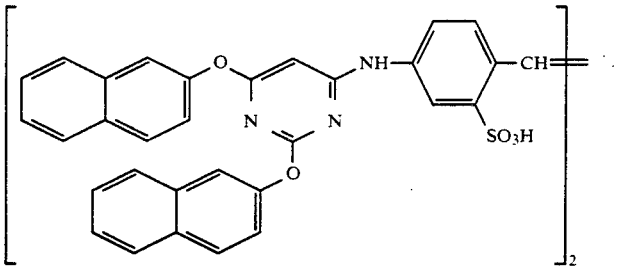

Furthermore, there was added to the blue-sensitive emulsion layer, green-sensitive emulsion layer and red-sensitive emulsion layer, 1-(5-methylureidophenyl)-5-mercaptotetrazole in respective amounts of $8.5 \times 10^{-5}$, $7.7 \times 10^{-4}$ and $2.5 \times 10^{-4}$ mol per mol of silver halide.

The following dyes were added to the emulsion layers in order to prevent irradiation.

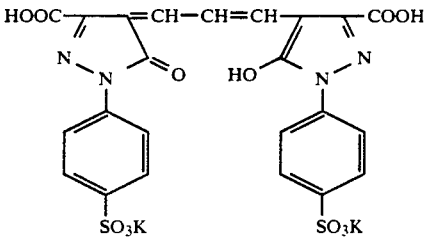

and

-continued

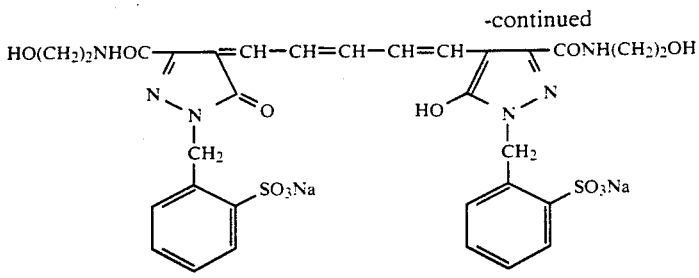

Layer Composition

The compositions of the various layers are shown below. The figures denote the coated amount (g/m$^2$). With the silver halide emulsion, they denote the coated amount calculated as silver.

Support

Polyethylene-laminated paper (containing a white pigment ($TiO_2$) and a bluish dye (ultramarine) in the polyethylene on the side of the first layer)

| | |
|---|---|
| First Layer: Blue-Sensitive Layer | |
| Silver chlorobromide emulsion described above | 0.30 |
| Gelatin | 1.86 |
| Yellow coupler (ExY) | 0.82 |
| Color image stabilizer (Cpd-1) | 0.19 |
| Color image stabilizer (Cpd-7) | 0.03 |
| Solvent (Solv-3) | 0.35 |
| Second Layer: Anti-Color-Mixing Layer | |
| Gelatin | 0.99 |
| Anti-color-mixing agent (Cpd-5) | 0.08 |
| Solvent (Solv-1) | 0.16 |
| Solvent (Solv-4) | 0.08 |
| Third Layer: Green-Sensitive Layer | |
| Silver chlorobromide emulsion (containing silver bromide localized on one part of the grain surface at 1 mol % as a proportion of the total grain and being cubic with a grain size of 0.40 μm and a variation coefficient of 0.09) | 0.20 |
| Gelatin | 1.24 |
| Magenta coupler (ExM) | 0.29 |
| Color image stabilizer (Cpd-3) | 0.09 |
| Color image stabilizer (Cpd-4) | 0.06 |
| Solvent (Solv-2) | 0.32 |
| Compound of the present invention | See Table 2 |
| Fourth Layer: Ultraviolet Absorbing Layer | |
| Gelatin | 1.58 |
| Ultraviolet absorber (UV-1) | 0.47 |
| Anti-color-mixing agent (Cpd-5) | 0.05 |
| Solvent (Solv-5) | 0.24 |
| Solvent (Solv-7) | 0.16 |
| Fifth Layer | |
| Silver chlorobromide emulsion (containing silver bromide localized on one part of the grain surface at 1.6 mol % as a proportion of the total grain and being cubic with a grain size of 0.36 μm and a variation coefficient of 0.11) | 0.21 |
| Gelatin | 1.34 |
| Cyan coupler (ExC) | 0.34 |
| Color image stabilizer (Cpd-6) | 0.17 |
| Color image stabilizer (Cpd-7) | 0.34 |
| Color image stabilizer (Cpd-9) | 0.04 |
| Solvent (Solv-6) | 0.37 |
| Sixth Layer: Ultraviolet Absorbing Layer | |
| Gelatin | 0.53 |
| Ultraviolet absorber (UV-1) | 0.16 |
| Anti-color-mixing agent (Cpd-5) | 0.02 |
| Solvent (Solv-5) | 0.08 |
| Seventh Layer: Protective Layer | |

-continued

| | |
|---|---|
| Gelatin | 1.33 |
| Acrylic modified copolymer of polyvinyl alcohol (degree of modification: 17%) | 0.17 |
| Liquid paraffin | 0.03 |

(ExY) Yellow Coupler
The same as (ExY) in Example 1

(ExM) Magenta Coupler: Comparative Compound A-1
The same as (ExM) in Example 1

(ExC) Cyan Coupler
A 1/3/6 mixture (by weight) of

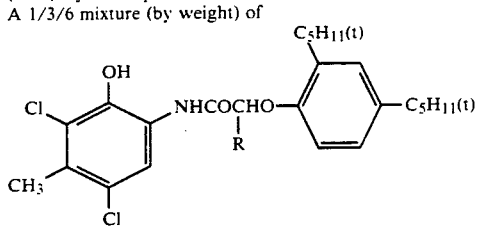

wherein R is H, $C_2H_5$ and $C_4H_9$ (Cpd-1) Color Image Stabilizer
The same as (Cpd-1) in Example 1

(Cpd-3) Color Image Stabilizer
The same as (Cpd-3) in Example 1

(Cpd-4) Color Image Stabilizer

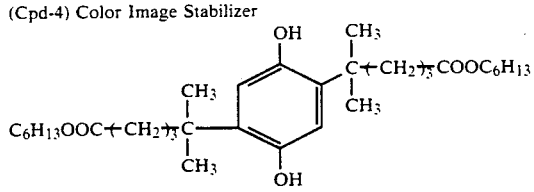

(Cpd-5) Anti-Color-Mixing Agent
The same as (Cpd-5) in Example 1

(Cpd-6) Color Image Stabilizer
The same as (Cpd-6) in Example 1

(Cpd-7) Color Image Stabilizer
The compound (Cpd-7) in Example 1 in which the average molecular weight is 60,000

(Cpd-9) Color Image Stabilizer

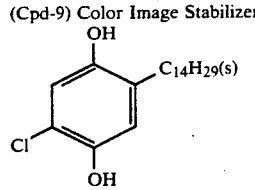

(UV-1) Ultraviolet Absorber
The same as (UV-1) in Example 1

(Solv-1) Solvent
The same as (Solv-1) in Example 1

(Solv-2) Solvent
A 3/7 mixture of (Solv-2) in Example 1

-continued (Solv-3) Solvent
The same as (Solv-3) in Example 1

(Solv-4) Solvent
The same as (Solv-4) in Example 1

(Solv-5) Solvent
The same as (Solv-5) in Example 1

(Solv-6) Solvent

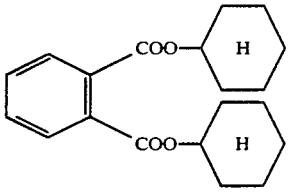

(Solv-7) Solvent

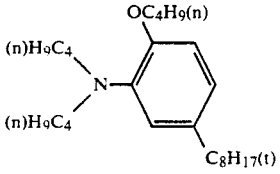

Furthermore, photosensitive materials (B2) to (AC) were prepared by the same manner as the above Photosensitive Material (A2), except that the magenta coupler and the compounds of the present invention of Photosensitive Material (A2) were altered as shown in Table 2.

The above Photosensitive Materials (A2) to (AC) were exposed via an optical wedge and then processed in the following steps.

| Processing Step | Temperature (°C.) | Time (sec) |
|---|---|---|
| Color Development | See Table 2 | 45 |
| Bleach-Fixing | 30-36 | 45 |
| Stabilization (1) | 30-37 | 20 |
| Stabilization (2) | 30-37 | 20 |
| Stabilization (3) | 30-37 | 20 |

-continued

| Processing Step | Temperature (°C.) | Time (sec) |
|---|---|---|
| Stabilization (4) | 30-37 | 30 |
| Drying | 70-85 | 60 |

(A four-tank counter flow system from Stabilization (4) to (1) was adopted.)

The compositions of the various processing solutions were as follows.

| | |
|---|---|
| Color Developing Solution (running solution): | |
| Water | 800 ml |
| Ethylenediaminetetraacetic Acid | 2.0 g |
| Triethanolamine | 8.0 g |
| Sodium Chloride | 5.0 g |
| Potassium Carbonate | 25 g |
| N-Ethyl-N-(β-methanesulfonamidoethyl)-3-methyl-4-aminoaniline Sulfate | 5.0 g |
| N,N-Diethylhydroxylamine | 4.2 g |
| 5,6-Dihyiroxvbenzene-1,2,4-trisulfonic Acid | 0.3 g |
| Brightening Agent (4,4'-diaminostilbene-based) | 2.0 g |
| Water to make | 1,000 ml |
| pH (25° C.) | See Table 2 |
| Bleach-Fixing Solution: | |
| Water | 400 ml |
| Ammonium Thiosulfate (700 g/liter) | 100 ml |
| Sodium Sulfite | 18 g |
| Ethylenediaminetetraacetic Acid Iron (III) Ammonium Salt | 55 g |
| Ethylenediaminetetraacetic Acid Disodium Salt | 3 g |
| Glacial Acetic Acid | 8 g |
| Water to make | 1,000 ml |
| pH (25° C.) | 5.5 |
| Stabilizing Solution: | |
| Formalin (37 wt %) | 0.1 g |
| Formalin-Sulfurous Acid Adduct | 0.7 g |
| 5-Chloro-2-methyl-4-isothiazolin-3-one | 0.02 g |
| 2-Methyl-4-isothiazolin-3-one | 0.01 g |
| Copper Sulfate | 0.005 g |
| Water to make | 1,000 ml |
| pH (25° C.) | 4.0 |

The photographic properties were evaluated by the two criteria of Dmin and Dmax.

The results are shown in Table 2.

TABLE 2

| Sample No. | Photo-Sensitive Material | Magenta Coupler | Compound* of the Present Invention | Processing Temperature (°C.) | Processing pH | Photo-graphic Properties Dmin | Dmax | Comment |
|---|---|---|---|---|---|---|---|---|
| 1 | (A2) | A-1 | II-19 | 36 | 10.5 | 0.13 | 2.01 | Comparison |
| 2 | (B2) | M-3 | — | " | " | 0.16 | 2.68 | " |
| 3 | (B2) | " | — | " | 11.0 | 0.21 | 2.78 | " |
| 4 | (B2) | " | — | " | 11.5 | 0.32 | 2.82 | " |
| 5 | (A2) | A-1 | II-19 | 38 | 10.5 | 0.16 | 2.21 | " |
| 6 | (B2) | M-3 | — | " | " | 0.18 | 2.71 | " |
| 7 | (B2) | " | — | " | 11.0 | 0.26 | 2.79 | " |
| 8 | (B2) | " | — | " | 11.5 | 0.34 | 2.82 | " |
| 9 | (A2) | A-1 | II-19 | 40 | 10.5 | 0.20 | 2.42 | " |
| 10 | (B2) | M-3 | — | " | " | 0.21 | 2.78 | " |
| 11 | (B2) | " | — | " | 11.0 | 0.28 | 2.81 | " |
| 12 | (B2) | " | — | " | 11.5 | 0.36 | 2.83 | " |
| 13 | (C2) | " | II-19 | 36 | 10.5 | 0.11 | 2.70 | Invention |
| 14 | (D2) | " | III-1 | " | 11.0 | 0.11 | 2.80 | " |
| 15 | (E2) | M-3 | V-1 | 36 | 11.5 | 0.12 | 2.84 | Invention |
| 16 | (F2) | " | II-23 | 38 | 10.5 | 0.11 | 2.73 | " |
| 17 | (G2) | " | III-30 | " | 11.0 | 0.12 | 2.81 | " |
| 18 | (H2) | " | V-2 | " | 11.5 | 0.12 | 2.82 | " |
| 19 | (I2) | " | II-1 | 40 | 10.5 | 0.12 | 2.81 | " |
| 20 | (C2) | " | II-19 | " | 11.0 | 0.12 | 2.80 | " |
| 21 | (F2) | " | II-23 | " | 11.5 | 0.13 | 2.81 | " |
| 22 | (J2) | " | III-3 | " | 11.0 | 0.12 | 2.79 | " |

TABLE 2-continued

| Sample No. | Photo-Sensitive Material | Magenta Coupler | Compound* of the Present Invention | Processing Temperature (°C.) | Processing pH | Photo-graphic Properties Dmin | Dmax | Comment |
|---|---|---|---|---|---|---|---|---|
| 23 | (K2) | " | III-17 | " | " | 0.13 | 2.80 | " |
| 24 | (L2) | " | III-20 | " | " | 0.12 | 2.83 | " |
| 25 | (M2) | " | III-27 | " | " | 0.12 | 2.71 | " |
| 26 | (N2) | " | IV-1 | " | " | 0.11 | 2.80 | " |
| 27 | (O2) | " | IV-3 | " | " | 0.12 | 2.71 | " |
| 28 | (P2) | " | V-4 | " | " | 0.13 | 2.81 | " |
| 29 | (Q2) | " | V-8 | " | " | 0.12 | 2.80 | " |
| 30 | (R2) | M-3 | V-15 | 40 | 11.0 | 0.12 | 2.81 | Invention |
| 31 | (B-2) | " | — | 45 | " | 0.32 | 2.86 | Comparison |
| 32 | (B-2) | " | — | 50 | " | 0.54 | 2.90 | " |
| 33 | (F-2) | " | II-23 | 45 | " | 0.14 | 2.84 | Invention |
| 34 | " | " | " | 50 | " | 0.15 | 2.87 | " |
| 35 | (S-2) | M-1 | II-1 | 40 | 10.8 | 0.12 | 2.79 | " |
| 36 | (T-2) | M-5 | II-19 | " | " | 0.13 | 2.81 | " |
| 37 | (U-2) | M-7 | II-23 | " | " | 0.13 | 2.77 | " |
| 38 | (V-2) | M-12 | III-17 | " | " | 0.12 | 2.76 | " |
| 39 | (W-2) | M-19 | III-27 | " | " | 0.13 | 2.81 | " |
| 40 | (X-2) | M-24 | IV-2 | " | " | 0.13 | 2.75 | " |
| 41 | (Y-2) | M-30 | IV-5 | " | " | 0.12 | 2.77 | " |
| 42 | (Z-2) | M-32 | IV-9 | " | " | 0.12 | 2.80 | " |
| 43 | (AA) | M-34 | V-5 | " | " | 0.13 | 2.81 | " |
| 44 | (AB) | M-40 | V-7 | " | " | 0.13 | 2.80 | " |
| 45 | (AC) | M-51 | V-22 | 40 | 10.8 | 0.13 | 2.74 | Invention |
| 46 | (D2) | M-3 | III-1 | 30 | 10.0 | 0.11 | 2.47 | Comparison |
| 47 | " | " | " | " | 12.3 | 0.88 | 2.70 | " |
| 48 | " | " | " | " | 11.0 | 0.12 | 2.59 | " |
| 49 | " | " | " | 38 | 10.0 | 0.12 | 2.60 | " |
| 50 | " | " | " | " | 12.3 | 0.91 | 2.81 | " |
| 51 | " | " | " | 60 | 11.0 | 0.88 | 2.86 | " |

*Compounds (II) to (V) were added at 5 mol % to the coupler.

(I)

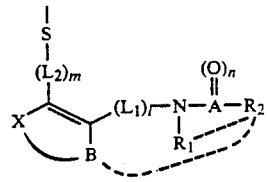

As is apparent from the results of Table 2, the fog and color density exhibit good photographic properties when using the pyrazolone-based magenta couplers of the present invention and Compounds (II) to (V) of the present invention.

By implementing the present invention, it is possible to process silver halide color photographic materials which are outstanding both in terms of fog and color density.

While the invention has been described in detail and with reference to specific embodiments thereof, it will be apparent to one skilled in the art, that various changes and modifications can be made therein without departing from the spirit and scope thereof.

What is claimed is:

1. A method for processing a silver halide color photographic material which has been imagewise exposed to light, wherein the silver halide color photographic material having a layer containing at least one pyrazolone-based magenta coupler having a coupling releasing group represented by formula (I) and at least one compound represented by formula (IIIa) is processed with a color developing solution having a developing solution temperature of 36° to 45° C. and a developing solution pH of 10.5 to 11.5, said developing solution being replenished with a replenisher in an amount of from 60 to 150 ml/m$^2$ of the silver halide photographic material;

wherein $L_1$ and $L_2$ represent a methylene group or an ethylene group; l and m represent 0 or 1; $R_1$ represents a hydrogen atom, an alkyl group, an aryl group or a heterocyclic group; $R_2$ represents an alkyl group, an aryl group, a heterocyclic group having a carbon atom bonded to A, an acyl group, an alkoxy carbonyl group, a carbamoyl group, an alkoxy group, an aryloxy group, an alkylamino group, an anilino group, an acylamino group, a ureido group, a sulfoamoylamino group, an alkoxycarbonylamino group, a sulfonamide, an alkylthio group or an arylthio group; A represents a carbon atom or a sulfur atom; when A is a carbon atom, n represents 1, and when A is a sulfur atom, n represents 1 or 2; B represents —CH=; X represents an atomic group necessary to form a ring; $R_1$ and $R_2$ may bond together to form a ring; and B and $R_2$ may bond together to form a ring;

(IIIa)

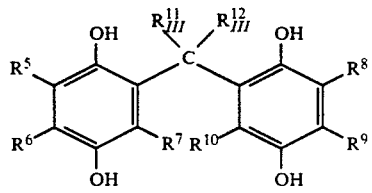

wherein $R^5$, $R^6$, $R^7$, $R^8$, $R^9$ and $R^{10}$ represent a hydrogen atom, a halogen atom, a sulfo group, a carboxyl group, a cyano group, an alkyl group, an aryl group, an acylamino group, a sulfonamide group, an alkoxy group, an aryloxy group, an alkythio group, an arylthio group, an acyl group, an acyloxy group, a sulfonyl group, a carbamoyl group, an alkoxycarbonyl group or a sulfamoyl group; $R^{11}_{III}$ represents a hydrogen atom, and $R^{12}_{III}$ represents an alkyl group having 1 to 30 carbon atoms.

2. The method as in claim 1, wherein $R_2$ is an alkyl group, an aryl group, an alkylamino group or an anilino group.

3. The method as claimed in claim 1, wherein said silver halide color photographic material contains a silver halide emulsion having a silver chloride content of 95 mol % or more.

4. The method as claimed in claim 1, wherein said compound represented by formula (IIIa) is used in an amount of from 0.1 to 200 mol % based on the magenta coupler represented by formula (I).

5. The method as claimed in claim 1, wherein said magenta coupler having a coupler releasing group represented by formula (I) is used in an amount of from $1\times10^{-3}$ to 1 mol per mol of silver halide.

6. The method as claimed in claim 1, wherein said magenta coupler represented by formula (I) and said compound represented by formula (IIIa) are added to a green-sensitive silver halide emulsion.

7. The method as in claim 1, wherein X represents an atomic group constructed of atoms selected from carbon atoms, oxygen atoms, nitrogen atoms or sulfur atoms, necessary to form an unsaturated 5-, 6- or 7-membered ring.

* * * * *